US009050815B2

(12) United States Patent
Kobayashi et al.

(10) Patent No.: US 9,050,815 B2
(45) Date of Patent: Jun. 9, 2015

(54) LIQUID HOLDING CONTAINER AND LIQUID SUPPLY SYSTEM

(71) Applicant: SEIKO EPSON CORPORATION, Tokyo (JP)

(72) Inventors: Atsushi Kobayashi, Nagano (JP); Izumi Nozawa, Nagano (JP); Tadahiro Mizutani, Nagano (JP); Hiroyuki Nakamura, Nagano (JP); Hiroyuki Kawate, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/961,214

(22) Filed: Aug. 7, 2013

(65) Prior Publication Data

US 2014/0043411 A1 Feb. 13, 2014

(30) Foreign Application Priority Data

| | | |
|---|---|---|
| Aug. 8, 2012 | (JP) | 2012-175750 |
| Mar. 26, 2013 | (JP) | 2013-063527 |
| Jun. 4, 2013 | (JP) | 2013-117616 |

(51) Int. Cl.
*B41J 2/175* (2006.01)

(52) U.S. Cl.
CPC ..... *B41J 2/17523* (2013.01); *B41J 2/17513* (2013.01); *B41J 2/1752* (2013.01); *B41J 2/17546* (2013.01); *B41J 2/17553* (2013.01)

(58) Field of Classification Search
USPC ..... 347/84–86
See application file for complete search history.

(56) References Cited

U.S. PATENT DOCUMENTS

| | | | | |
|---|---|---|---|---|
| 6,010,213 | A * | 1/2000 | Kanaya et al. | 347/87 |
| 6,033,063 | A | 3/2000 | Tomikawa et al. | |
| 2005/0151811 | A1 | 7/2005 | Shimizu et al. | |
| 2007/0247497 | A1 * | 10/2007 | Buchanan et al. | 347/85 |

FOREIGN PATENT DOCUMENTS

| | | | |
|---|---|---|---|
| JP | 08-132633 | A | 5/1996 |
| JP | 2000-141697 | A | 5/2000 |
| JP | 2002-337355 | A | 11/2002 |
| JP | 2005-205893 | A | 8/2005 |
| JP | 2011-207066 | A | 10/2011 |

OTHER PUBLICATIONS

International Search Report for International Application No. PCT/JP2013/004620 mailed Oct. 22, 2013.

* cited by examiner

*Primary Examiner* — Stephen Meier
*Assistant Examiner* — Sharon A Polk
(74) *Attorney, Agent, or Firm* — Global IP Counselors, LLP

(57) ABSTRACT

A liquid holding container is adapted to supply liquid to a liquid introduction portion of a liquid consuming device. The liquid holding container includes a container and a first porous member. The container includes a liquid holding portion for holding the liquid, and a discharge port in communication with the liquid holding portion for discharging the liquid to the liquid introduction portion. The first porous member is provided on the discharge port for contacting the liquid introduction portion. The first porous member has a projecting part projecting in a direction from the liquid holding portion toward the discharge port.

14 Claims, 50 Drawing Sheets

LIQUID HOLDING CONTAINER AND LIQUID SUPPLY SYSTEM

CROSS-REFERENCE TO RELATED APPLICATIONS

This application claims priority to Japanese Patent Application No. 2012-175750 filed on Aug. 8, 2012, Japanese Patent Application No. 2013-063527 filed on Mar. 26, 2013, and Japanese Patent Application No. 2013-117616 filed on Jun. 4, 2013. The entire disclosures of Japanese Patent Application Nos. 2012-175750, 2013-063527 and 2013-117616 are hereby incorporated herein by reference.

BACKGROUND

1. Technical Field

The present invention relates to a liquid holding container and a liquid supply system.

2. Related Art

With a liquid consuming device in which a liquid holding container is mounted, as is noted in Japanese Unexamined Patent Publication No. 2005-205893, when mounting the liquid holding container in the liquid consuming device, by having a liquid supply portion provided in the liquid holding container and a liquid introduction portion provided in the liquid consuming device be in contact with each other, liquid is supplied from the liquid holding container to the liquid consuming device. For example, with the inkjet printer noted in Japanese Unexamined Patent Publication No. 2011-207066, foam is provided in the liquid supply portion of the ink cartridge, and a metal filter is provided in the liquid introduction portion of the ink cartridge, and liquid is supplied by these being in contact.

SUMMARY

However, with the technology noted in the above mentioned publications, there was no consideration of variation of width of the liquid supply portion or liquid introduction portion, changes in the installation environment, degradation that comes with repeated attachment and detachment or the like. Because of that, there was a desire for technology capable of good contact between the liquid supply portion and the liquid introduction portion even when these problems occur.

The present invention can be realized as the following modes or aspects in order to address at least a portion of the problems described above.

A liquid holding container according to one aspect is adapted to supply liquid to a liquid introduction portion of a liquid consuming device. The liquid holding container includes a container and a first porous member. The container includes a liquid holding portion for holding the liquid, and a discharge port in communication with the liquid holding portion for discharging the liquid to the liquid introduction portion. The first porous member is provided on the discharge port for contacting the liquid introduction portion. The first porous member has a projecting part projecting in a direction from the liquid holding portion toward the discharge port.

With the liquid holding container of this aspect, the first porous member has a projecting part projecting in the direction from the liquid holding portion toward the discharge port, so when the liquid holding container is mounted in the liquid consuming device, the first porous member is in contact with the liquid introduction portion from the projecting part. Because of that, the air that existed between the first porous member and the liquid introduction portion is gradually removed toward the outside from the projecting part of the first porous member that contacted the liquid introduction portion. As a result, it is possible to make it easy to avoid having air become sandwiched between the first porous member and the liquid introduction portion.

The liquid holding container noted above preferably further includes a biasing member provided on the liquid holding portion side of the first porous member to bias the first porous member in the direction from the liquid holding portion toward the discharge port.

With this aspect, the first porous member is biased by the biasing member in a the direction from the liquid holding portion toward the discharge port, so even when a problem occurs such as variation in the width of the discharge port or introduction portion, changes in the installation environment, or degradation accompanying repeated attachment and detachment, it is possible to have good contact between the first porous member and the liquid introduction portion. Because of that, the liquid inside the liquid holding container can be supplied stably to the liquid consuming device. The biasing member may bias the porous member directly, and may also bias it indirectly via another member.

A liquid supply system according to another aspect includes the liquid holding container noted above, and the liquid consuming device for introducing the liquid from the liquid holding container, wherein the liquid consuming device has the liquid introduction portion for introducing the liquid from the liquid discharge port, the liquid introduction portion has a cylindrical body and a second porous member provided on the cylindrical body, the first porous member has a convex form which is convex facing the second porous member, the second porous member has a concave form which is concave facing the first porous member, and a top part of the convex form of the first porous member in a direction facing the second porous member is configured be in contact with a portion of the concave form of the second porous member.

With the liquid supply system of this aspect, the liquid introduction portion has a cylindrical body and a second porous member provided on the cylindrical body, and the second porous member has a concave form that is concave facing the first porous member. Because of that, for example, when the liquid holding container that was mounted in the liquid consuming device is removed from the liquid consuming device, it is possible to make it easy to receive liquid dripped from the liquid holding container in the concavity of the liquid introduction portion. By doing that, it is possible to make it easy to avoid liquid dripped from the liquid holding container from spattering. Also, with this liquid supply system, the first porous member has a convex form that is convex facing the second porous member, and of the convex form of the first porous member, the top part in the direction facing the second porous member can be in contact with a portion of the concave form of the second porous member. Because of this, when the liquid holding container is mounted in the liquid consuming device, the porous member is in contact with the liquid introduction portion from the top part of the convex form. Because of this, the air that existed between the first porous member of the discharge port and the second porous member of the liquid introduction portion is gradually removed toward the outside from the top part of the convex form of the first porous member that contacted the second porous member. As a result, it is possible to make it easier to avoid air from becoming sandwiched between the discharge port and the liquid introduction portion.

A liquid supply system according to another aspect includes the liquid holding container noted above, and the liquid consuming device for introducing the liquid from the liquid holding container, wherein the liquid consuming device has the liquid introduction portion for introducing the liquid from the liquid discharge port, the liquid introduction portion has a cylindrical body and a second porous member provided on the cylindrical body, the first porous member has a convex form which is convex facing the second porous member, the second porous member has a convex form which is convex facing the first porous member, and a top part of the convex form of the first porous member in a direction facing the second porous member is configured to be in contact with a portion of the convex form of the second porous member.

With the liquid supply system of this aspect, the second porous member of the liquid introduction portion has a convex form that is convex facing the first porous member, so it is possible to have the first porous member of the discharge port and the second porous member of the liquid introduction portion be in contact with each other by their convex form parts. By doing this, it is possible to make it even easier to avoid air becoming sandwiched between the discharge port and the liquid introduction portion.

A liquid holding container according to another aspect is adapted to supply liquid to a liquid introduction portion of a liquid consuming device. The liquid holding container includes a container and a porous member. The container includes a liquid holding portion for holding the liquid, and a discharge port in communication with the liquid holding portion and configured to discharge the liquid to the liquid introduction portion. The porous member is provided on the discharge port and configured to be in contact with the liquid introduction portion. The porous member has a projecting part projecting in a direction from the liquid holding portion toward the discharge port. The projecting part has a top part contacting the liquid introduction portion.

With the liquid holding container of this aspect, the porous member has a projecting part projecting in the direction from the liquid holding portion toward the discharge port. Because of this, when the liquid holding container is mounted in the liquid consuming device, the porous member is in contact with the liquid introduction portion from the projecting part. Then, the air that existed between the porous member and the top part of the projecting part is gradually removed toward the outside with the top part of the projecting part of the porous member that contacted the liquid introduction portion as the center. As a result, it is possible make it easy to avoid air becoming sandwiched between the porous member and the liquid introduction portion.

In the liquid holding container noted above, the projecting part preferably has a shape for which the top part is configured to be in point contact with the liquid introduction portion.

With this aspect, the top part can be in point contact with the liquid introduction portion. Because of this, when the liquid holding container is mounted in the liquid consuming device, the top part can be in point contact with the liquid introduction portion. Then, the air that existed between the porous member and the liquid introduction portion is gradually removed toward the outside with the top part of the projecting part of the porous member that was in point contact with the liquid introduction portion as the center. As a result, it is possible to make it easier to avoid air becoming sandwiched between the porous member and the liquid introduction portion.

In the liquid holding container noted above, a shape of a cross section cutting the projecting part at a surface passing through the top part preferably has a curved line that does not include an inflection point, and the top part is preferably always positioned over the curved line part.

With this aspect, the shape of the cross section cutting the projecting part at the surface that the top part passes through has a curved line part that does not contain an inflection point. Then, the top part is always positioned over the curved line. Here, for example, when the shape of the cross section cutting the projecting part at the surface that the top part passes through has a curved line that does contain an inflection point, it is easy for air to become sandwiched between the porous member and the liquid introduction portion at the inflection point. However, with this embodiment, the shape of the cross section cutting the projecting part at the surface the top part passes through has a curved line part that does not contain an inflection point, and the top part is always positioned over the curved line, so it is easy to avoid air becoming sandwiched between the porous member and the liquid introduction portion.

In the liquid holding container noted above, a portion of the projecting part to be in contact with the liquid introduction portion is preferably a circular shape for which a shape of a cross section cutting in the direction from the liquid holding portion toward the discharge port includes an oval or a perfect circle.

With this aspect, of the projecting part, the part that can be in contact with the liquid introduction portion is a circular shape including an oval or perfect circle for the shape of the cross section cutting in the direction from the liquid holding portion toward the discharge port, so when the liquid holding container is mounted in the liquid consuming device, the top part can be in point contact with the liquid introduction portion. By doing this, the air that existed between the porous member and the liquid introduction portion is gradually removed toward the outside with the top part of the projecting part of the porous member that was in point contact with the liquid introduction portion as the center. As a result, it is possible to make it easy to avoid air becoming sandwiched between the porous member and the liquid introduction portion.

In the liquid holding container noted above, the top part preferably extends in a straight line.

With this aspect, the top part of the projecting part of the porous member extends in a straight line. When the liquid holding container is mounted in the liquid consuming device, the porous member is in contact with the liquid introduction portion from the projecting part. Then, the air that existed between the porous member and the liquid introduction portion is gradually removed toward the outside from the projecting part of the porous member that was in contact with the liquid introduction portion. At this time, it is possible to increase the exhaust volume of air that existed between the porous member and the liquid introduction portion per unit of time more when the top part extends in a straight line than when it is in dot form. As a result, it is possible to make it easier to avoid air becoming sandwiched between the porous member and the liquid introduction portion.

In the liquid holding container noted above, when two directions orthogonal to a direction in which the liquid is discharged from the discharge port to the liquid introduction portion are called a first direction and a second direction, and when the first direction and the second direction are orthogonal to each other, the porous member has a first width in the first direction and a second width in the second direction, the first width is preferably greater than the second width, and the top part preferably extends in a straight line along the first direction.

With this aspect, the two directions orthogonal to the direction in which the liquid is discharged from the discharge port to the liquid introduction portion are called a first direction and a second direction, and when the first direction and the second direction are orthogonal to each other, the porous member has a first width in the first direction and a second width in the second direction. Also, the first width is larger than the second width. With this shape, the top part extends in a straight line along the first direction. Here, the exhaust volume per unit of time of the air existing between the porous member and the liquid introduction portion depends on the length of the top part of the porous member. It is possible to increase the air exhaust efficiency more when the top part of the porous member is matched to the first direction with the larger width than when matched to the second direction with the smaller width. As a result, it is possible to make it easier to avoid air becoming sandwiched between the porous member and the liquid introduction portion.

In the liquid holding container noted above, the porous member has preferably a first part containing the top part and a second part that does not contain the top part, and in a process of mounting the liquid holding container in the liquid consuming device, the first part preferably projects further than the second part in the direction from the liquid holding portion toward the discharge port so that the first part is in contact with the liquid introduction portion ahead of the second part.

With this aspect, the porous member has a first part containing a top part and a second part that does not contain the top part. Then, in the process of the liquid holding container being mounted in the liquid consuming device, the first part projects more than the second part in the direction from the liquid holding portion toward the discharge port so that the first part can contact the liquid introduction portion ahead of the second part. By doing this, the porous member in contact with the liquid introduction portion during the first period in the mounting process is only the first part, and what starts new contact in the second period following the first period is only the second part. Here, when the surface area in simultaneous contact is large, there is an increase in the time required to allow the sandwiched air to escape to outside the porous member, so there is an increase in the possibility of air becoming sandwiched. However, if the surface area in simultaneous contact is made small such as with the aspect, it is possible to reduce the volume of air that fails to escape to outside the porous member during contact. As a result, the air that existed between the porous member and the introduction portion can easily be removed from between the porous member and the introduction portion.

In the liquid holding container noted above, a cross section of the porous member when the porous member is cut at a surface parallel to a direction in which the liquid is discharged from the discharge port to the liquid introduction portion preferably has a curved line, and the top part is preferably positioned over the curved line.

With this aspect, the cross section of the porous member when the porous member is cut at the surface parallel to the direction in which the liquid is discharged from the discharge port to the liquid introduction portion has a curved line. Also, the top part is positioned over the curved line. In the process when the liquid holding container is mounted in the liquid consuming device, by the top part being in contact with the liquid introduction portion, there is the effect of a reduction in the sandwiching of air between the porous member and the liquid introduction portion. Furthermore, the cross section of the porous member has a curved line, so in the process of the porous member contacting the liquid introduction portion and the shape of that cross section deforming from a curved line to a straight line, uneven wrinkles or the like occur less easily in the surface of the porous member. By doing that, when air sandwiched between the porous member and the liquid introduction portion is pushed out, the air can be pushed out more easily, so it is possible to make it harder for it to be left behind.

In the liquid holding container noted above, a projecting structure is preferably equipped between the porous member and the liquid holding portion, and in a state before the liquid holding container is mounted in the liquid consuming device, the top part of the porous member is preferably formed by the projecting structure.

With this aspect, by the projection of the projecting structure, a portion of the porous member is boosted up, and it is possible to form the projecting part easily. For example, when manufacturing the liquid holding container, it is possible to give a convex form by pressing the sheet form porous member on the projecting structure. By doing this, when manufacturing the liquid holding container, it is no longer necessary to form the porous member in a shape matching the projecting part in advance, so it is possible to simplify the manufacturing process.

In the liquid holding container noted above, the projecting structure preferably contains a flow path forming member, and the flow path forming member is preferably positioned between the porous member and the liquid holding portion so as to contact the porous member, and preferably has a convex part on a surface in contact with the porous member.

With this aspect, the flow path forming member is positioned between the porous member and the liquid holding portion so as to contact the porous member, and has a convex part on the surface in contact with the porous member. In this way, by processing the flow path forming member having a convex part in advance, it is possible to simplify the manufacturing process of incorporating the projecting structure in the liquid holding container.

In the liquid holding container noted above, the projecting structure preferably contains a flow path forming member and a convex member, the flow path forming member is preferably positioned between the porous member and the liquid holding portion so as to contact the porous member, and the convex member is preferably positioned between the porous member and the flow path forming member so as to contact the porous member.

With this aspect, the flow path forming member is positioned between the porous member and the liquid holding portion so as to contact the porous member, and the convex member is positioned between the porous member and the flow path forming member so as to contact the porous member. In this way, by forming the flow path forming member and the convex member as separate parts, it is possible to make it easy to do the machining fabrication of each member constituting the projecting structure.

In the liquid holding container noted above, the projecting structure preferably contains a flow path forming member and a biasing member, the flow path forming member is preferably positioned between the porous member and the liquid holding portion so as to be in contact with the porous member, and the biasing member is preferably positioned between the flow path forming member and the liquid holding portion so as to be in contact with the flow path forming member, and preferably has a convex part on a surface in contact with the flow path forming member.

With this aspect, the projecting structure contains a flow path forming member and a biasing member, the flow path forming member is positioned between the porous member and the liquid holding portion so as to be in contact with the porous member, and the biasing member is positioned between the flow path forming member and the liquid holding portion so as to be in contact with the flow path forming member, and has a convex part on the surface in contact with the flow path forming member. The biasing member is a structure having a function of biasing the flow path forming member, so it is harder than the flow path forming member. When forming a structure such as the convex part, an item that is hard is more suitable than a flexible item for machining. In this way, by giving a convex part to the biasing member, it is possible to make it easy to do machining fabrication of each part constituting the projecting structure.

In the liquid holding container noted above, the projecting structure preferably contains a flow path forming member, a biasing member, and a convex member, the flow path forming member is preferably positioned between the porous member and the liquid holding portion so as to be in contact with the porous member, and the convex member is preferably positioned between the flow path forming member and the biasing member so as to be in contact with the flow path forming member.

With this aspect, the projecting structure contains a flow path forming member, a biasing member, and a convex member, the flow path forming member is positioned between the porous member and the liquid holding portion so as to be in contact with the porous member, and the convex member is positioned between the flow path forming member and the biasing member so as to be in contact with the flow path forming member. In this way, by forming the biasing member and the convex member as separate parts, it is possible to make it easy to do the machining fabrication of each member constituting the projecting structure.

BRIEF DESCRIPTION OF THE DRAWINGS

Referring now to the attached drawings which form a part of this original disclosure:

FIG. 2 is a perspective view of the holder the cartridge is mounted in.

DETAILED DESCRIPTION OF EXEMPLARY EMBODIMENTS

Figure 1:
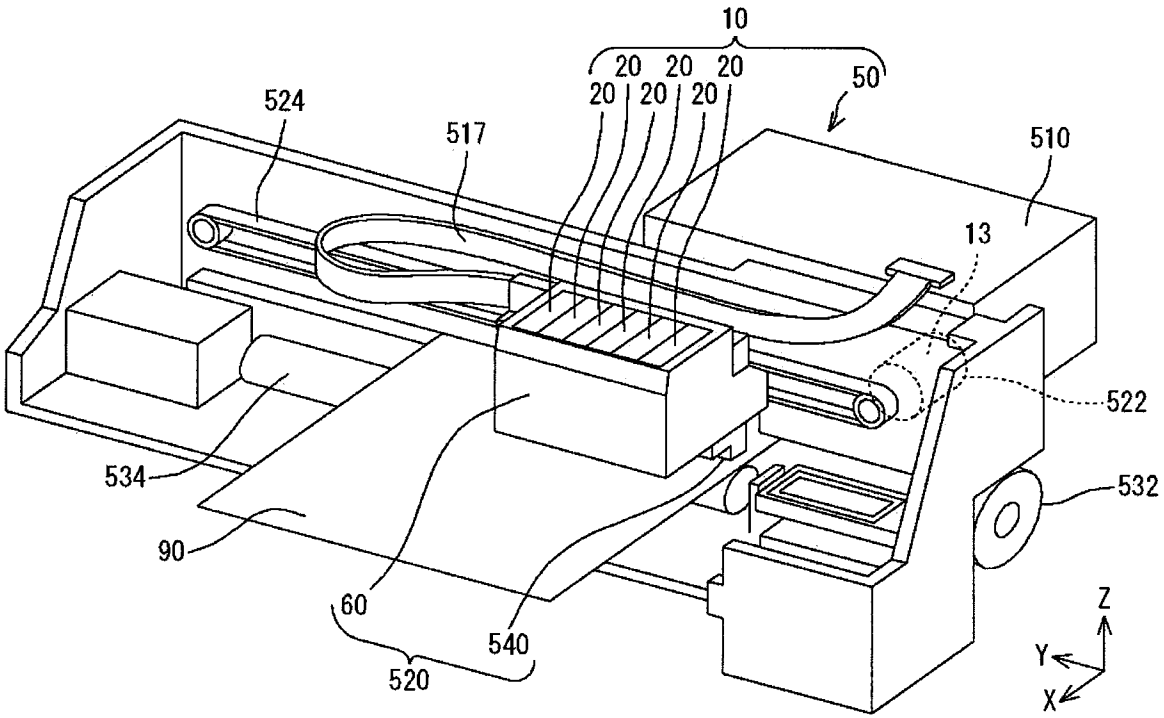
FIG. 1 is a perspective view showing the constitution of the liquid supply system.

FIG. 1 is a perspective view showing the constitution of the liquid supply system 10 of this embodiment. The liquid supply system 10 is equipped with a cartridge 20 as a liquid holding container which holds ink inside, and a printer 50 as a liquid consuming device. In FIG. 1, mutually orthogonal XYZ axes are depicted. The XYZ axes of FIG. 1 correspond to the XYZ axes of other drawings. In drawings shown hereafter, XYZ axes are attached as necessary. With the use orientation of the printer 50, the −Z axis direction is vertically downward, and the printer 50 +X axis direction surface is the front surface.

The printer 50 has a main scan feed mechanism, a sub scan feed mechanism, and a head drive mechanism. The main scan feed mechanism uses the power of a carriage motor 522 and moves a carriage 520 connected to a drive belt 524 back and forth in the main scan direction. The sub scan feed mechanism conveys printing paper 90 in the sub scan direction using a paper feed roller 534 which uses a paper feed motor 532 for power. With this embodiment, the main scan direction of the printer 50 is the Y axis direction, and the sub scan direction is the X axis direction. The head drive mechanism drives the print head 540 equipped on the carriage 520 and performs discharging of ink. The printer 50 is equipped with a control unit 510 for controlling each of the mechanisms described above. The control unit 510 is connected to the carriage 520 via a flexible cable 517.

The carriage 520 is equipped with a holder 60 in which the cartridge 20 is mounted, and a print head 540 on which are arranged so as to face opposite the printing paper 90 a plurality of nozzles 541 (see FIG. 6) for discharging ink. The holder 60 is constituted to be able to mount a plurality of cartridges 20, and is arranged on the top side of the print head 540. The cartridges 20 mounted in the holder 60 are aligned in the Y axis direction. With the example shown in FIG. 1, six cartridges can be mounted independently in the holder 60, and for example, one each of six types of cartridge including black, yellow, magenta, cyan, light cyan, and light magenta are mounted. As the holder 60, it is possible to use an item for which any of a plurality of types of cartridge other than these can be mounted.

Figure 2:
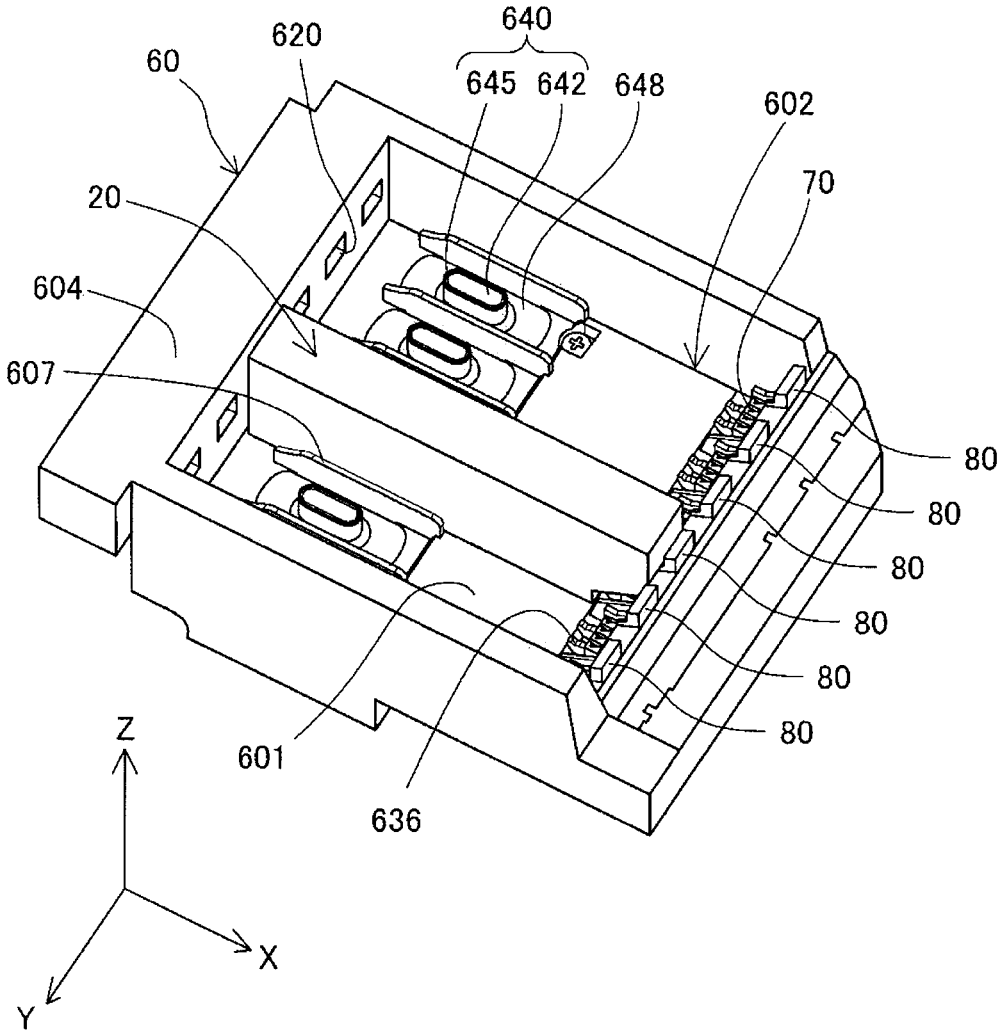

FIG. 2 is a perspective view of the holder 60 the cartridge 20 is mounted in. In FIG. 2, a state for which one cartridge 20 is mounted in the holder 60 is shown. The holder 60 is equipped with a cartridge housing chamber 602 in which the cartridge 20 is mounted from above. The cartridge housing chamber 602 is divided by partition walls 607 into a plurality of slots (mounting spaces) which can accept each cartridge 20. This kind of partition wall 607 functions as a guide when inserting the cartridge 20 into a slot. It is also possible to omit the partition walls 607.

In the cartridge housing chamber 602, for each slot, provided are a lever 80, a recess 620, a protruding part 636, a liquid introduction portion 640, and a contact mechanism 70.

The lever 80 is provided on the +X axis direction side of the cartridge housing chamber 602, and the recess 620 is provided on the wall surface of the −X axis direction side of the cartridge housing chamber 602. When the cartridge 20 is mounted along the partition wall 607 from above the cartridge housing chamber 602, the cartridge 20 is locked by the lever 80 and the recess 620. When the cartridge 20 is mounted in the cartridge housing chamber 602, a liquid supply portion 280 (see FIG. 3) of the cartridge 20 is connected to the liquid introduction portion 640 provided on a bottom surface 601 of the cartridge housing chamber 602.

The liquid introduction portion 640 has a device side cylindrical body 645 provided on the bottom surface 601 of the cartridge housing chamber 602, and a device side filter 642 as a device side porous member provided on the tip surface (+Z axis side surface) of the device side cylindrical body 645. The device side filter 642 is formed, for example, by a porous member such as metal mesh, metal non-woven fabric, a resin filter or the like. Inside the device side cylindrical body 645, an ink flow path 646 in communication with the print head 540 is formed in a funnel shape along the Z axis direction (see FIG. 6). The device side filter 642 provided on the tip of the device side cylindrical body 645 is in contact with a container side filter 273 provided on the liquid supply portion 280 of the cartridge 20 (see FIG. 6). An elastic member 648 is provided on the circumference of the liquid introduction portion 640. In a state with the cartridge 20 mounted in the holder 60, the elastic member 648 seals closed the circumference of the liquid supply portion 280 of the cartridge 20. By doing this, the elastic member 648 prevents ink from leaking to the periphery from the liquid supply portion 280.

The contact mechanism 70 is electrically connected to the control unit 510 via the flexible cable 517. In a state with the cartridge 20 mounted in the holder 60, the contact mechanism 70 is in electrical contact with a terminal group 400 provide on a circuit substrate 40 of the cartridge 20 (see FIG. 3). By having the contact mechanism 70 and the terminal group 400 of the cartridge 20 in electrical contact in this way, it is possible to transmit various types of information between the control unit 510 and the cartridge 20.

Figure 3:
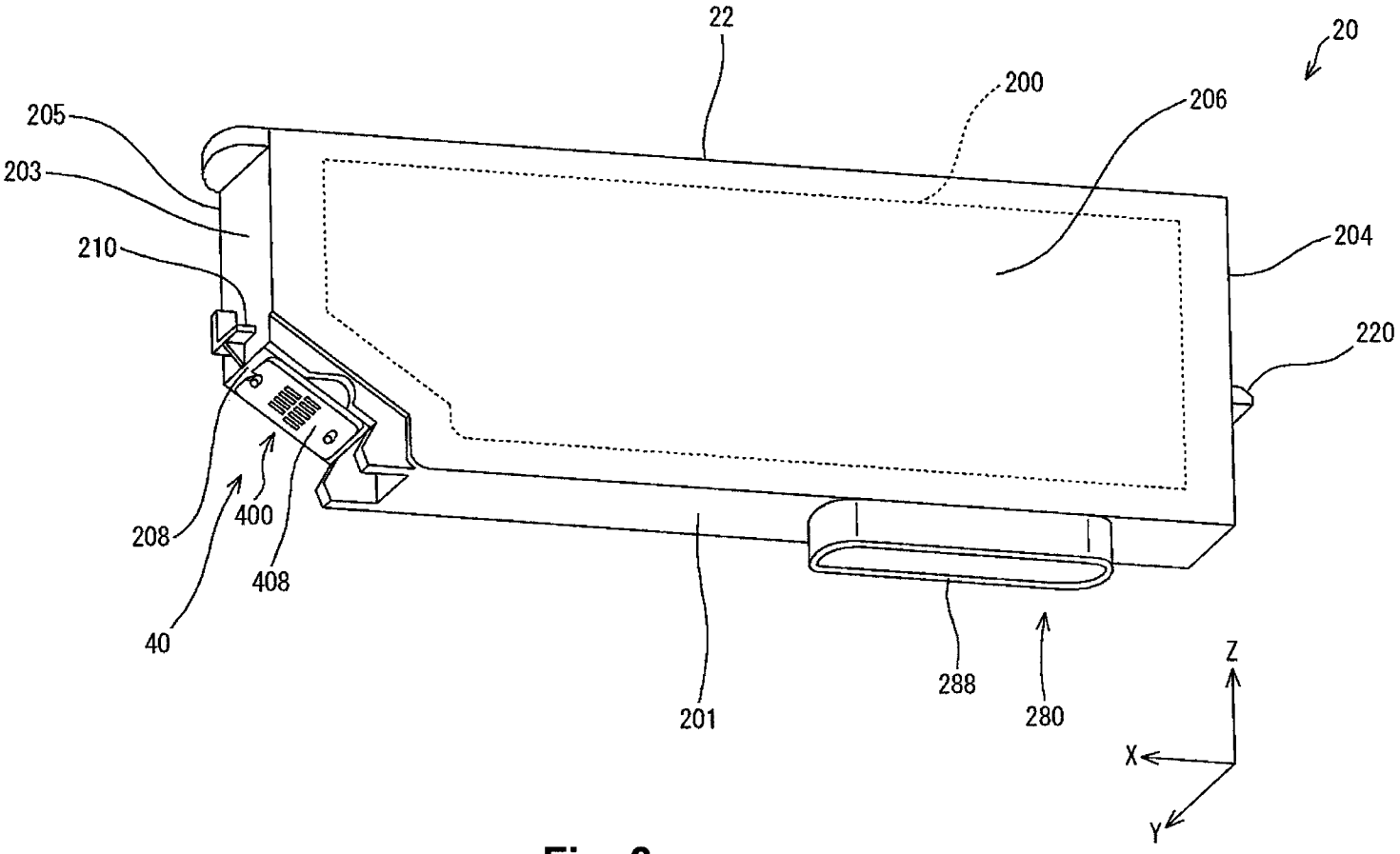
FIG. 3 is a perspective view showing the constitution of the cartridge.

FIG. 3 is a perspective view showing the constitution of the cartridge 20. The cartridge 20 is equipped with a case 22 formed by a synthetic resin such as polypropylene (PP) or the like, a liquid holding portion 200 formed inside the case 22, the liquid supply portion 280 provided on the bottom surface of the case 22, and the circuit substrate 40.

A first projecting part 210 is provided on a front surface 203 of the case 22 (+X axis direction side surface). When the cartridge 20 is mounted in the holder 60, the first projecting part 210 is locked by the lever 80 (see FIG. 2) provided on the cartridge housing chamber 602.

A second projecting part 220 is provided on a back surface 204 (−X axis direction surface) of the case 22. When the cartridge 20 is mounted in the holder 60, the second projecting part 220 is locked by the recess 620 provided on the cartridge housing chamber 602.

A slope face 208 is provided at the corner at which the front surface 203 of the case 22 and a bottom surface 201 (−Z axis direction surface) intersect. The circuit substrate 40 is provided on the slope face 208. The terminal group 400 in contact with the contact mechanism 70 (FIG. 2) is provided on a surface 408 of the circuit substrate 40. On the back surface of the circuit substrate 40 is mounted a memory device such as an EEPROM or the like electrically connected to the terminal group 400.

The liquid supply portion 280 is in communication with the liquid holding portion 200 inside the case 22. The liquid supply portion 280 is equipped with a container side cylindrical body 288 for which the tip (−Z axis direction edge part) is opened. In a state with the cartridge 20 mounted in the holder 60, the tip part of the container side cylindrical body 288 is adhered to the elastic member 648 provided on the bottom surface 601 of the holder 60.

Figure 4:
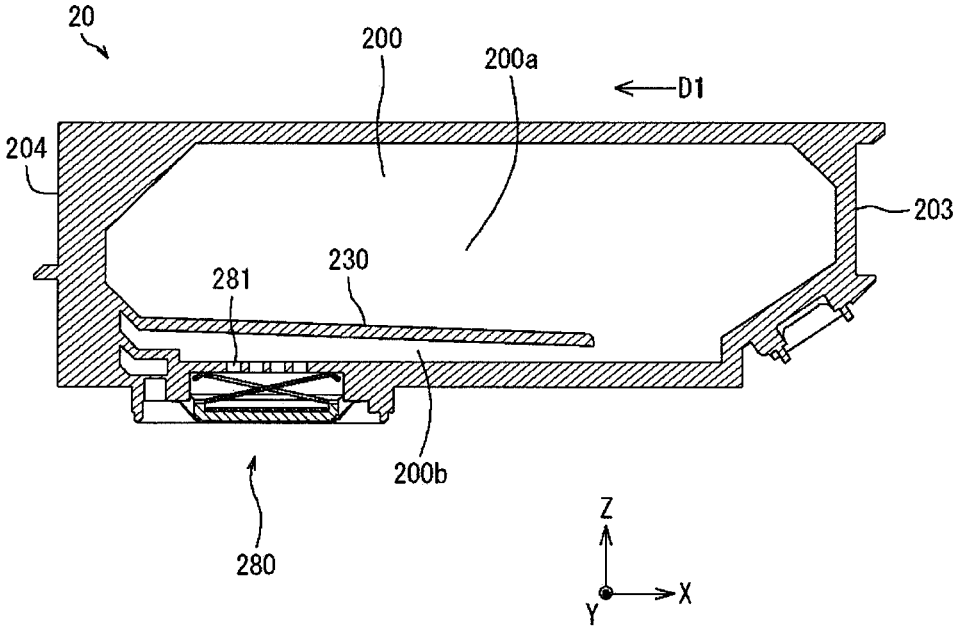
FIG. 4 is a drawing showing the ZX cross section of the cartridge.

FIG. 4 is a drawing showing the ZX cross section of the cartridge 20. A liquid holding portion 200 is formed on the interior of the cartridge 20. A communication port 281 for supplying liquid to the liquid supply portion 280 is provided on the bottom surface of the liquid holding portion 200. On the top part of the communication port 281, a partition plate 230 that partitions the liquid holding portion 200 into an upper space 200*a* and a lower space 200*b* is provided. The partition plate 230 is in contact with two side surfaces (+Y axis direction side surface and −Y axis direction side surface) and the back surface 204 of the case 22, and is inclined from the back surface 204 side toward the front surface 203 side facing the −Z axis direction (vertically downward). The lower space 200*b* formed by this partition plate 230 becomes a space in which air bubbles pool when air (air bubbles) flow into the cartridge 20 from the liquid supply portion 280. This partition plate 230 may also be omitted.

Figure 5:
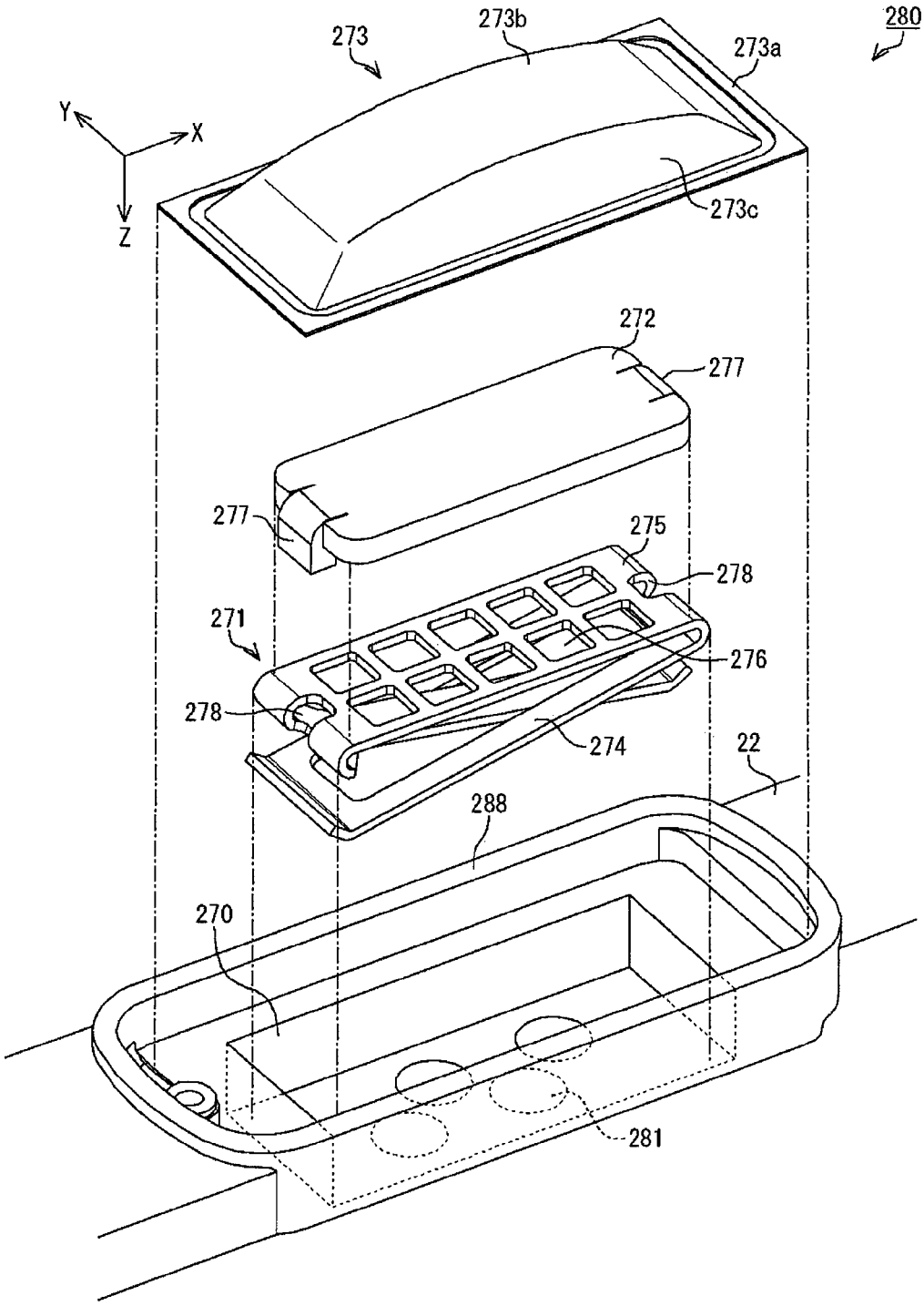
FIG. 5 is an exploded perspective view of the liquid supply portion.
Figure 6:
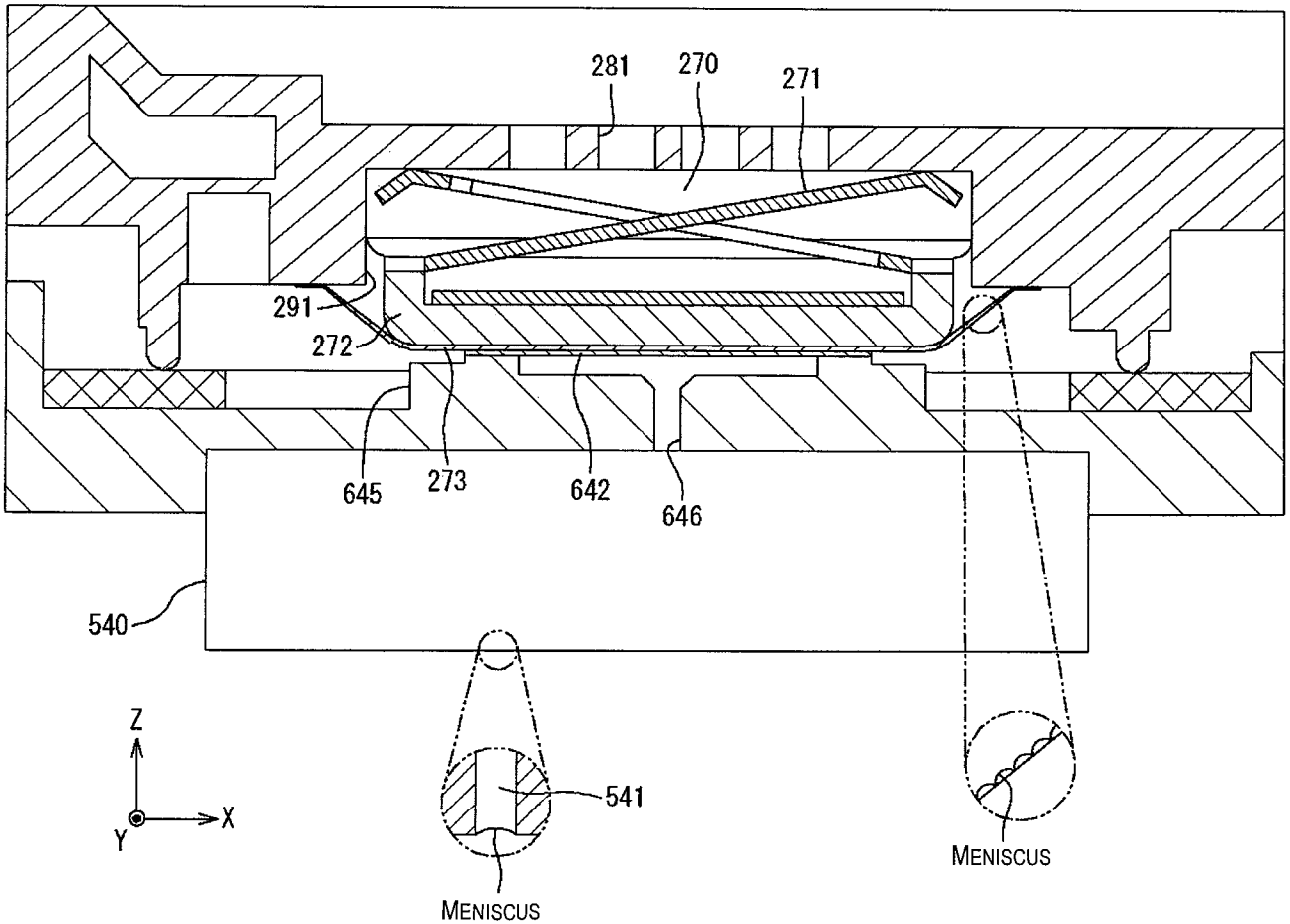
FIG. 6 is a ZX cross section diagram of the state when the liquid supply portion is in contact with the liquid introduction portion.

FIG. 5 is an exploded perspective view of the liquid supply portion 280. FIG. 6 is a ZX cross section diagram of the state when the liquid supply portion 280 is in contact with the liquid introduction portion 640. As shown in these drawings, the liquid supply portion 280 is constituted with a flat spring 271, a foam 272 as a flow path forming member, and a container side filter 273 as a container side porous member arranged on a recess 270 provided on the bottom surface 201 of the case 22. On the bottom of the recess 270 is arranged a communication port 281 that communicates with the lower space 200*b* inside the liquid holding portion 200. Also, as shown in FIG. 6, a discharge port 291 is formed on the side facing opposite to the communication port 281 side of the recess 270.

The container side filter 273 is a porous member provided on the outermost surface of the liquid supply portion 280. The circumferential edge part 273*a* of the container side filter 273 is adhered to the case 22 of the circumference of the recess 270. The container side filter 273 covers the discharge port 291. As shown in FIG. 5, the center part 273*b* of the container side filter 273 has a convex form projecting part that is convex facing the side opposite to the flat spring 271 side of the container side filter 273 from the flat spring 271 side of the container side filter 273, specifically, facing the −Z axis direction from the +Z axis direction. Also, the center part 273*b* projects facing further to the outside (−Z axis direction side) than the circumferential edge part 273*a* of the container side filter 273. In a state with the cartridge 20 mounted in the holder 60, the device side filter 642 provided on the holder 60 is in contact with the center part 273*b* of the container side filter 273. In a state with the cartridge 20 mounted in the holder 60, an ink meniscus is formed without an inclined part 273*c* between the container side filter 273 circumferential edge part 273*a* and the center part 273*b* being in contact with the device side filter 642 (see FIG. 6). With this meniscus, in a state with the cartridge 20 mounted in the holder 60, leaking of liquid from the inclined part 273*c* of the container side filter 273 is inhibited.

As the container side filter 273, it is preferable to use a filter for which adhesion to the case 22 is possible, pressure loss is small, and meniscus pressure resistance is high. As this kind of filter, for example, it is possible to use a filter formed by opening film through-holes using press working or the like, an asymmetric membrane such as an MMM membrane made by PALL Corp. or a symmetric membrane such as woven fabric, for example. As the woven fabric, for example, it is possible to use woven fabric made by FILTRONA Corp. or the like.

The container side filter 273 can be molded for example by pressing the filter noted above using a mold. Pressing using a mold is called embossing. The convex state of the container side filter 273 (boost) is can be formed by implementing embossing on the filter.

Also, when not embossing, for example with the process of adhering a flat woven fabric to the case 22, it is possible to deform the woven fabric to the convex shape. "Meniscus pressure resistance" means the pressure that can be withstood without the ink (liquid) meniscus breaking, and is also called "bubble point pressure."

The flat spring 271 is equipped with a biasing member 274 and a support member 275 as an integrated unit. The flat spring 271 has almost the same or a slightly higher height than the depth of the recess 270 provided in the case 22. The flat spring 271 is arranged inside the recess 270 with the support member 275 side facing the container side filter 273 (−Z axis direction side) The biasing member 274 is formed by the leg parts provided at both ends of the long plate form support member 275 being bent so as to intersect at the +Z axis direction side. A plurality of circulation holes 276 are provided piercing through in the Z axis direction on the flat plate shaped support member 275. When the cartridge 20 is mounted in the holder 60, the biasing member 274 has the function of putting the container side filter 273 in contact with the device side filter 642 while pressing it indirectly via the foam 272. During this pressing, the support member 275 supports the container side filter 273 in planar form indirectly via the foam 272, and causes surface contact of the container side filter 273 on the device side filter 642. With this embodiment, the biasing member 274 and the support member 275 are formed as an integrated unit, but it is also possible to constitute these as separate members. Also, the biasing member 274 can also be constituted by another elastic body such as a coil spring, elastic rubber or the like.

As the foam 272, for example, it is possible to use a urethane type foam material, a polyethylene foam material or the like. Also, as the material of the foam 272, for example, it is possible to use a sponge, nonwoven fabric, felt or the like. By interposing the foam 272 between the flat spring 271 and the container side filter 273, it is easy to make the flow volume of ink flowing from the discharge port 291 to the print head 540 side uniform across the discharge port 291 area. The communication port 281 and the circulation hole 276 of the flat spring 271 is positioned partially at the discharge port 291 area. Because of this, it is easy for the flow volume of ink flowing from the discharge port 291 side to the print head 540 side to be partially deviated. However, with this embodiment, since the foam 272 is interposed between the flat spring 271 and the container side filter 273, it is easier for the ink flow volume to be uniform across the discharge port 291 area.

The foam 272 is a porous member arranged between the flat spring 271 and the container side filter 273. The foam 272 disperses and supplies liquid supplied from within the liquid holding portion 200 through the circulation holes 276 provided on the support member 275 of the flat spring 271 in planar form to the container side filter 273. The thickness of the foam 272 is set to a thickness for which it is possible to disperse the liquid supplied from the circulation holes 276 in planar form. Also, the rigidity of the foam 272 is a rigidity of a level for which the flow path inside the foam 272 is not blocked in a state with the container side filter 273 biased to the device side filter 642 by the flat spring 271. Jutting parts 277 bent to the flat spring 271 side are provided at the foam 272 +X axis direction side end part and the −X axis direction side end part. The jutting parts 277 are fit in the recesses 278 provided at the flat spring 271 +X axis direction side end part and the −X axis direction side end part. By doing this, the foam 272 is aligned in relation to the flat spring 271.

Also, by having the foam 272 positioned between the liquid holding portion 200 and the container side filter 273 so as to contact the container side filter 273, it is possible to deform the container side filter 273 to a convex form.

FIG. 7, FIGS. 8A and 8B, and FIGS. 9A and 9B are explanatory drawings showing the operation when the cartridge 20 is mounted in the holder 60 (mounting operation). FIG. 7, FIGS. 8A and 8B, and FIGS. 9A and 9B showing the ZX cross section of the cartridge 20 and the holder 60 are in time series in sequence of FIG. 7, FIGS. 8A and 8B, and FIGS. 9A and 9B.

Figure 7:
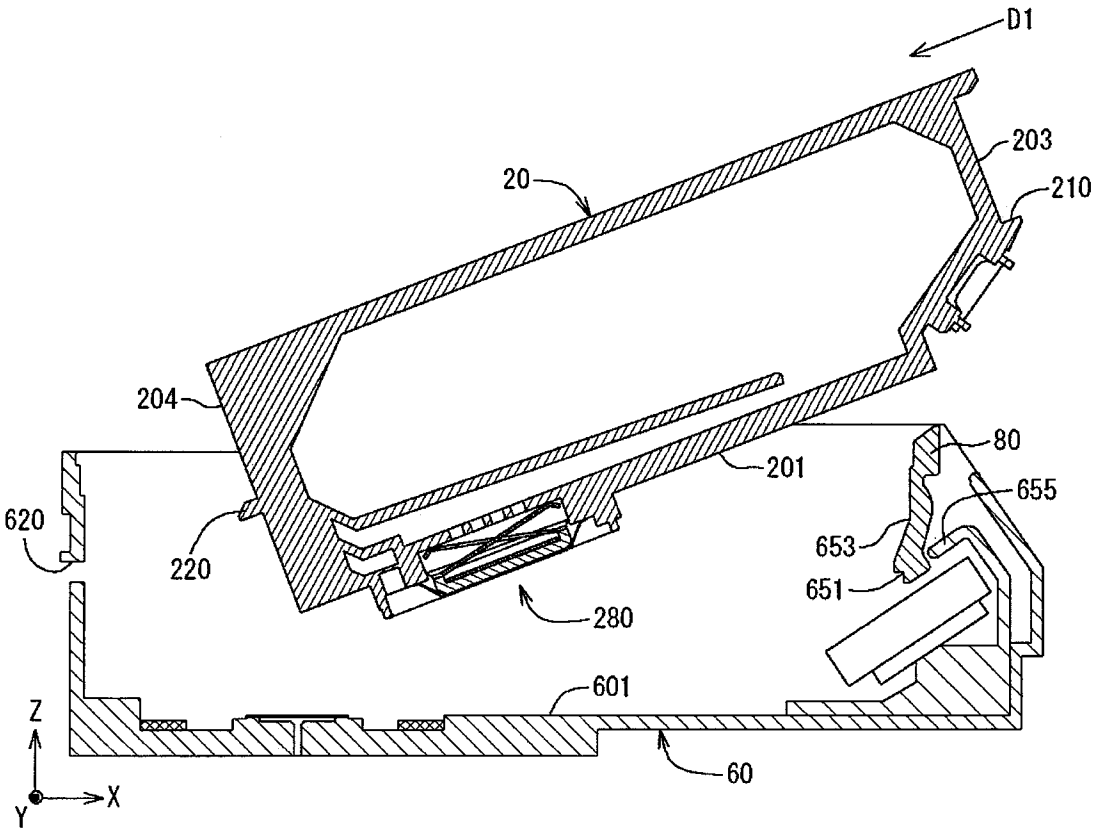
FIG. 7 is an explanatory drawing showing the cartridge mounting operation.

As shown in FIG. 7, when mounting the cartridge 20 in the holder 60, in a state with the cartridge 20 tilted in relation to the holder 60, the cartridge 20 is inserted in the holder 60 from the second projecting part 220 side along the arrow direction D1 in the drawing. At this time, in a state with the liquid supply portion 280 facing the bottom surface 601 of the holder 60, the cartridge 20 is tilted in the direction for which the distance between the bottom surface 201 and the bottom surface 601 of the holder 60 widens as it goes from the back surface 204 side to the front surface 203 side. The arrow direction D1 is the mounting direction when mounting the cartridge 20 in the holder 60. Hereafter, the direction D1 is noted as the mounting direction D1. The mounting direction D1 has the same tilt as the tilt of the cartridge 20 in relation to the holder 60. The mounting direction D1 is the same direction as the extension direction of the cartridge 20. In other words, as shown in FIG. 4, with the cartridge 20 alone, the mounting direction D1 is along the X direction.

The mounting direction with this embodiment means the insertion direction of the container side filter 273 in relation to the device side filter 642 on the XY plane when mounting the cartridge 20 in the holder 60. For example, after the insertion orientation of the cartridge 20 is regulated by a partition wall 607 or the like, the direction for inserting the container side filter 273 of the cartridge 20 in the device side filter 642 of the holder 600 is definitively set. As a result, the mounting direction D1 is the −X axis direction.

Figure 8A:
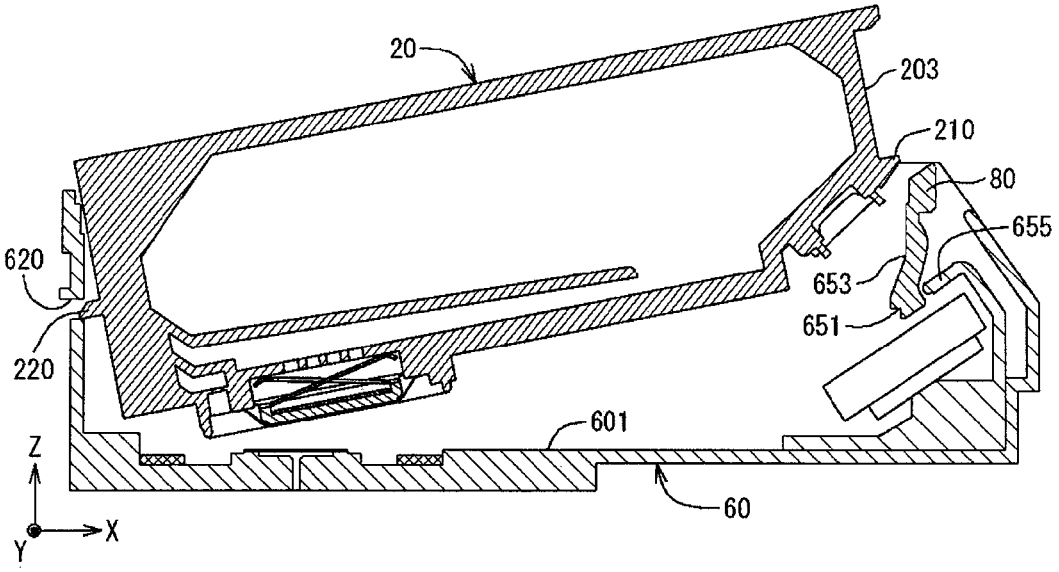
FIGS. 8A and 8B are explanatory drawings showing the cartridge mounting operation.

Next, as shown in FIG. 8A, the second projecting part 220 is inserted in the recess 620. In the state shown in FIG. 8A, the first projecting part 210 of the cartridge 20 is positioned at the +Z axis direction side of a regulating part 651 which is at the lever 80 of the holder 60 side.

Next, from the state shown in FIG. 8A, with the second projecting part 220 inserted in the recess 620 as the rotational fulcrum, the cartridge 20 is rotated (turned) clockwise seen from the +Y axis direction, in other words, so as to press the front surface 203 side toward the bottom surface 601 of the holder 60. Having done that, as shown in FIG. 8B, the first projecting part 210 advances in the Z axis direction while the movement in the Y axis and X axis directions is restricted by a guide part 653 of the lever 80.

Figure 8B:
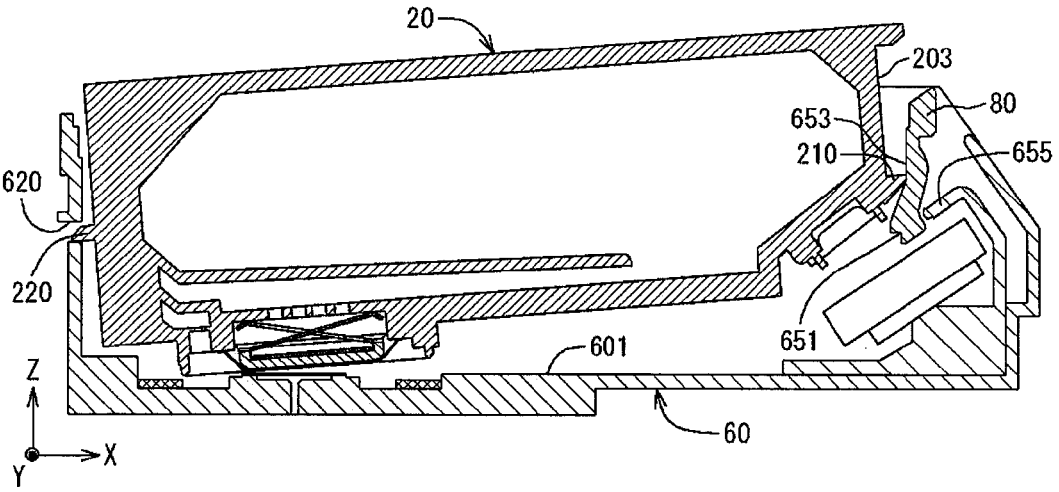
Figure 9A:
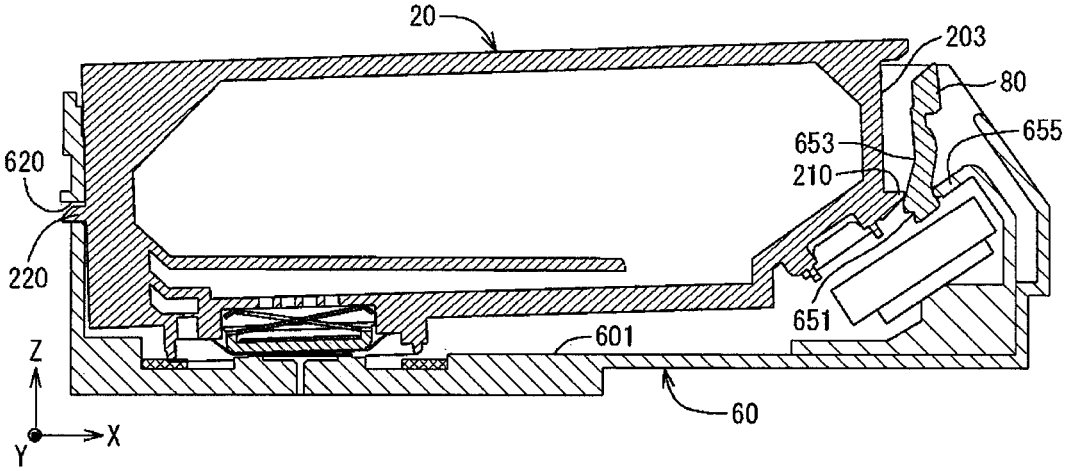
FIGS. 9A and 9B are explanatory drawings showing the cartridge mounting operation.

Furthermore, from the state shown in FIG. 8B, when rotated so as to push in the front surface 203 side of the cartridge 20, the first projecting part 210 is pushed further to the −Z axis direction side. Having done that, as shown in FIG. 9A, the lever 80 is pushed to the +X axis direction by the first projecting part 210, and rotates (turns) counterclockwise seen from the +Y axis direction. At that time, the lever 80 contacts an elastic member 655 and biasing force in the direction pushing the lever 80 back in the clockwise direction seen from the +Y axis direction is received from the elastic member 655. This biasing force is an external force that includes a −X axis direction component. In other words, the turning area of the lever 80 is restricted by the elastic member 655. The state with the lever 80 in contact with the elastic member 655 and being biased is maintained until the cartridge 20 is further pushed in from the state shown in FIG. 9A and the first projecting part 210 goes past the guide part 653 of the lever 80.

Figure 9B:
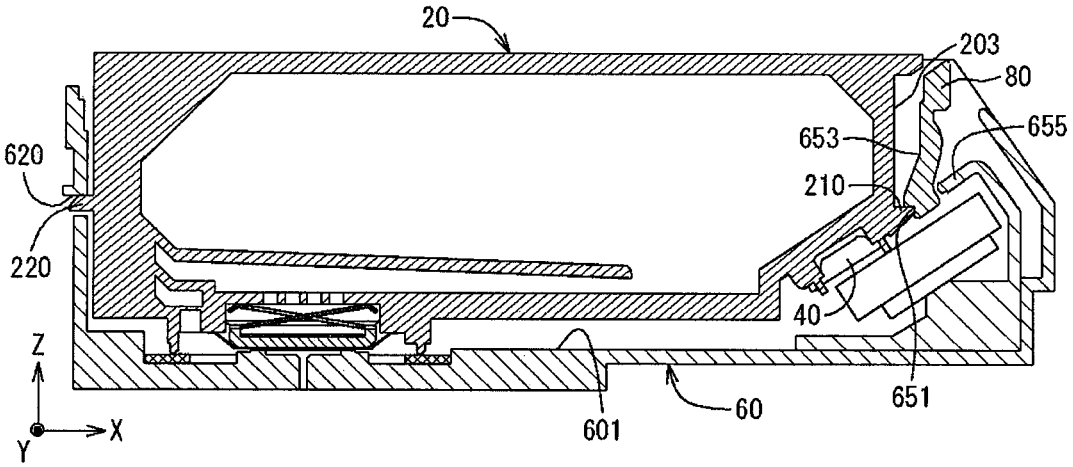

Furthermore, from the state shown in FIG. 9A, the front surface 203 side of the cartridge 20 is rotated so as to push in, and when the first projecting part 210 goes past the guide part 653 of the lever 80, as shown in FIG. 9B, the lever 80 is rotated such that the first projecting part 210 moves in the −X axis side direction. By doing this, the regulating part 651 locks the first projecting part 210. When the first projecting part 210 is locked by the regulating part 651, the movement of the cartridge 20 to the +Z axis direction and to the +X axis direction are restricted. By the liquid supply portion 280 of the cartridge 20 connecting with the liquid introduction portion 640, the second projecting part 220 and the recess 620 engaging, and the first projecting part 210 and the regulating part 651 engaging, the mounting of the cartridge 20 into the holder 60 is completed. Also, by the cartridge 20 being mounted correctly in the designed mounting position, the terminal group 400 (FIG. 3) of the circuit substrate 40 and the terminal group (not illustrated) on the device side are electrically connected to each other, and signals are transmitted between the cartridge 20 and the printer 50.

Figure 10A:
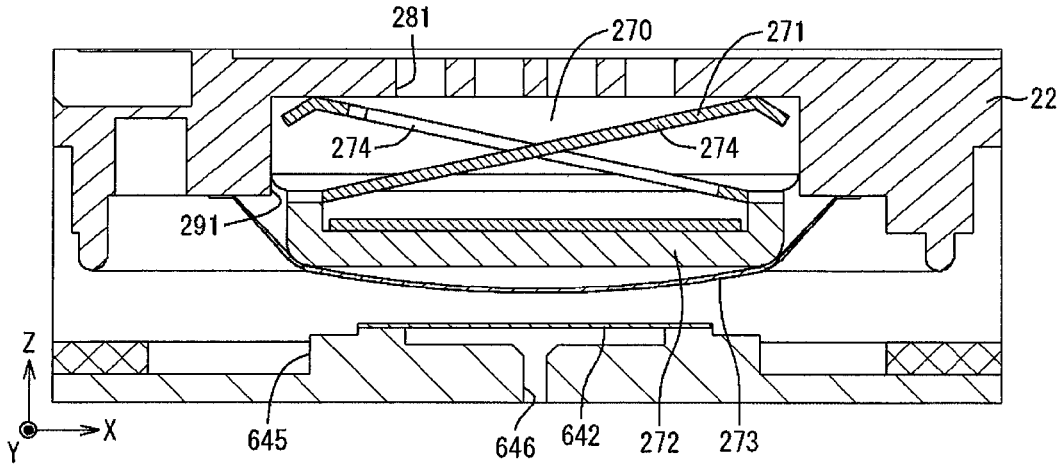
FIGS. 10A and 10B are explanatory drawings showing the liquid supply portion operation when the cartridge is mounted in the holder.
Figure 10B:
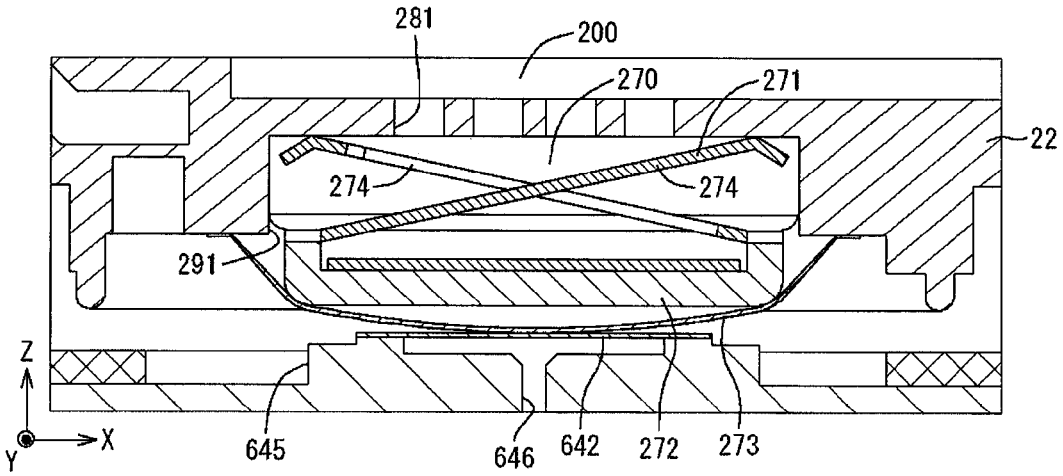
Figure 11A:
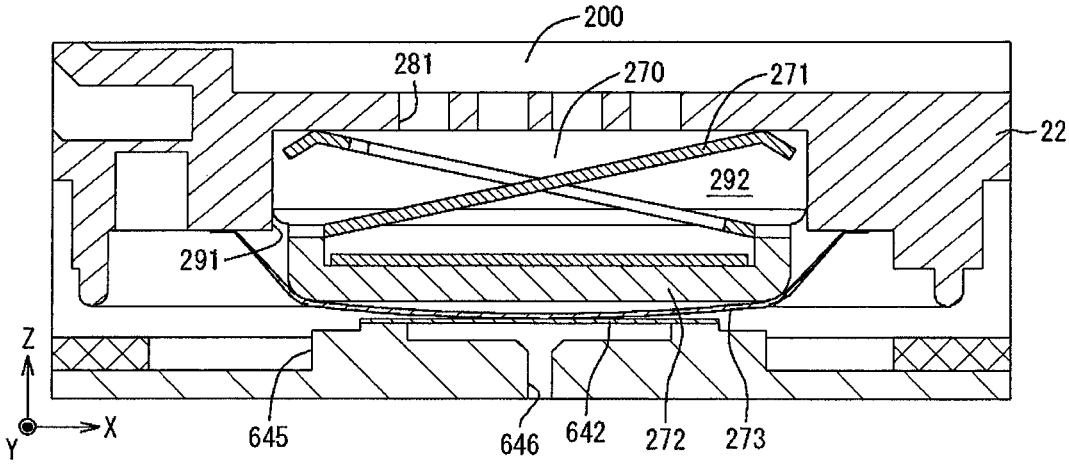
FIGS. 11A and 11B are explanatory drawings showing the liquid supply portion operation when the cartridge is mounted in the holder.

FIGS. 10A and 10B and FIGS. 11A and 10B are explanatory drawings showing the operation of the liquid supply portion 280 when the cartridge 20 is mounted in the holder 60. FIGS. 10A and 10B and FIGS. 11A and 10B show the ZX cross section of the liquid supply portion 280 and the liquid introduction portion 640. With this embodiment, as shown in FIG. 10A, the container side filter 273 is boosted in the −Z axis direction. When the cartridge 20 is mounted in the holder 60, the cartridge 20 is pushed into the holder 60. Because of this, the case 22 of the cartridge 20 drops in the −Z axis direction in relation to the device side cylindrical body 645 of the holder 60.

In the process of mounting the cartridge 20 in the holder 60, as shown in FIG. 10B, with the liquid supply portion 280, first, the container side filter 273 contacts the device side filter 642. At this time, at the container side filter 273, the top part which is the site projecting the furthest on the −Z axis direction starts contacting the device side filter 642. At this time, between the container side filter 273 and the device side filter 642, there is a gap at both sides in the X axis direction sandwiching the site at which the container side filter 273 and the device side filter 642 start contacting each other. Following, the site at which the container side filter 273 and the device side filter 642 start contacting each other is noted as the contact start part.

The gap between the container side filter 273 and the device side filter 642 broadens respectively in the +X axis direction and the −X axis direction with the contact start part as the base point.

When the cartridge 20 is pushed further into the holder 60, the container side filter 273 receives reactive force from the device side filter 642. By doing this, as shown in FIG. 11A, the convex state (boost) of the container side filter 273 is eased. As a result, the gap between the container side filter 273 and the device side filter 642 becomes narrow compared to the state in FIG. 10B.

Figure 11B:
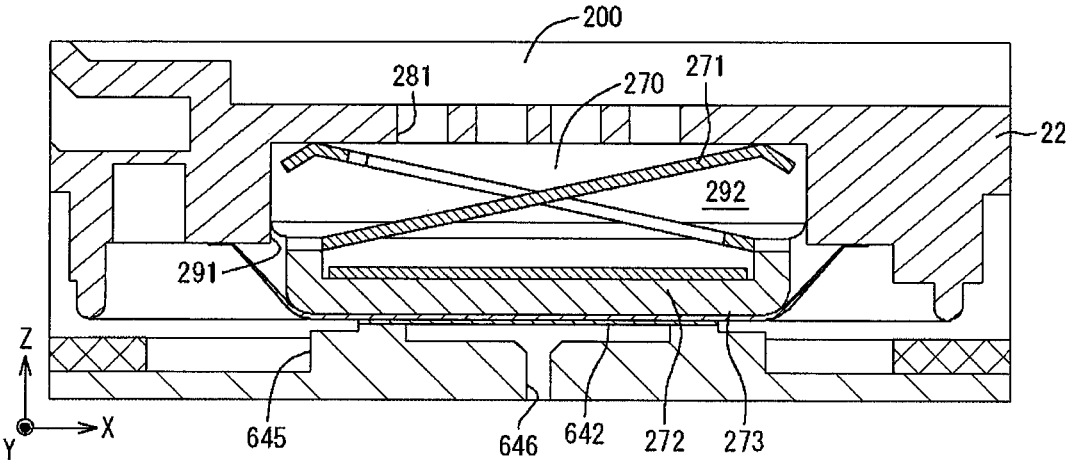

When the cartridge 20 is pushed further into the holder 60, the container side filter 273 is sandwiched by the device side filter 273 and the foam 272. By doing this, as shown in FIG. 11B, the convex state (boost) of the container side filter 273 is further eased. As a result, the gap between the container side filter 273 and the device side filter 642 is even narrower compared to the state shown in FIG. 11A.

Then, when the cartridge 20 is further pushed into the holder 60, the container side filter 273 is pushed further to the recess 270 side by the device side cylindrical body 645. By doing this, the flat spring 271 receives compression force, and the flat spring 271 is contracted toward the liquid holding portion 200 side. Then, by the contraction of the flat spring 271, the position of the container side filter 273 in relation to the case 22 is displaced toward the communication port 281 side. As a result, a space 292 enclosed by the recess 270 and the container side filter 273 is compressed.

Here, the communication port 281 is provided between the liquid holding portion 200 and the space 292. By the communication port 281, the volume of ink flowing into the space 282 from the liquid holding portion 200 is narrowed. Because of this, when the space 292 is compressed by the contraction of the flat spring 271, the ink inside the space 292 bleeds to the outside of the cartridge 20 from the container side filter 273. By the ink that bleeds from the container side filter 273 being conveyed to the device side filter 642, the ink starts circulating from the cartridge 20 to the ink flow path 646.

By the operation noted above, as the liquid supply portion 280 drops in the −Z axis direction, the gap between the container side filter 273 and the device side filter 642 is gradually eliminated in the direction moving away in the X axis direction with the contact start part as the base point. Said another way, together with the drop of the liquid supply portion 280 in the −Z axis direction, with the contact start part as the base point, the areas in mutual contact (hereafter referred to as contact areas) broaden facing the direction moving away in the X axis direction. In other words, as the liquid supply portion 280 drops in the −Z axis direction, the contact area of the container side filter 273 and the device side filter 642 broadens facing outside of the overlapping area of the container side filter 273 and the device side filter 642 (hereafter referred to as the overlapping area). By broadening of the contact area of the container side filter 273 and the device side filter 642, the space between the container side filter 273 and the device side filter 642 is pushed to the outside from the overlapping area of the container side filter 273 and the device side filter 642. As a result, when the cartridge 20 is mounted in the holder 60, it is possible to avoid air becoming sandwiched between the container side filter 273 and the device side filter 642.

Here, the container side filter 273 has a first part containing the top part and a second part that does not contain the top part. Then, in the process of the cartridge 20 being mounted in the holder 60, the first part projects in the direction facing the discharge port 291 from the liquid holding portion 200 more than the second part so that the first part can be in contact with the device side filter 642 ahead of the second part. By doing this, the container side filter 273 in contact with the device side filter 642 in the first period in the mounting process is only the first part, and what starts new contact in the second period subsequent to the first period is only the second part. Here, when the surface simultaneously in contact of the container side filter 273 and the device side filter 642 becomes large, the time required for the sandwiched air to escape to the outside from between the container side filter 273 and the device side filter 642 increases, so there is a higher possibility of the air becoming trapped. However, if the surface area simultaneously in contact is made smaller, the air that existed between the container side filter 273 and the device side filter 642 is easily removed from between the container side filter 273 and the device side filter 642.

With this embodiment, the cartridge 20 corresponds to the liquid holding container, the printer 50 corresponds to the liquid consuming device, the case 22 corresponds to the container, the container side filter 273 corresponds to the first porous member, the device side filter 642 corresponds to the second porous member, and the flat spring 271 corresponds to the spring.

With this embodiment, when the cartridge 20 is mounted in the holder 60, the container side filter 273 is biased by the biasing member 274 to the device side filter 642 side, so it is possible to absorb the variation in pressing force of the container side filter 273 on the device side filter 642. As a result, even if there are individual differences between the cartridge 20 (liquid supply portion 280) and the printer 50 (liquid introduction portion 640), environmental changes, or plastic deformation due to repeated attaching and detaching or the like, it is possible to have a good contact state between the container side filter 273 and the device side filter 642. As a result, it is possible to stably supply ink within the cartridge 20 to the printer 50.

Also, with this embodiment, it is possible to avoid air becoming sandwiched between the container side filter 273 and the device the filter 642, so it is possible to avoid the ink flow path between the cartridge 20 and the printer 50 from becoming narrower.

Here, when air becomes sandwiched between the container side filter 273 and the device side filter 642, there are cases when the circulation of ink is obstructed by the sandwiched air. Because of this, there is an increase in the flow path resistance of the ink flow path due to the air sandwiched between the container side filter 273 and the device side filter 642. As a result, there are cases when the discharge performance of the ink at the print head 540 decreases, so there is the problem that the printing quality can easily decrease. Also, in that kind of case, when replacing the cartridge 20, for example, it is possible to recover the flow path resistance by suctioning the ink forcibly from the cartridge 20 to the printer 50 side. However, since ink is forcibly suctioned from the cartridge 20, there is the problem of the ink consumption volume increasing.

In contrast to this, with this embodiment, it is possible to avoid air becoming sandwiched between the container side filter 273 and the device side filter 642, so it is possible to avoid the flow path resistance of the ink flow path from increasing. Because of this, with this embodiment, it is easy to maintain the discharge performance of ink at the print head 540, so it is easy to avoid a decrease in printing quality. Then, it is possible to avoid air becoming sandwiched between the container side filter 273 and the device side filter 642, so it is possible to make it easy to avoid forcible suctioning of ink from the cartridge 20.

Also, with this embodiment, the flat spring 271 is equipped with a flat plate shaped support member 275, and the container side filter 273 is biased by the biasing member 274 via this support member 275. Because of that, it is possible to have uniform contact between the container side filter 273 and the device side filter 642.

Also, with this embodiment, as shown in FIG. 10A, the flat spring 271 has a plurality (with this embodiment, two) of biasing members 274. With this embodiment, the two biasing members 274 intersect each other when viewed from the Y axis direction.

With this kind of flat spring 271, it is easy to make the contact pressure between the container side filter 273 and the device side filter 642 uniform in the X axis direction within the mutually contacting surfaces of the container side filter 273 and the device side filter 642.

Also, with this embodiment, the foam 272 is arranged between the flat spring 271 and the container side filter 273, so it is possible to again broaden the flow path surface area of the ink squeezed by the circulation holes 276 of the support member 275 within the foam 272. Because of that, it is possible to ease the pressure loss that occurs due to the circulation holes 276 of the support member 275. Also, it is possible to broaden the flow path surface area of the ink within the foam 272, so it is possible to uniformly flow the ink in sheet form on the container side filter 273. Also, with this embodiment, the foam 272 is arranged between the flat spring 271 and the container side filter 273, so it is possible to prevent the container side filter 273 from entering the circulation holes 276 of the support member 275. Because of that, when the cartridge 20 is mounted in the holder 60, a gap is prevented from opening between the container side filter 273 and the device side filter 642, and it is possible to suppress the occurrence of air bubbles in that gap.

Also, with this embodiment, the container side filter 273 has a shape projecting toward the device side filter 642, so when the container side filter 273 and the device side filter 642 are put in contact, it is possible to suppress tensile stress from acting on the container side filter 273. As a result, for example, by having the container side filter 273 pulled upward by the device side cylindrical body 645 of the liquid introduction portion 640, it is possible to suppress tearing or damage of the container side filter 273.

Also, with this embodiment, since the biasing member 274 and the support member 275 are formed as an integral unit, it is possible to reduce the manufacturing cost of the cartridge 20, and to reduce the man hours for assembling the cartridge 20 as well.

FIRST EMBODIMENT

Figure 12:
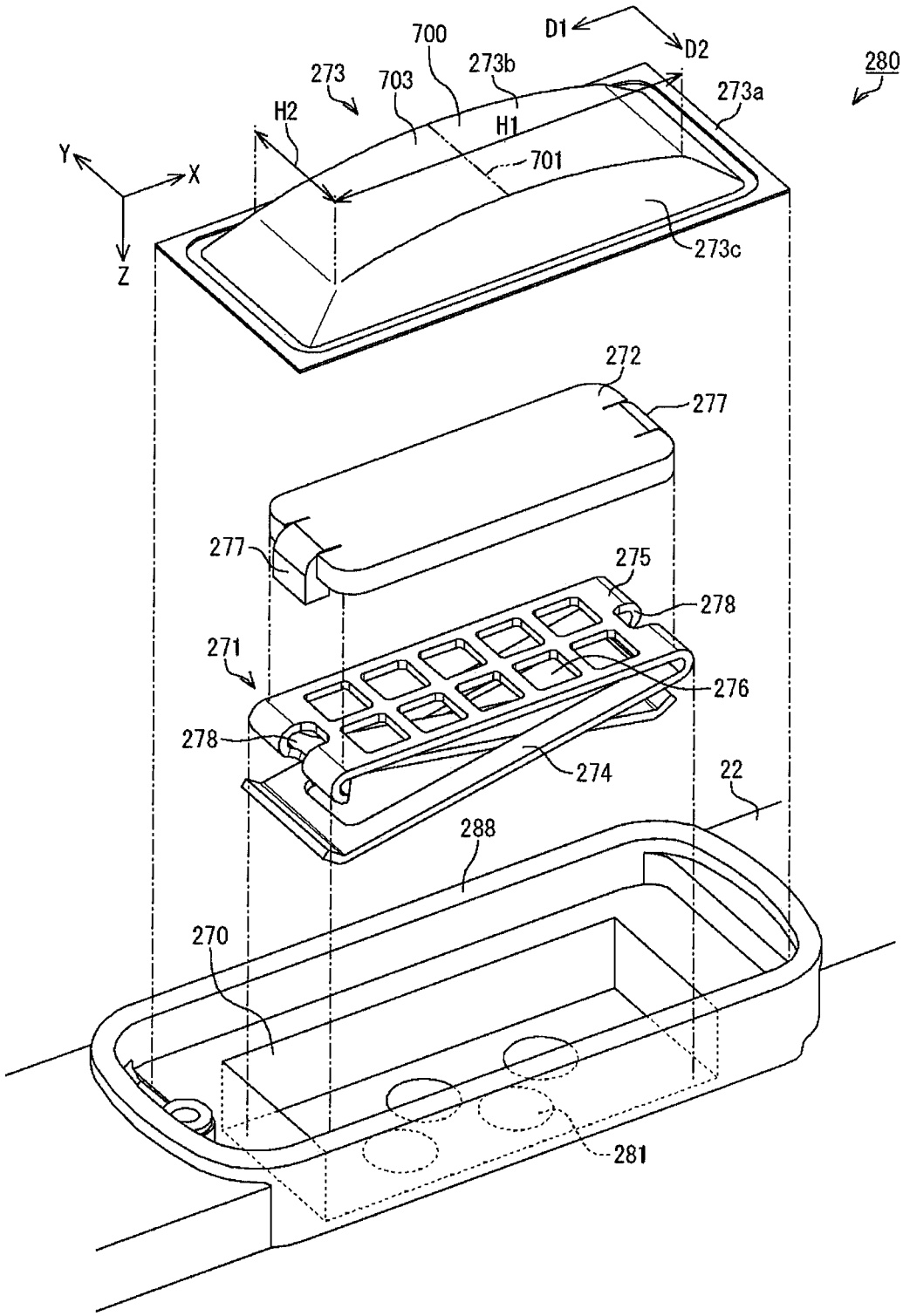
FIG. 12 is an exploded perspective view of the liquid supply portion of working example A1 with the first embodiment.

With the cartridge 20 of the first embodiment, as shown in FIG. 12, the container side filter 273 has a convex part 700. The convex part 700 has a projecting part which is a convex form that is convex facing from the +Z axis direction toward the −Z axis direction. Also, with the cartridge 20, the width H1 of the convex part 700 in the mounting direction D1 is greater than the width H2 of the convex part 700 in the orthogonal direction D2. The orthogonal direction D2 is a direction orthogonal to the mounting direction D1 with a planar view of the container side filter 273, specifically, with a planar view of the XY plane with the cartridge 20 in a standalone state.

Figure 13:
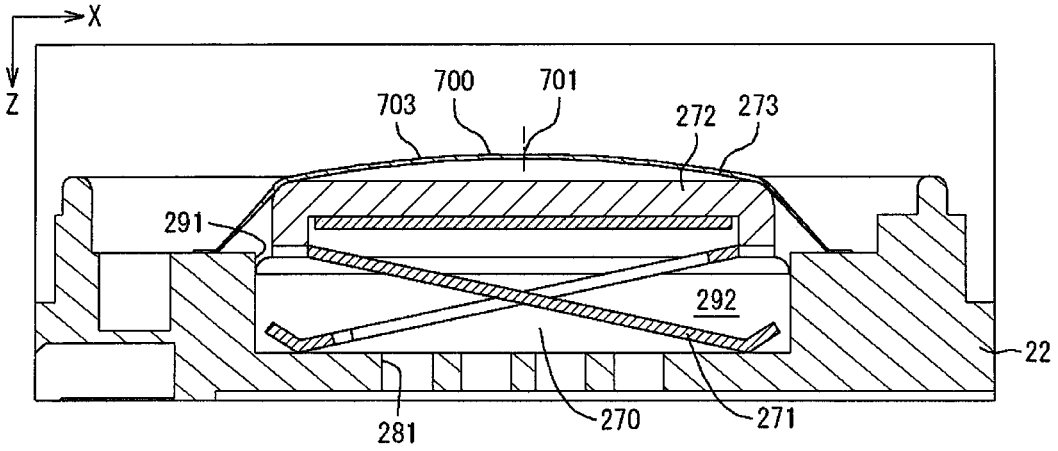
FIG. 13 is a cross section diagram when the container side filter is cut on the XZ plane with the first embodiment.

With the first embodiment, the top part 701 of the convex part 700 of the container side filter 273 extends along the orthogonal direction D2. Also, the top part 701 extends in a straight line along the orthogonal direction D2 such as shown by the dotted line, so can also be said to extend along a virtual straight line. Because of this, as shown in FIG. 13, the top part 701 appears at the cross section when the container side filter 273 is cut on the XZ plane. In other words, the cross section shape of the container side filter 273 when the container side filter 273 is cut along the mounting direction D1 contains the top part 701 of the convex part 700. The top part 701 is the site projecting the most in the −Z axis direction when the XZ plane is seen in plan view. With the first embodiment, the convex part 700 of the container side filter 273 is constituted by the line including a curved line 703 at the cross section when cut on the XZ plane. Then, the top part 701 is positioned over the curved line 703.

On the other hand, except for when the container side filter 273 is cut along the orthogonal direction D2 at the site overlapping the top part 701, the top part 701 does not appear at the cross section when the container side filter 273 is cut at the YZ plane (not illustrated). In other words, of the mounting direction D1 and the orthogonal direction D2, the top part 701 of the convex part 700 of the container side filter 273 extends only in the orthogonal direction D2. This can be regarded as the top part 701 of the convex part 700 of the container side filter 273 not extending in the mounting direction D1.

Here, the container side filter 273 has a first part including the top part 701 and a second part that does not include the top part 701. Then, in the process of the cartridge 20 being mounted in the holder 60, the first part projects in the direction facing the discharge port 291 from the liquid holding portion 200 more than the second part, so that the first part can contact the device side filter 642 ahead of the second part. By doing this, the container side filter 273 in contact with the device side filter 642 in the first period of the mounting process is only the first part, and what starts new contact during the second period following the first period is only the second part. Here, when the surface area simultaneously in contact of the container side filter 273 and the device side filter 642 is large, the time required to have the sandwiched air escape to outside from between the container side filter 273 and the device side filter 642 increases, so the possibility of the air becoming trapped increases. However, if the surface area simultaneously in contact is made smaller, it is possible to reduce the volume of air that fails to escape to the outside of the container side filter 273 during contact. As a result, the air that existed between the container side filter 273 and the device side filter 642 is easily removed from between the container side filter 273 and the device side filter 642.

Furthermore, of the first part, the smaller the width in the mounting direction of the cartridge 20, the smaller the surface area initially in contact by the container side filter 273 on the device side filter 642, so the possibility of air becoming trapped is also smaller. Because of that, the effect is greater if the shape is near a straight line that the first part almost has no surface area of. Also, the effect is greater if the top part 701 is positioned at the center of the width in the mounting direction of the first part.

WORKING EXAMPLE A1

We will describe a working embodiment for the cartridge 20 of the first embodiment. Hereafter, the working examples of the first embodiment will be noted as working examples A. Then, thereafter, since there are a plurality of working examples A. the plurality of working examples A will be distinguished from each other by adding a number to each respective item. As described previously, with the cartridge 20 of the first embodiment, the convex part 700 of the container side filter 273 can be formed, for example, by implementing embossing on the filter. An example of forming the convex part 700 of the container side filter 273 by implementing embossing on the filter is used as working example A1. With working example A1, it is possible to constitute the convex part 700 of the container side filter 273.

However, the method of forming the convex part 700 of the container side filter 273 is not limited to that of working example A1. As the method of forming the convex part 700 of the container side filter 273, for example, it is possible to also use a method of providing a convex part that is convex facing the outside from the inside of the recess 270 further to the liquid holding portion 200 side than the container side filter 273, specifically facing the container side filter 273 side. In this case, the container side filter 273 is boosted by the convex part in the direction that is convex facing the outside from the inside of the liquid holding portion 200. Following, we will describe an example of forming the convex part 700 of the container side filter 273 using the convex part.

WORKING EXAMPLE A2

Figure 14:
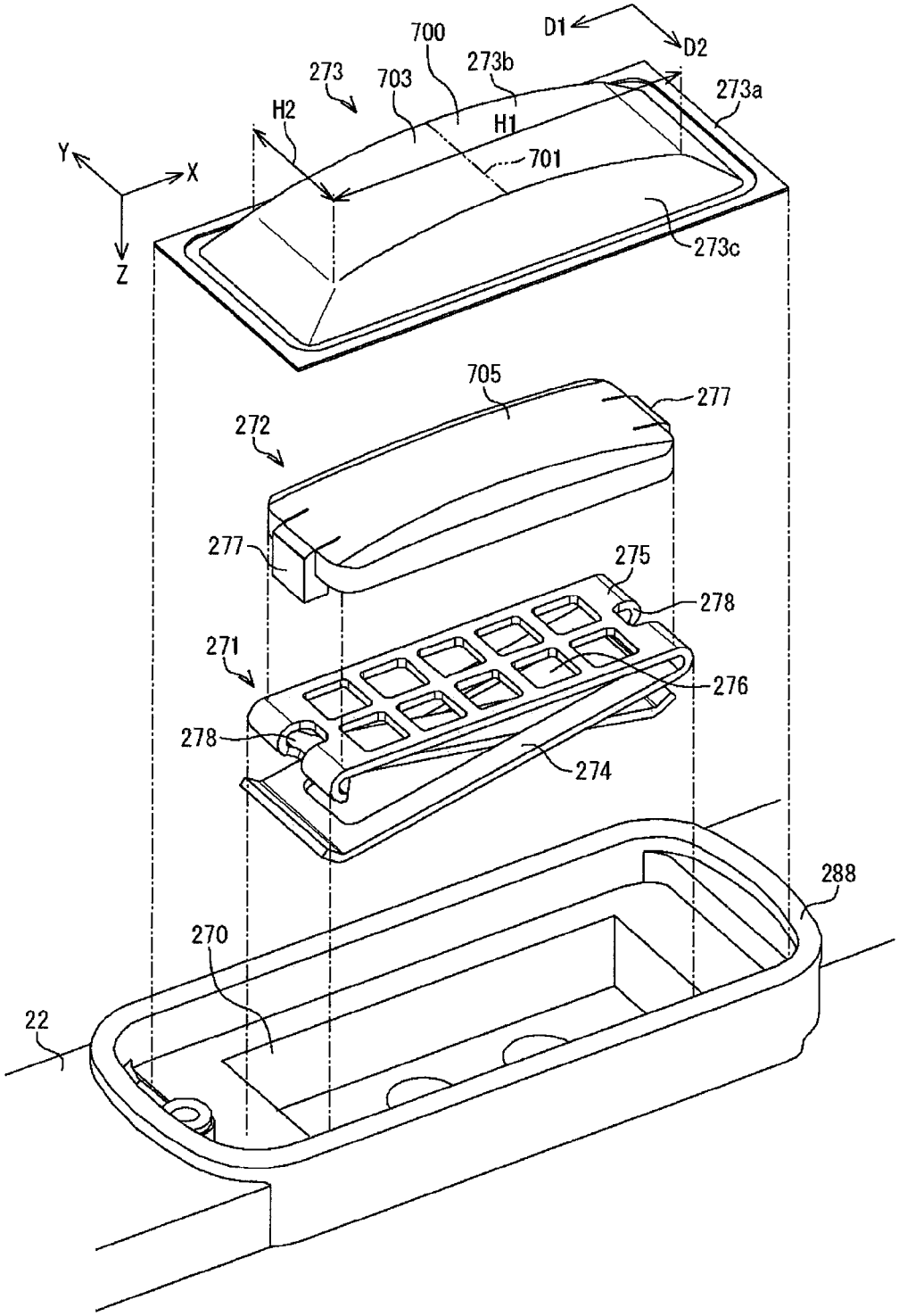
FIG. 14 is an exploded perspective view of the liquid supply portion with working example A2.

With working example A2, as shown in FIG. 14, the projecting structure for forming the convex part 700 of the container side filter 273 includes the convex part 705 provided on the foam 272. With the foam 272, the convex part 705 has a projecting part that projects facing the container side filter 273 side, specifically facing the −Z axis direction. The width in the mounting direction D1 of the convex part 705 is the same as the width H1 of the convex part 700 or smaller than the width H1 of the convex part 705. Also, the width in the orthogonal direction D2 of the convex part 705 is the same as the width H2 of the convex part 700 or smaller than the width H2 of the convex part 700. With working example A2, the convex part 705 is provided on the foam 272, so by adhering the container side filter 273 to the case 22 in a state with the flat spring 271 and the foam 272 housed in the recess 270, it is possible to constitute the convex part 700 of the container side filter 273.

The foam 272 is positioned between the container side filter 273 and the liquid holding portion 200 so as to contact the container side filter 273, and has a convex part 705 on the surface that contacts the container side filter 273. In this way, by forming the foam 272 having the convex part 705 in advance, it is possible to simplify the manufacturing process of incorporating the projecting structure in the cartridge 20.

WORKING EXAMPLE A3

Figure 15:
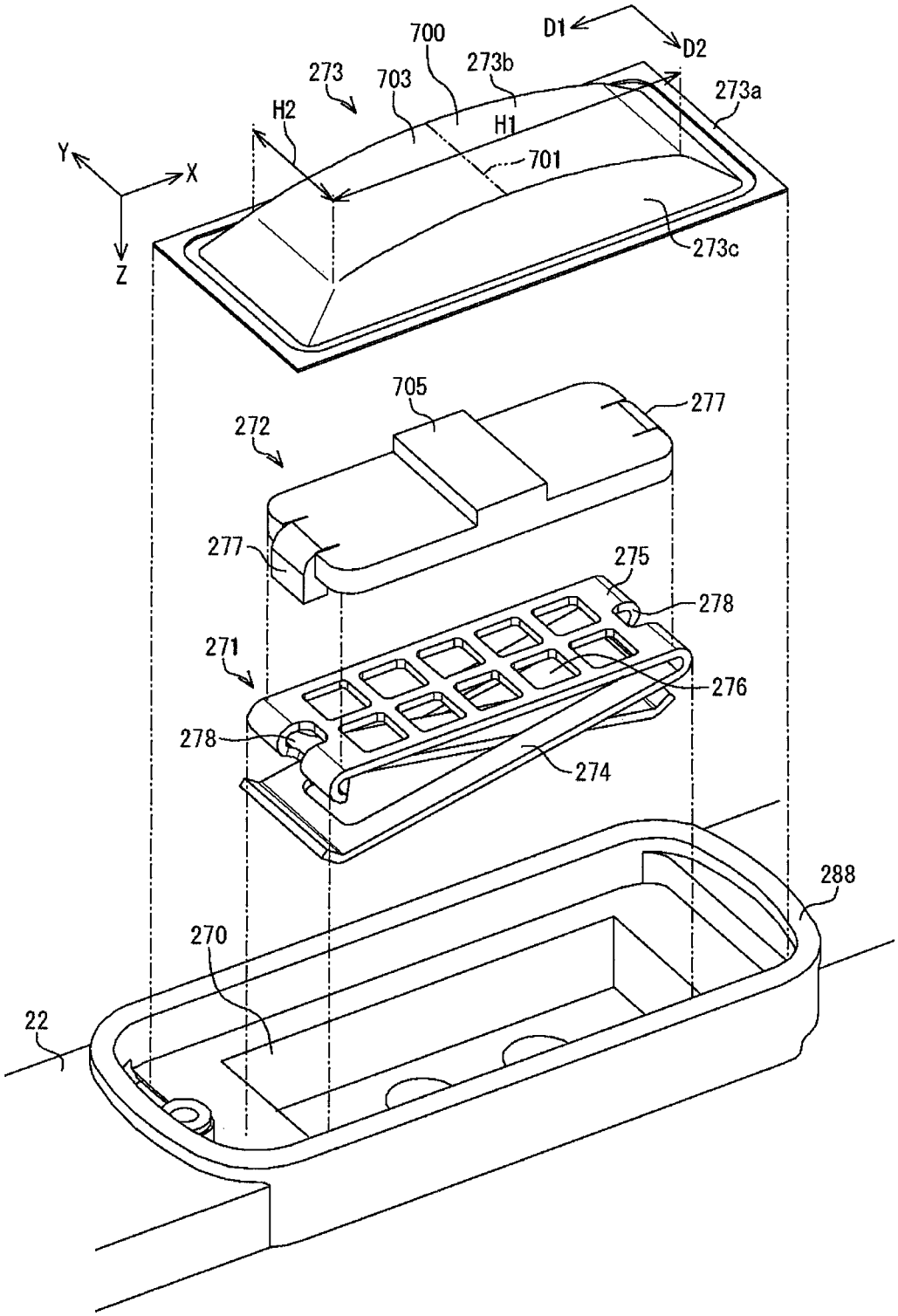
FIG. 15 is an exploded perspective view of the liquid supply portion with working example A3.

With working example A3, as shown in FIG. 15, the projecting structure for forming the convex part 700 of the container side filter 273 includes the convex part 705 provided on the foam 272. The convex part 705 is provided on the container side filter 273 side of the foam 272. With the foam 272, the convex part 705 has a projecting part projecting facing the container side filter 273 side, specifically, the −Z axis direction. The width in the mounting direction D1 of the convex part 705 is smaller than the width in the orthogonal direction D2 of the convex part 705. With working example A3, the convex part 705 extends along the orthogonal direction D2.

The width in the mounting direction D1 of the convex part 705 is the same as width H1 of the convex part 700 or smaller than the width H1 of the convex part 700. Also, the width in the orthogonal direction of the convex part 705 is the same as the width H2 of the convex part 700 or is smaller than the width H2 of the convex part 700. Also, the width of the mounting direction D1 of the convex part 705 with working example A3 is smaller than the width of the mounting direction D1 of the convex part 705 with embodiment 2 (FIG. 14). With working example A3, the convex part 705 is provided on the foam 272, so by adhering the container side filter 273 to the case 22 in a state with the flat spring 271 and the foam 272 housed in the recess 270, it is possible to constitute the convex part 700 of the container side filter 273.

WORKING EXAMPLE A4

Figure 16:
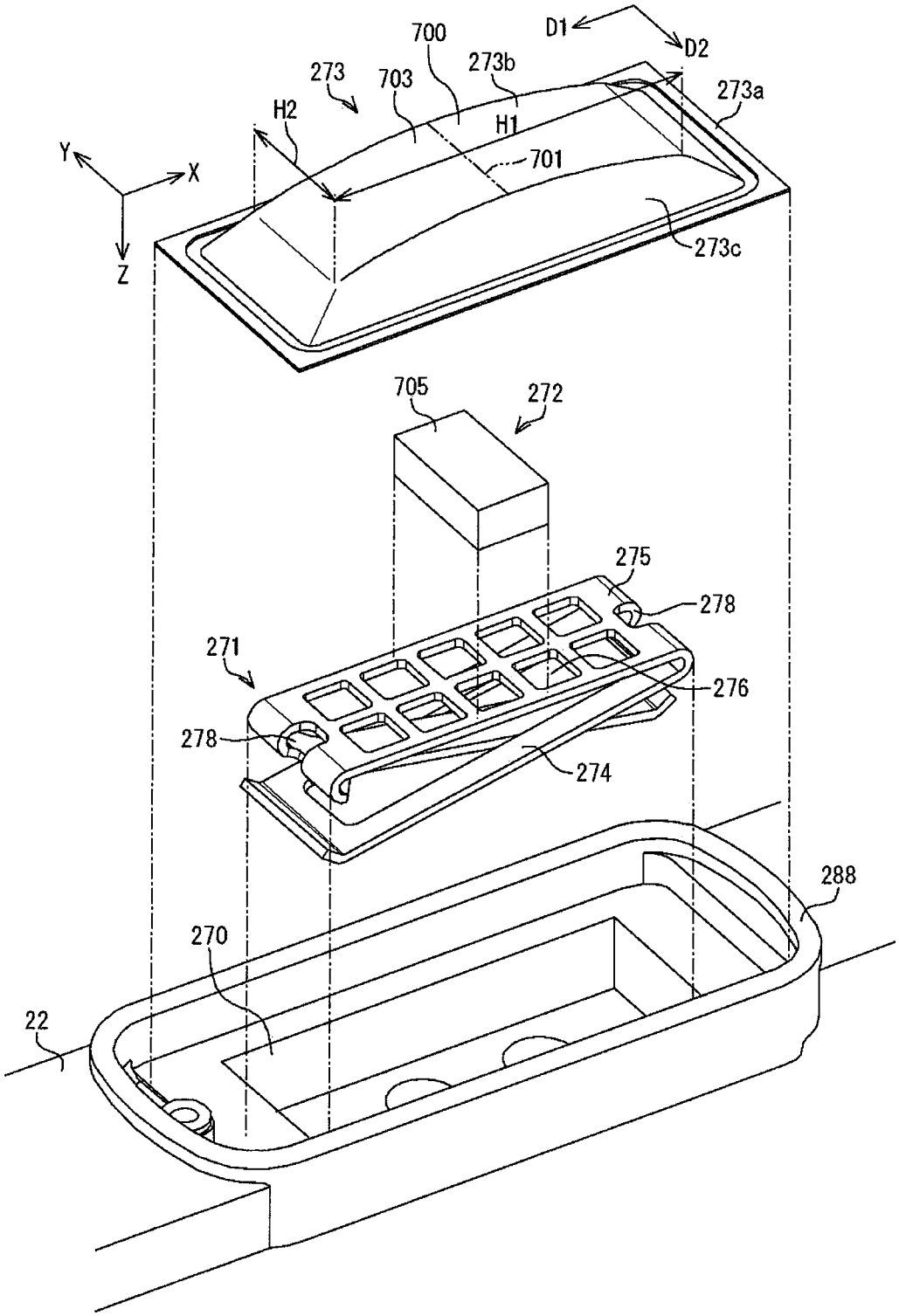
FIG. 16 is an exploded perspective view of the liquid supply portion with working example A4.

With working example A4, as shown in FIG. 16, the convex part 705 is constituted by the foam 272. The foam 272 as the convex part 705 is provided between the flat spring 271 and the container side filter 273. The convex part 705 has a projecting part projecting facing the container side filter 273 side from the flat spring 271 side, specifically, facing the −Z axis direction. The width in the mounting direction D1 of the convex part 705 is smaller than the width in the orthogonal direction D2 of the convex part 705. With working example A4, the convex part 705 extends along the orthogonal direction D2.

The width in the mounting direction D1 of the convex part 705 is the same as the width H1 of the convex part 700 or is smaller than the width H1 of the convex part 700. Also, the width in the orthogonal direction D2 of the convex part 705 is the same as the width H2 of the convex part 700 or is smaller than the width H2 of the convex part 700. Also, the width in the mounting direction D1 of the convex part 705 with working example A4 is smaller than the width in the mounting direction D1 of the convex part 705 with working example A2 (FIG. 14). With working example A4, the convex part 705 is constituted by the foam 272, so by adhering the container side filter 273 to the case 22 in a state with the flat spring 271 and the foam 272 housed inside the recess 270, it is possible to constitute the convex part 700 of the container side filter 273.

WORKING EXAMPLE A5

Figure 17:
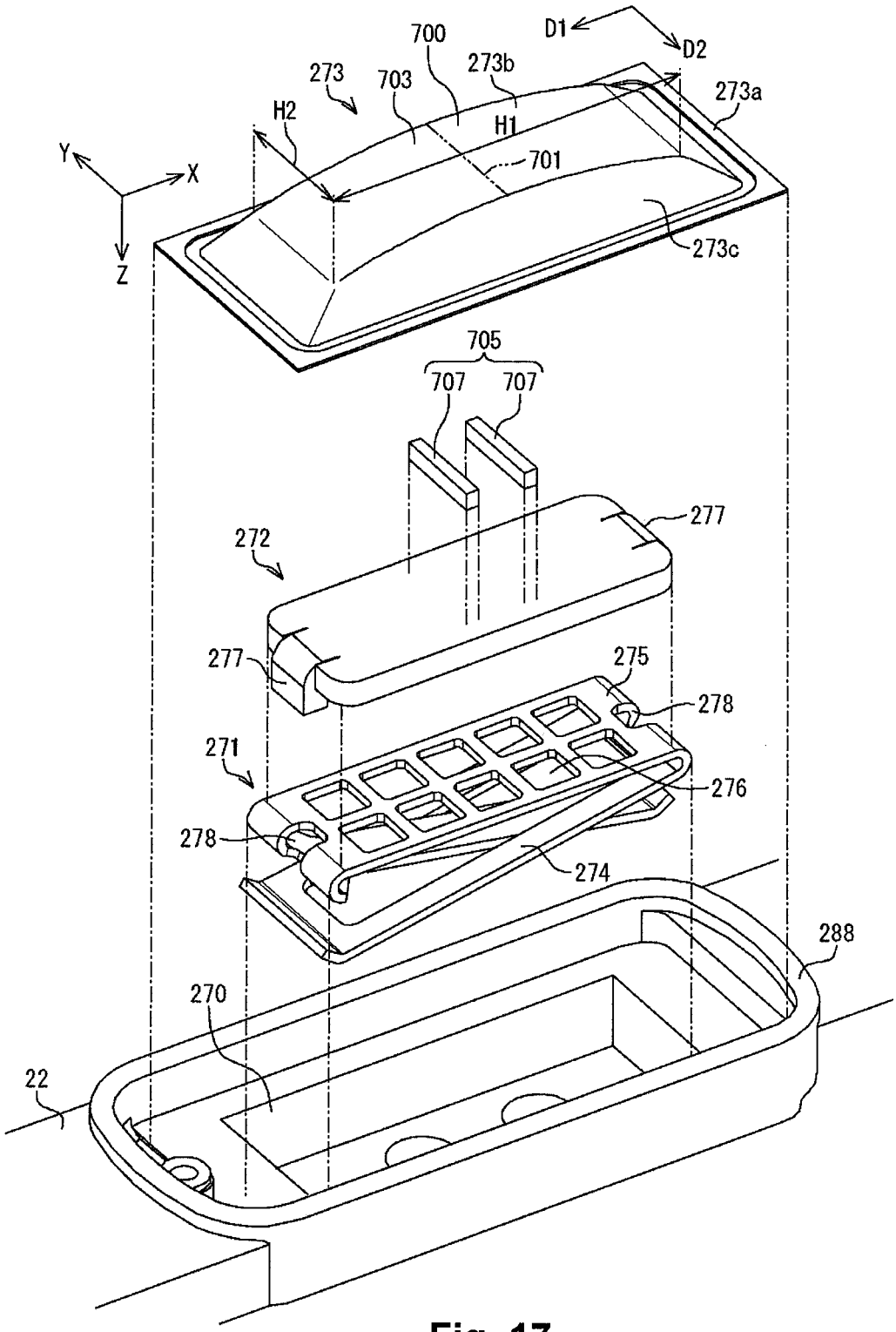
FIG. 17 is an exploded perspective view of the liquid supply portion with working example A5.

With working example A5, as shown in FIG. 17, the convex part 705 is provided between the foam 272 and the container side filter 273. Also, with working example A5, the convex part 705 has two spacers 707. The two spacers 707 respectively extend in the orthogonal direction D2. The two spacers 707, in a state with a gap opened between them, are aligned along the mounting direction D1. The convex part 705 has a projecting part that projects facing the container side filter 273 side from the foam 272 side, specifically, facing the −Z axis direction. The width in the mounting direction D1 of the convex part 705 including the gap between the two spacers 707 is smaller than the width in the orthogonal direction D2 of the convex part 705.

The width in the mounting direction D1 of the convex part 705 including the gap between the two spacers 707 is the same as the width H1 of the convex part 700 or is smaller than the width H1 of the convex part 700. Also, the width in the orthogonal direction D2 of the convex part 705 is the same as the width H2 of the convex part 700 or is smaller than the width H2 of the convex part 700. Also, the width in the mounting direction D1 of the convex part with working example A5 is smaller than the width in the mounting direction D1 of the convex part 705 with working example A2 (FIG. 14). As the material of the spacer 707, it is possible to use the same material as the foam 272 or to use a material that is different from the material of the foam 272. With working example A5, by adhering the container side filter 273 to the case 22 in a state with the flat spring 271, the foam 272, and the convex part 705 housed inside the recess 270, it is possible to constitute the convex part 700 of the container side filter 273.

WORKING EXAMPLE A6

Figure 18:
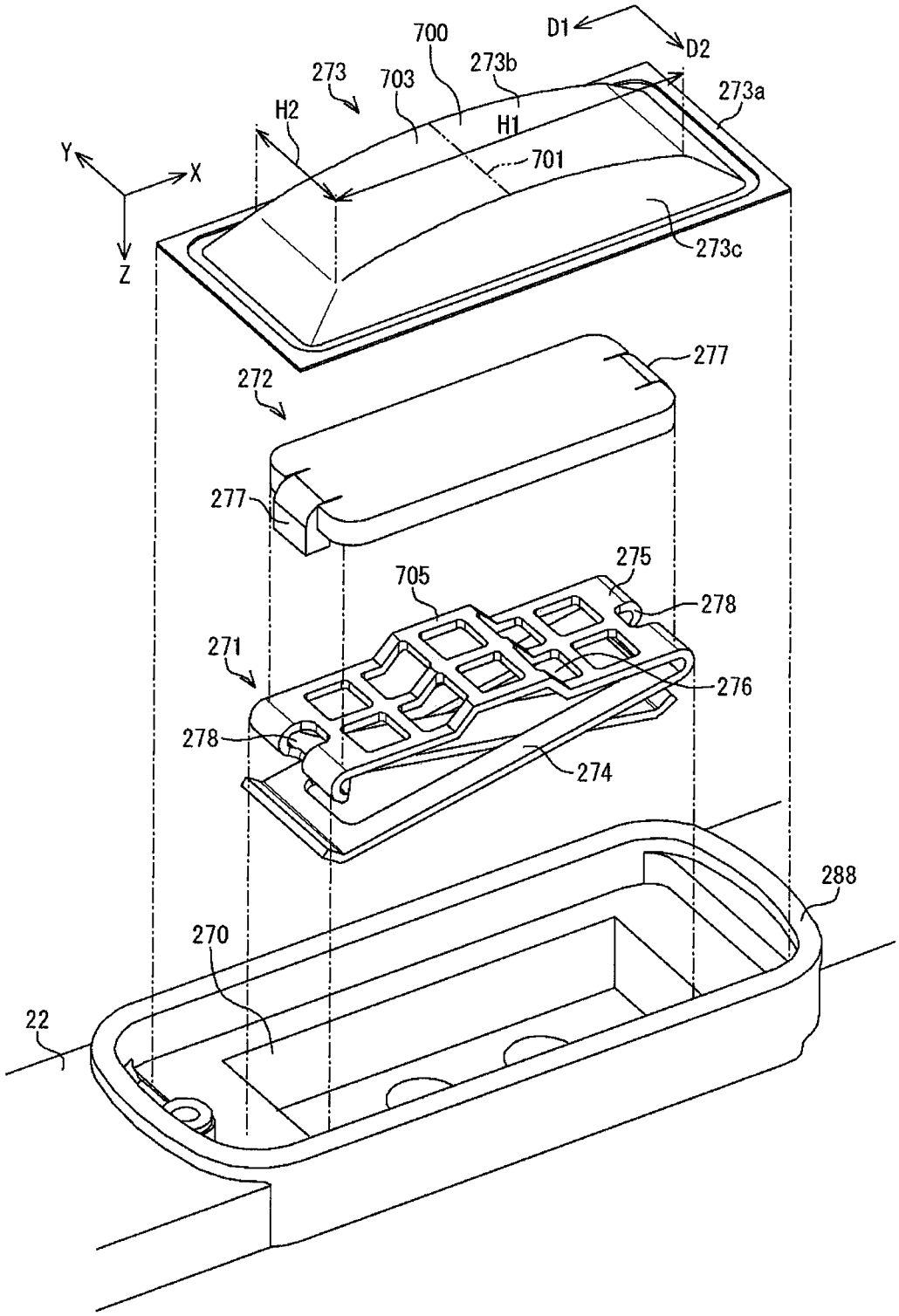
FIG. 18 is an exploded perspective view of the liquid supply portion with working example A6.

With working example A6, as shown in FIG. 18, the convex part 705 is provided on the flat spring 271. The convex part 705 is provided on the container side filter 273 side of the flat spring 271. With the flat spring 271, the convex part 705 has a projecting part that projects facing the container side filter 273 side, specifically faces the −Z axis direction. The width in the mounting direction D1 of the convex part 705 is smaller than the width in the orthogonal direction D2 of the convex part 705. With working example A6, the convex part 705 extends along the orthogonal direction D2.

The width in the mounting direction D1 of the convex part 705 is the same as the width H1 of the convex part 700 or is smaller than the width H1 of the convex part 700. Also, the width in the orthogonal direction D2 of the convex part 705 is the same as the width H2 of the convex part 700 or is smaller than the width H2 of the convex part 700. With the example shown in FIG. 18, the convex part 705 is formed by implementing bending processing on the support member 275 of the flat spring 271. With working example A6, when the container side filter 273 is adhered to the case 22 in a state with the flat spring 271 and the foam 272 housed inside the recess 270, the foam 272 is boosted in the direction convex facing the −Z axis direction by the convex part 705. By doing this, it is possible to constitute the convex part 700 of the container side filter 273.

WORKING EXAMPLE A7

Figure 19:
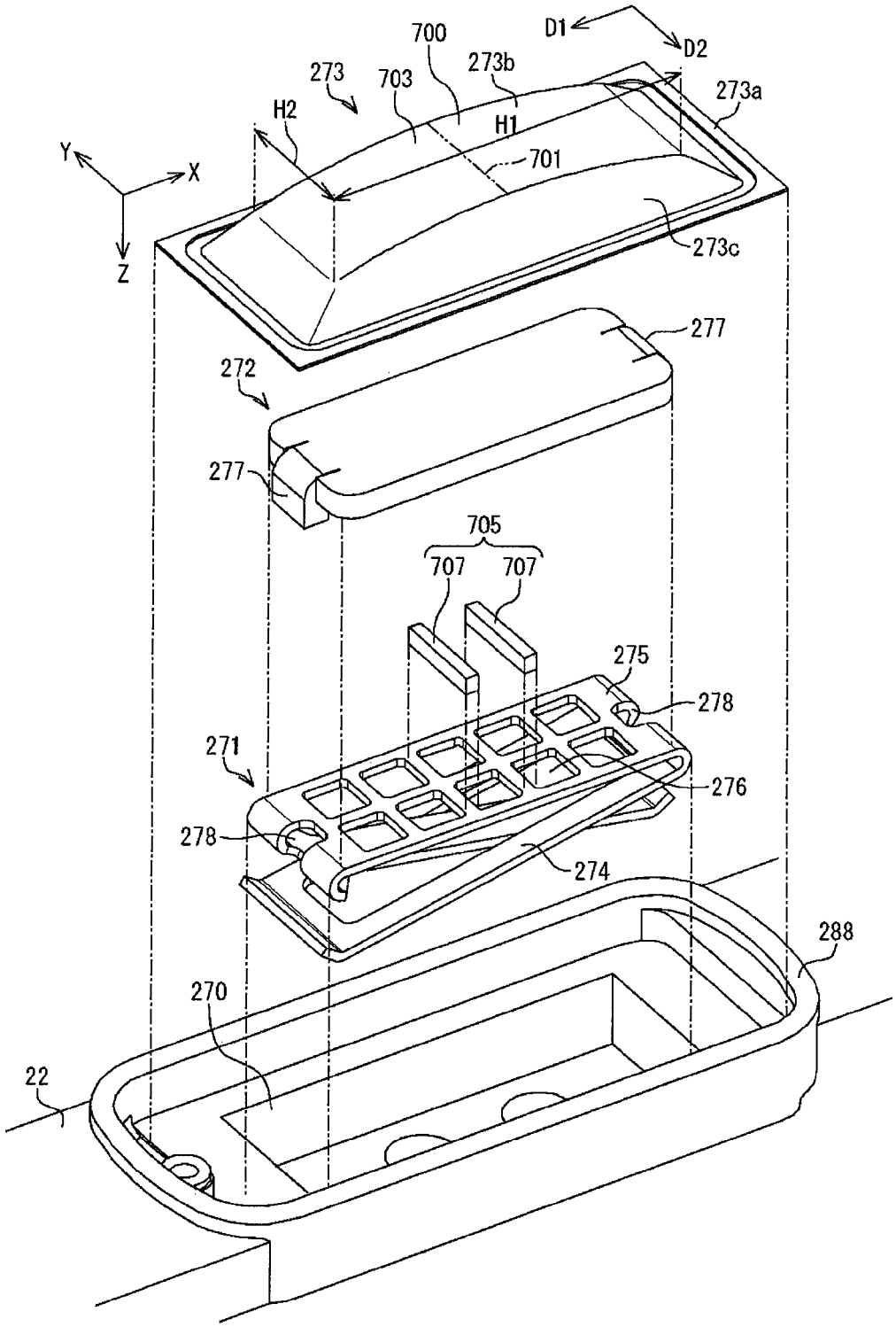
FIG. 19 is an exploded perspective view of the liquid supply portion with working example A7.

With working example A7, as shown in FIG. 19, the convex part 705 is provided between the flat spring 271 and the foam 272. The convex part 705 with working example A7 has the same constitution as the convex part 705 of working example A5 except that the arrangement position is different. Because of this, hereafter, we will omit a detailed description regarding the convex part 705 having two spacers 707. With working example A7, when the container side filter 273 is adhered to the case 22 in a state with the flat spring 271, the convex part 705, and the foam 272 housed inside the recess 270, the foam 272 is boosted in the direction becoming convex facing the −Z axis direction by the convex part 705. By doing this, it is possible to constitute the convex part 700 of the container side filter 273.

WORKING EXAMPLE A8

Figure 20:
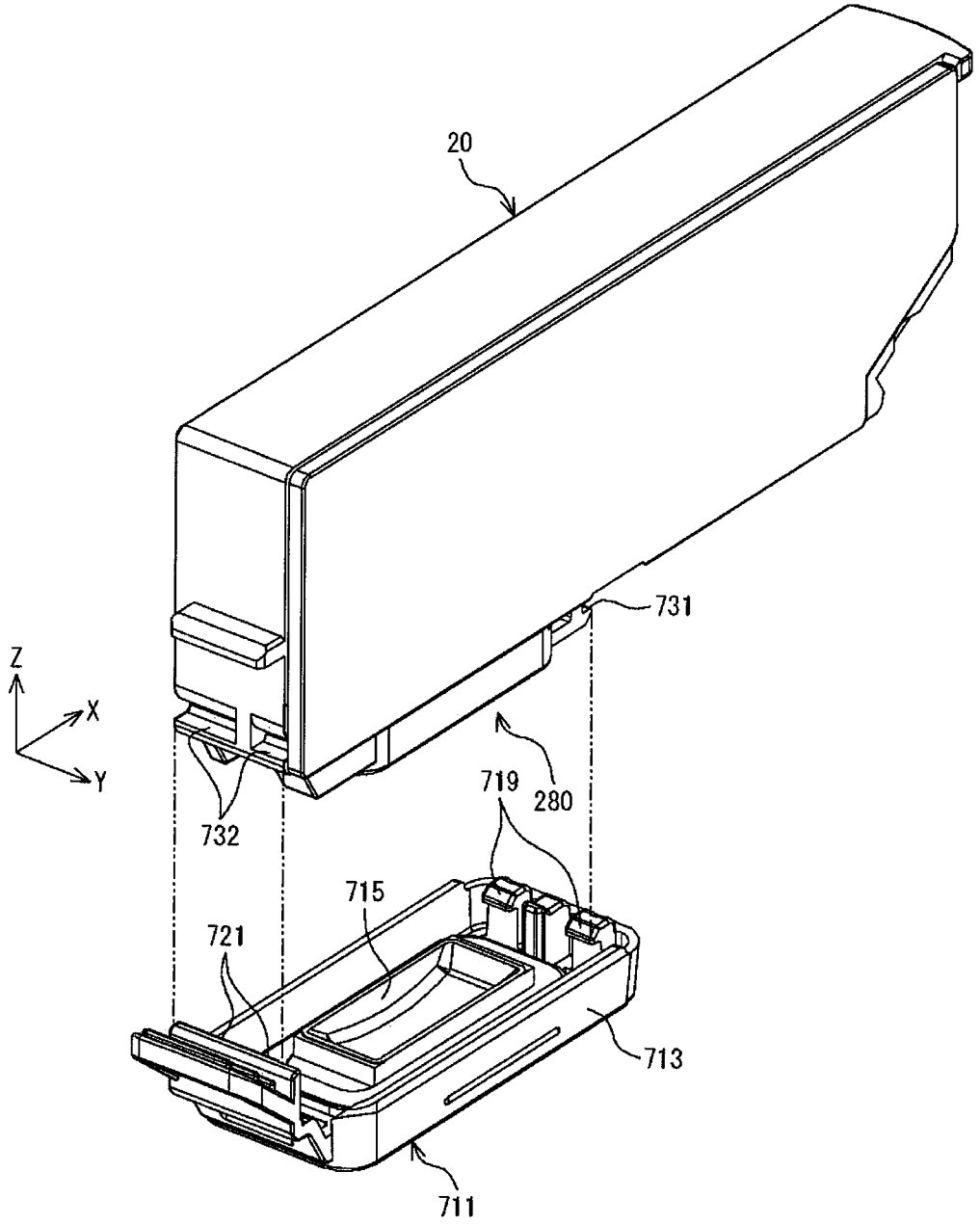
FIG. 20 is a perspective view showing the cartridge and the cap with working example A8.

With working example A8, as shown in FIG. 20, a cap 711 is attached to the cartridge 20. In the unused state of the cartridge 20, the cap 711 is covered on the liquid supply portion 280. It is possible to close the liquid supply portion 280 using the cap 711. By closing the liquid supply portion 280 with the cap 711, it is possible to inhibit to a low level leaking of ink from the liquid supply portion 280 and evaporation of the ink liquid component from the liquid supply portion 280. When mounting the cartridge 20 in the printer 50, the operator mounts the cartridge 20 in the printer 50 after removing the cap 711 from the liquid supply portion 280. In other words, the cartridge 20 is mounted in the printer 50 in a state with the cap 711 removed from the liquid supply portion 280.

Figure 21:
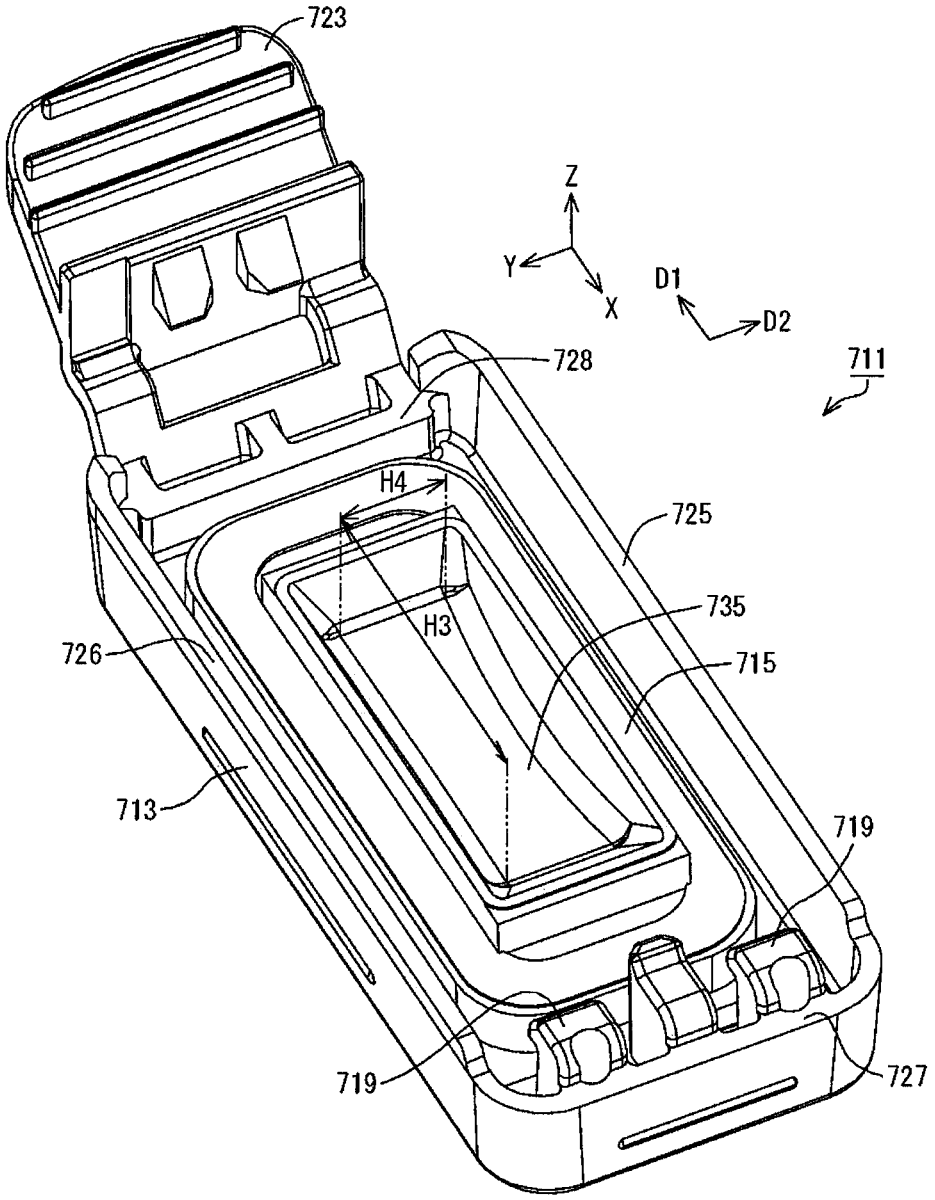
FIG. 21 is a perspective view showing the cap with working example A8.

As shown in FIG. 21, the cap 711 has a cover 713 and a seal member 715. The cover 713, for example, is formed from a synthetic resin such as nylon, polypropylene or the like. On the cover 713 are provided a recess 717, an engaging hook 719, an engaging hook 721, and a release lever 723. The recess 717 is provided in a direction that is convex facing the −Z axis direction. The recess 717 is enclosed by a bulkhead 725, a bulkhead 726, a bulkhead 727, and a bulkhead 728. The bulkhead 725 and the bulkhead 726 are facing each other in a state with a mutual gap in the Y axis direction. The bulkhead 727 and the bulkhead 728 are facing each other in a state with a mutual gap in the X axis direction.

The seal member 715 is housed inside the recess 717. The engaging hook 719 is provided on the bulkhead 728 side of the bulkhead 727. A gap is provided between the engaging hook 719 and the bulkhead 728. The seal member 715 is housed between the engaging hook 719 and the bulkhead 728. Because of this, the engaging hook 719 is provided between the bulkhead 727 and the seal member 715. The engaging hook 721 is provided at the opposite side to the seal member 715 side of the bulkhead 728. In other words, the engaging hook 721 is provided at the outside of the area within the recess 717 in the planar view. The engaging hook 719 and the engaging hook 721 are facing each other sandwiching the seal member 715 and the bulkhead 728 in the planar view.

Figure 22:
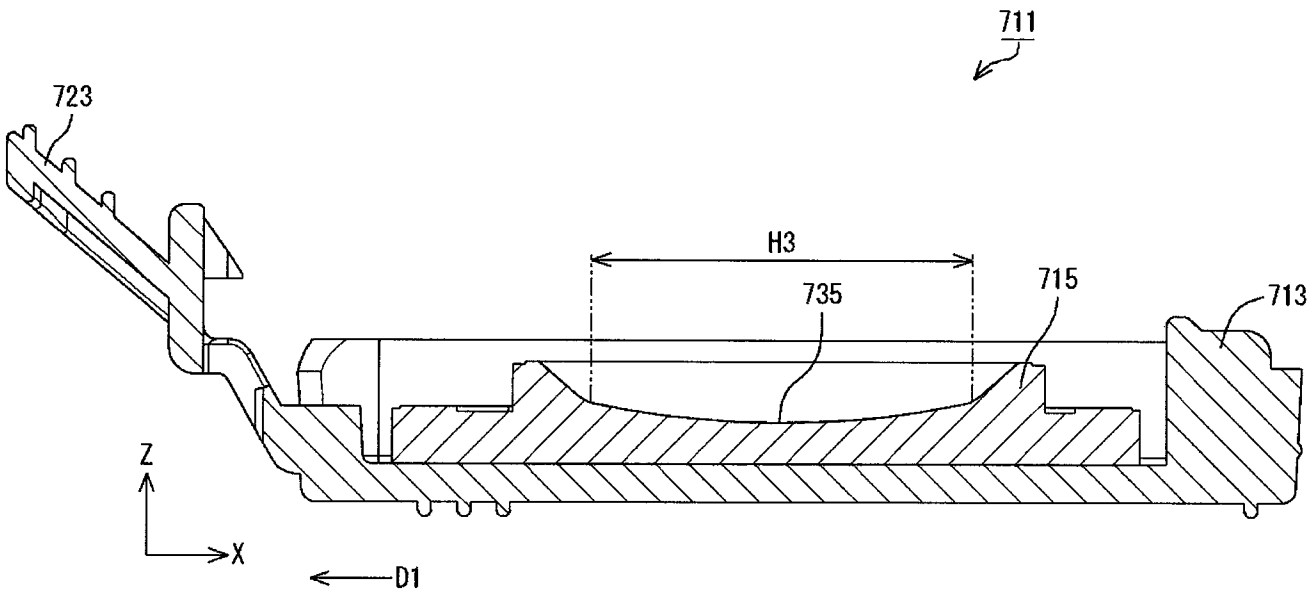
FIG. 22 is a cross section diagram when the cap is cut on the XZ plane with working example A8.

The release lever 723 is provided on the opposite side to the seal member 715 side of the bulkhead 728. The release lever 723 extends in the direction going away facing the outside of the recess 717 from the bulkhead 728 and facing the Z axis positive direction. The engaging hook 721 is provided on the release lever 723. A recess 735 is provided on the seal member 715. As shown in FIG. 22, the recess 735 is provided in a direction that is convex facing the −Z axis direction. The width H3 in the mounting direction D1 of the recess 735 is the same as the width H1 of the convex part 700 (FIG. 12) or is greater than the width H1 of the convex part 700. Also, as shown in FIG. 21, the width H4 in the orthogonal direction D2 of the recess 735 is the same as the width H2 of the convex part 700 (FIG. 12) or is greater than the width H2 of the convex part 700. As shown in FIG. 20, the cap 711 is mounted in the cartridge 20 by the engaging hook 719 being engaged with a part to be engaged 731 of the cartridge 20, and by the engaging hook 721 being engaged with a part to be engaged 732 of the cartridge 20.

Figure 23:
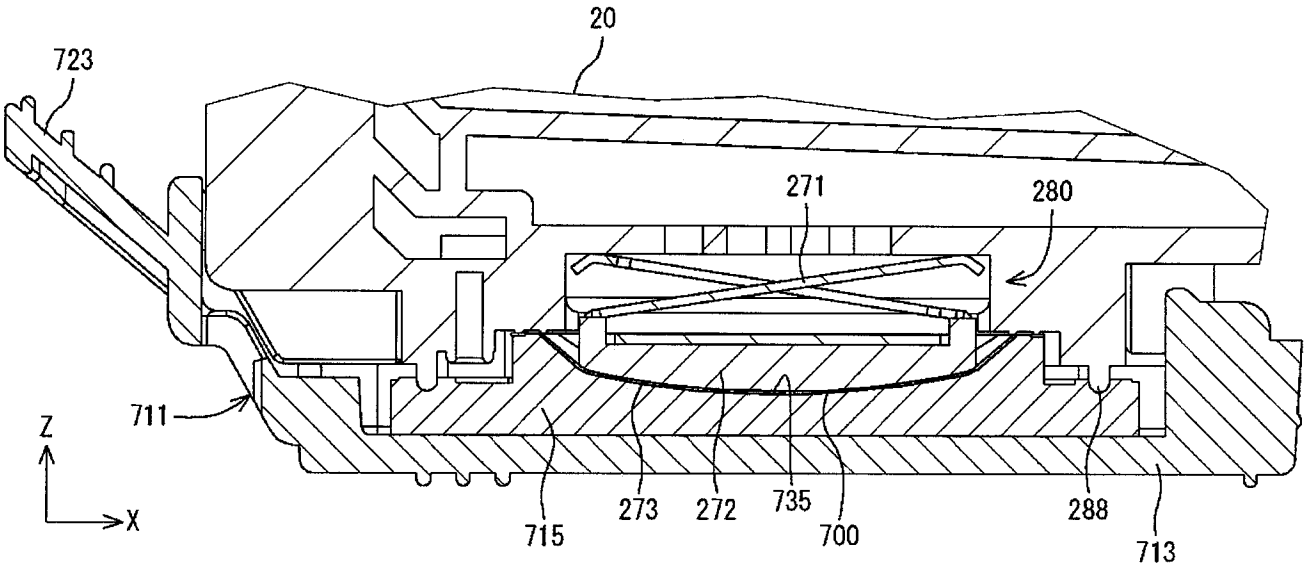
FIG. 23 is a partial cross section diagram when the cap is mounted on the cartridge with working example A8.

In a state with the cap 711 mounted on the cartridge 20, as shown in FIG. 23, the liquid supply portion 280 is covered from the outside by the cover 713 of the cap 711. In a state with the cap 711 mounted on the cartridge 20, by having the release lever 723 bent to the opposite side (−Z axis direction) to the cartridge 20 side, it is possible to remove the engaging hook 721 from the part to be engaged 732. By doing this, it is possible to remove the cap 711 from the cartridge 20. In a state with the cap 711 mounted on the cartridge 20, the seal member 715 faces opposite the liquid supply portion 280. The seal member 715 is constituted from a material having elasticity such as rubber, an elastomer or the like, for example. Then, in a state with the seal member 715 pressed on the container side cylindrical body 288, the seal member 715 seals the liquid supply portion 280. In a state with the liquid supply portion 280 sealed by the seal member 715, the site of the seal member 715 contacted by the container side cylindrical body 288 sinks inward. By doing this, in a state with the liquid supply portion 280 sealed by the seal member 715, the airtightness of the liquid supply portion 280 is increased.

In a state with the cap 711 mounted on the cartridge 20, the recess 735 faces opposite the foam 272 sandwiching the container side filter 273. Then, the recess 735 contacts the container side filter 273. At this time, the foam 272 is pressed facing the +Z axis direction by the recess 735 of the seal member 715 via the container side filter 273. By doing this, the convex part 700 can be constituted on the container side filter 273. In other words, with working example A8, by mounting the cap 711 on the cartridge 20, the convex part 700 of the container side filter 273 is formed.

With working example A8, when the cap 711 is removed from the cartridge 20, as time elapses, the deformation of the foam 272 and the container side filter 273 is reversed. Because of this, when the cap 711 is removed from the cartridge 20, as time elapses, the convex part 700 of the container side filter 273 decreases. However, after the cap 711 is removed from the cartridge 20, during the time it takes until the cartridge 20 is mounted in the printer 50, the boosting of the convex part 700 is maintained. Because of this, with working example A8 as well, it is possible to obtain the same effect respectively as with from working example A1 through A7. In other words, with working example A8 as well, when the cartridge 20 is mounted on the holder 60, it is possible to avoid having air trapped between the container side filter 273 and the device side filter 642. Even if the convex part 700 disappears after the cartridge 20 is mounted in the printer 50, there is no loss of the function of the cartridge 20 and the printer 50.

With the first embodiment described above, it is possible to use from working example A1 through working example A8 respectively individually. Also, with the first embodiment described above, it is also possible to use a constitution combining a number of working example A1 through working example A8. Furthermore, it is also possible to use a constitution that combines all of working example A1 through working example A8.

SECOND EMBODIMENT

Figure 24:
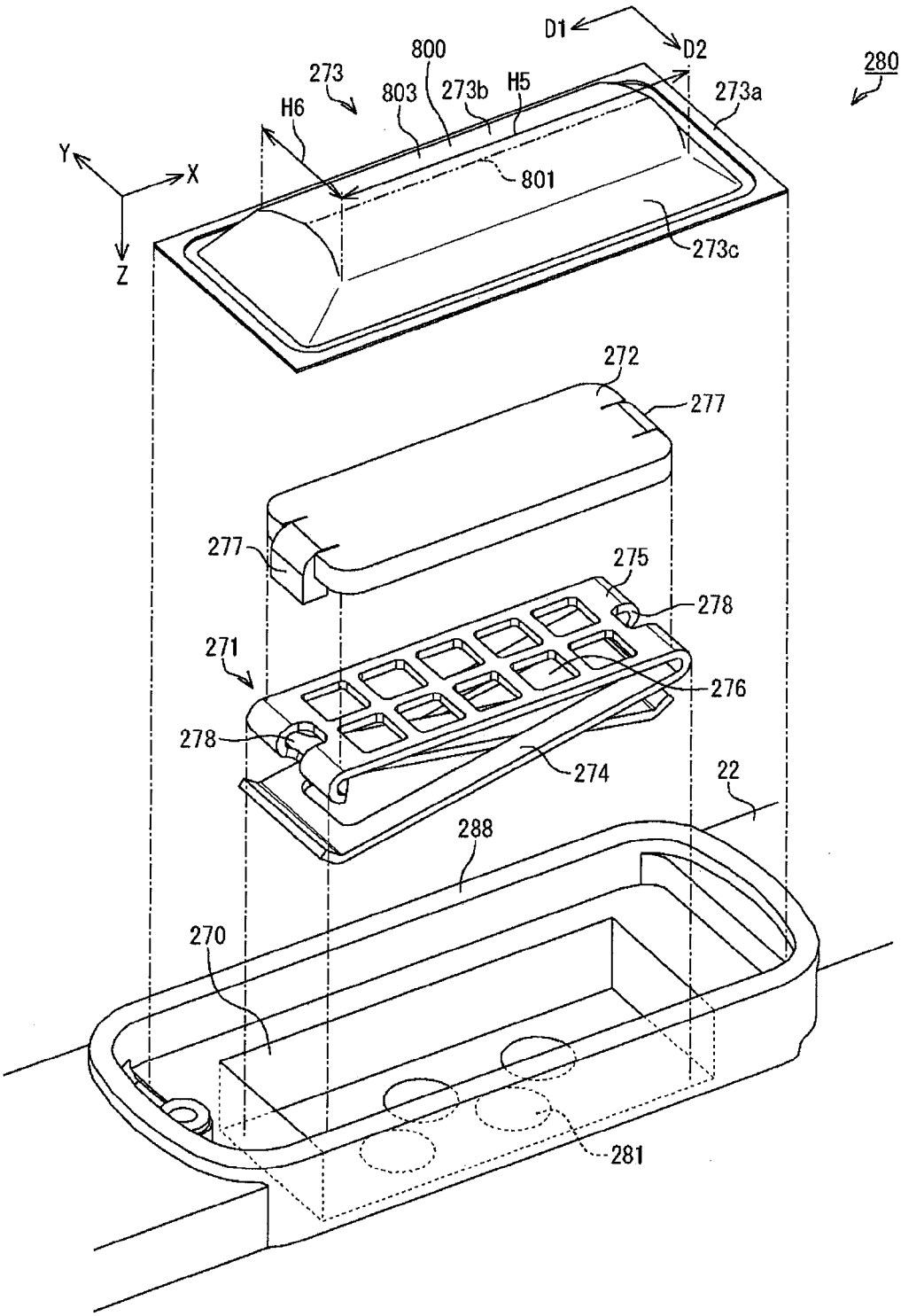
FIG. 24 is an exploded perspective view of the liquid supply portion of working example B1 of the second embodiment.

With cartridge 20 of the second embodiment, as shown in FIG. 24, the container side filter 273 has a convex part 800. The convex part 800 has a projecting part that projects facing from the +Z axis direction toward the −Z axis direction. The width H5 of the convex part 800 in the mounting direction D1 is greater than the width H6 of the convex part 800 in the orthogonal direction D2. The cartridge 20 of the second embodiment has the same constitution as that of the first embodiment except for the convex part 800 extending along the mounting direction D1. Because of this, hereafter, for the same constitutions as those of the first embodiment, we will give the same code numbers as those of the first embodiment, and will omit a detailed description.

Figure 25:
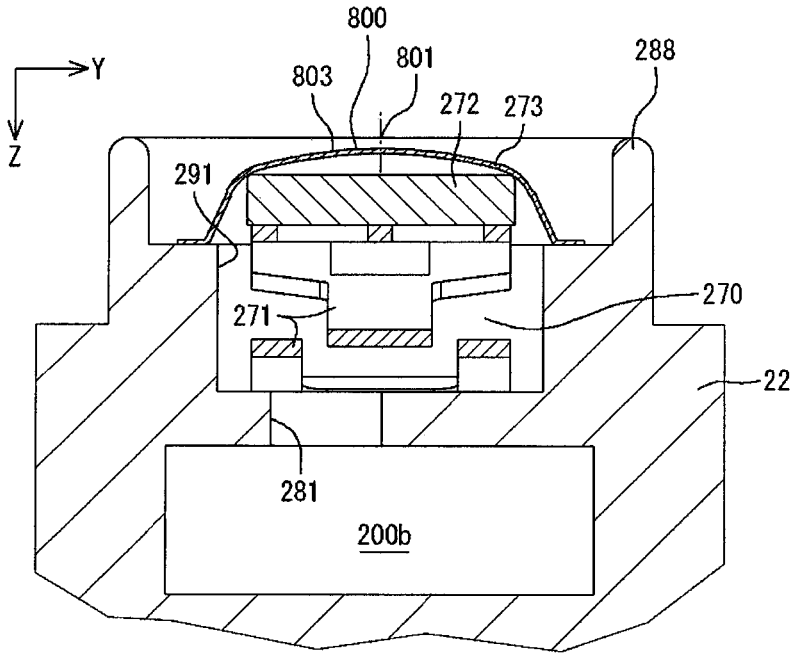
FIG. 25 is a cross section diagram when the container side filter is cut on the YZ plane with the second embodiment.

With the second embodiment, the top part 801 of the convex part 800 of the container side filter 273 extends in the mounting direction D1. Also, the top part 801 is depicted as a virtual straight line shown by dotted lines along the mounting direction D1, so the top part 801 can also be said to extend along the virtual straight line. Because of this, as shown in FIG. 25, the top part 801 appears at the cross section when the container side filter 273 is cut at the YZ plane. In other words, the cross section shape of the container side filter 273 when the container side filter 273 is cut along the orthogonal direction D2 includes the top part 801 of the convex part 800. The top part 801 is the site projecting the furthest in the −Z axis direction when the YZ plane is seen in plane view. With the second embodiment, the convex part 800 of the container side filter 273 is constituted by the line including the curved line 803 at the cross section when cut at the YZ plane. Then, the top part 801 is positioned over the curved line 803.

On the other hand, except for when the container side filter 273 is cut along the mounting direction D1 at the site overlapping the top part 801, the top part 801 does not appear at the cross section when the container side filter 273 is cut at the XZ plane. In other words, of the mounting direction D1 and the orthogonal direction D2, the top part 801 of the convex part 800 of the container side filter 273 extends only in the mounting direction D1. This can be regarded as the top part 801 of the convex part 800 of the container side filter 273 not extending in the orthogonal direction D2.

Here, when the container side filter 273 is in contact with the device side filter 642, there is the problem of air becoming trapped between the container side filter 273 and the device side filter 642. This phenomenon of air becoming trapped appears markedly when the entire area of the center part 273*b* of the container side filter 273 is simultaneously in contact with the device side filter 642. Here, the part including the top part 801 of the center part 273*b* of the container side filter 273 is the first part, and the part not including the top part 801 is the second part. Then, the first part projects further in the direction facing the outside from the inside of the cartridge 20 than the second part. With this constitution, when the cartridge 20 is mounted in the holder 60, after the first part contacts the device side filter 273, the second part contacts the device side filter 642. Because of this, the air held in between the container side filter 273 and the device side filter 642 can be pushed out from the first part to the second part.

Furthermore, of the first part, the smaller the width in the orthogonal direction bisecting at right angles the mounting direction of the cartridge 20, the smaller the surface area initially in contact by the container side filter 273 with the device side filter 642, so the possibility of air becoming trapped is smaller. Because of that, the closer the shape is to a straight line for which the first part has almost no surface area, the greater the effect. Also, the effect is greater when the top part 801 is positioned at the center of the width in the orthogonal direction of the first part.

As shown in FIG. 25, the cross section of the container side filter 273 when the container side filter 273 is cut at the surface parallel in relation to the direction the liquid is discharged from the discharge port 291 to the device side filter 642 has a curved line 803. Then, the top part 801 is positioned over the curved line. With the process of mounting the cartridge 20 in the holder 60, by the top part 801 contacting the liquid introduction portion 640, there is the effect of reducing the trapping of air between the container side filter 273 and the liquid introduction portion 640. Furthermore, the cross section of the container side filter 273 has the curved line 803, so in the process of the container side filter 273 contacting the liquid introduction portion 640, and the shape of that cross section deforming from a curved line to a straight line, it is more difficult for uneven wrinkles or the like to occur in the surface of the container side filter 273. By doing this, when air trapped between the container side filter 273 and the liquid introduction portion 640 is pushed out, it is easier to push the air out, and possible to make it more difficult for it to remain behind.

WORKING EXAMPLE B1

We will explain a working example of the cartridge 20 of the second embodiment. Hereafter, the working examples of the second embodiment are noted as working examples B. Then, since there are a plurality of working examples B, the plurality of working examples B are distinguished from each other by adding a number to each respectively. As described previously, with the cartridge 20 of the second embodiment, the convex part 800 of the container side filter 273 can be formed by implementing embossing on a filter. An example of forming the convex part 800 of the container side filter 273 by implementing embossing on a filter is used as working example B1. With working example B1, it is possible to constitute the convex part 800 of the container side filter 273.

Furthermore, as shown in FIG. 26 through FIG. 31, with the second embodiment, there are a first direction (X axis direction) and a second direction (Y axis direction) that are orthogonal in relation to the direction in which liquid is discharged to the liquid introduction portion 640 from the discharge port 291. Then, the container side filter 273 has a first width in the first direction and a second width in the second direction, and the first width is greater than the second width. At this time, the top part 801 extends in a straight line along the first direction. Here, the exhaust volume per unit of time of the air that existed between the container side filter 273 and the device side filter 642 depends on the length of the top part 801 of the container side filter 273. Having the width be along the larger first direction allows an increase in the efficiency of air exhausting more than having the top part 801 be along the smaller width second direction. As a result, it is possible to make it easier to avoid having air trapped between the container side filter 273 and the device side filter 642.

However, the method of forming the convex part 800 of the container side filter 273 is not limited to working example B1. As the method of forming the convex part 800 of the container side filter 273, for example, it is possible to use a method of providing a projecting structure that projects further to the liquid holding portion 200 side than the container side filter 273, facing the outside from the inside of the recess 270, specifically to the container side filter 273 side, or facing the discharge port 291 from the liquid holding portion 200. In this case, the container side filter 273 is projecting in a direction facing the discharge port 291 from the liquid holding portion 200 using the projecting structure. Hereafter, we will describe an example of forming the convex part 800 of the container side filter 273 using the convex part.

WORKING EXAMPLE B2

Figure 26:
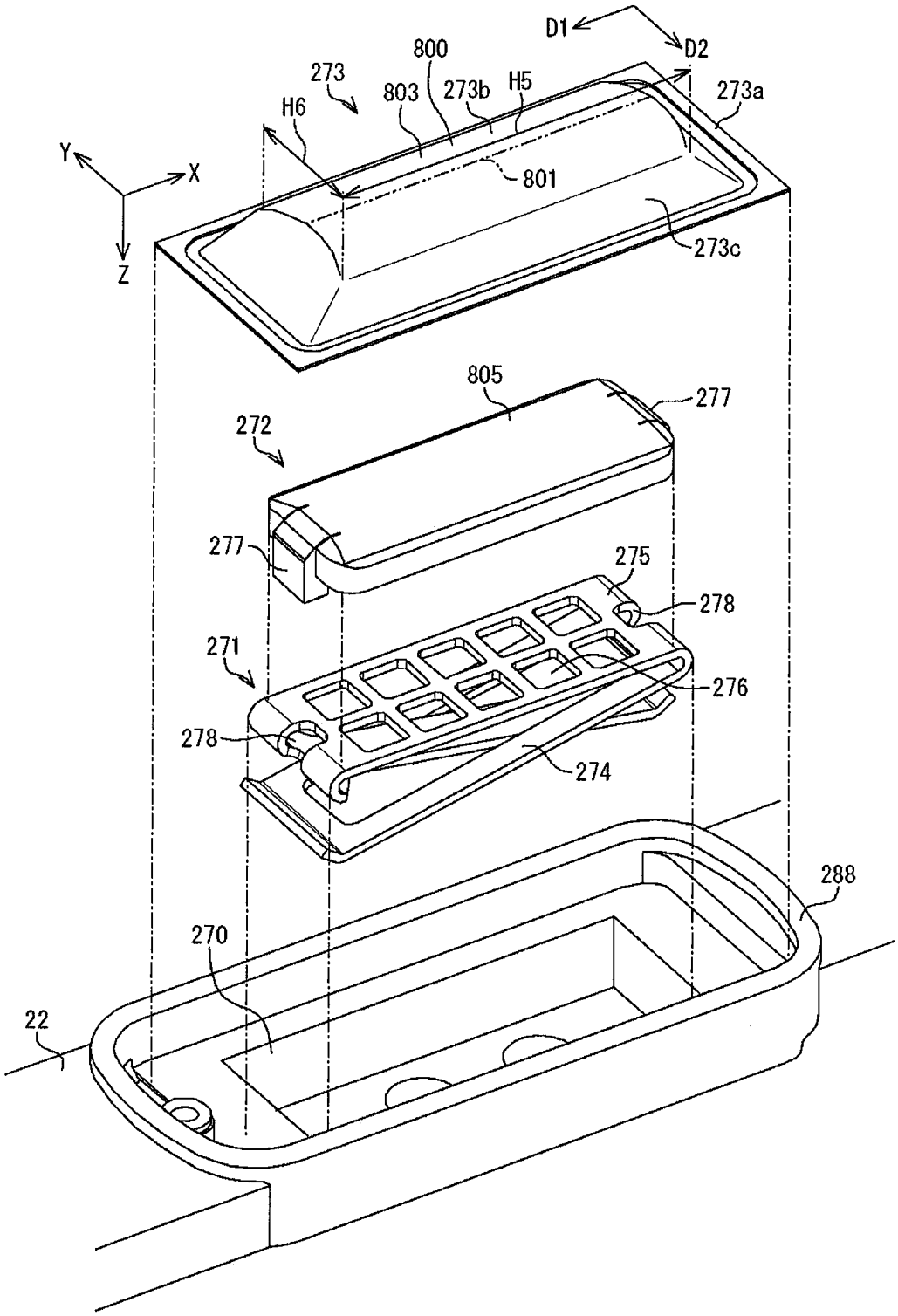
FIG. 26 is an exploded perspective view of the liquid supply portion of working example B2.

With working example B2, as shown in FIG. 26, the convex part 805 for forming the convex part 800 of the container side filter 273 is provided in the foam 272. The convex part 805 is provided at the container side filter 273 side of the foam 272. With the foam 272, the convex part 805 has a projecting part that projects facing the container side filter 273 side, specifically, facing the −Z axis direction. The width in the mounting direction D1 of the convex part 805 is the same as the width H5 of the convex part 800, or is smaller than the width H5 of the convex part 800. Also, the width in the orthogonal direction D2 of the convex part 805 is the same as the width H6 of the convex part 800 or is smaller than the width H6 of the convex part 800. With working example B2, the convex part 805 is provide on the foam 272, so by adhering the container side filter 273 to the case 22 in a state with the flat spring 271 and the foam 272 housed inside the recess 270, it is possible to constitute the convex part 800 of the container side filter 273.

WORKING EXAMPLE B3

Figure 27:
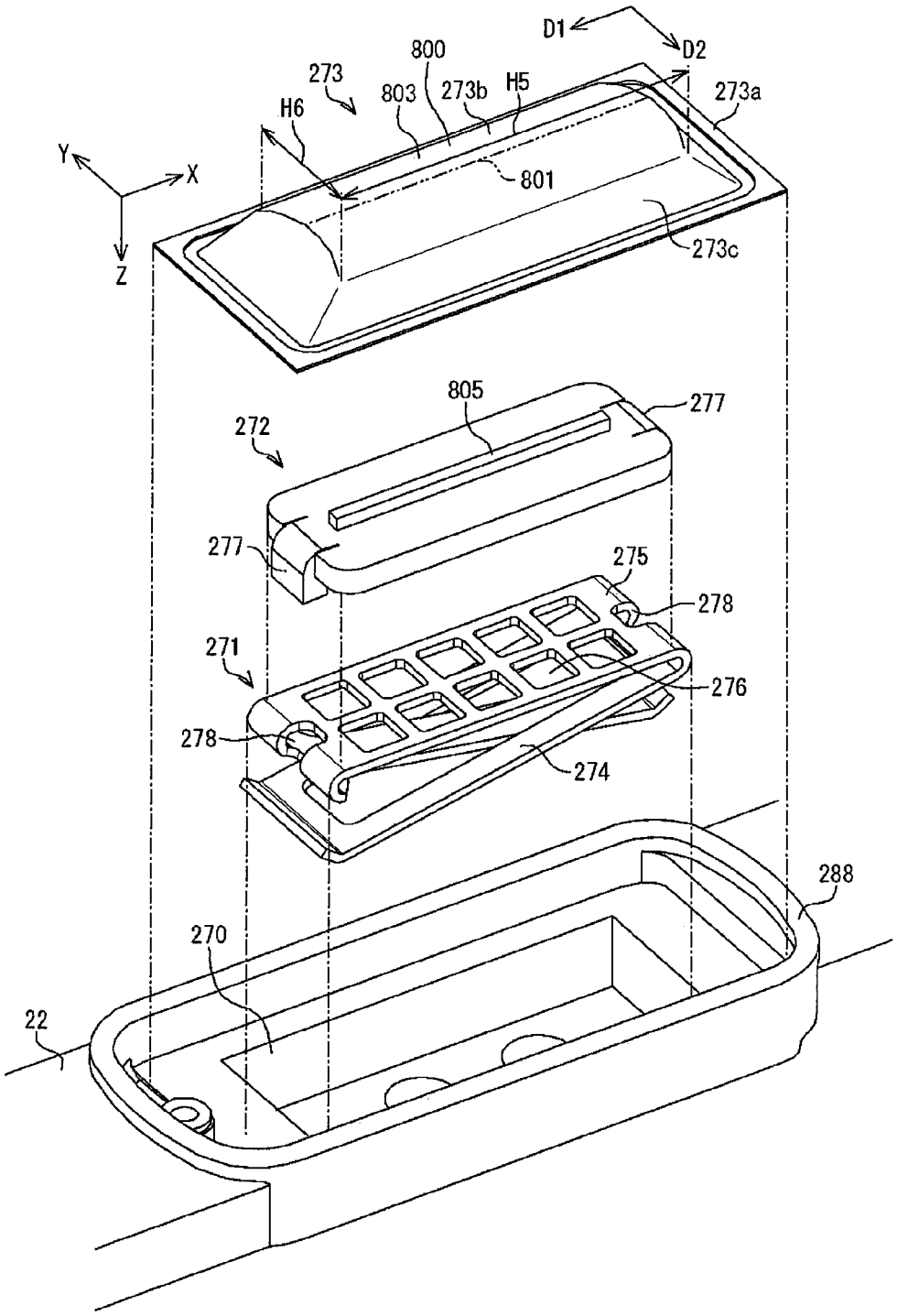
FIG. 27 is an exploded perspective view of the liquid supply portion of working example B3.

With working example B3, as shown in FIG. 27, the convex part 805 for forming the convex part 800 of the container side filter 273 is provided on the foam 272. The convex part 805 is provided on the container side filter 273 side of the foam 272. With the foam 272, the convex part 805 has a projecting part that projects facing the container side filter 273 side, specifically, faces the −Z axis direction. The width in the mounting direction D1 of the convex part 805 is greater than the width in the orthogonal direction D2 of the convex part 805. With working example B3, the convex part 805 extends along the mounting direction D1.

The width in the mounting direction D1 of the convex part 805 is the same as the width H5 of the convex part 800 or is smaller than the width H5 of the convex part 800. Also, the width in the orthogonal direction D2 of the convex part 805 is the same as the width H6 of the convex part 800 or is smaller than the width H6 of the convex part 800. Also, the width in the mounting direction D1 of the convex part 805 with working example B3 is smaller than the width in the mounting direction D1 of the convex part 805 with working example B2 (FIG. 26). With working example B3, the convex part 805 is provided on the foam 272, so by adhering the container side filter 273 to the case 22 in a state with the flat spring 271 and the foam 272 housed inside the recess 270, it is possible to constitute the convex part 800 of the container side filter 273.

WORKING EXAMPLE B4

Figure 28:
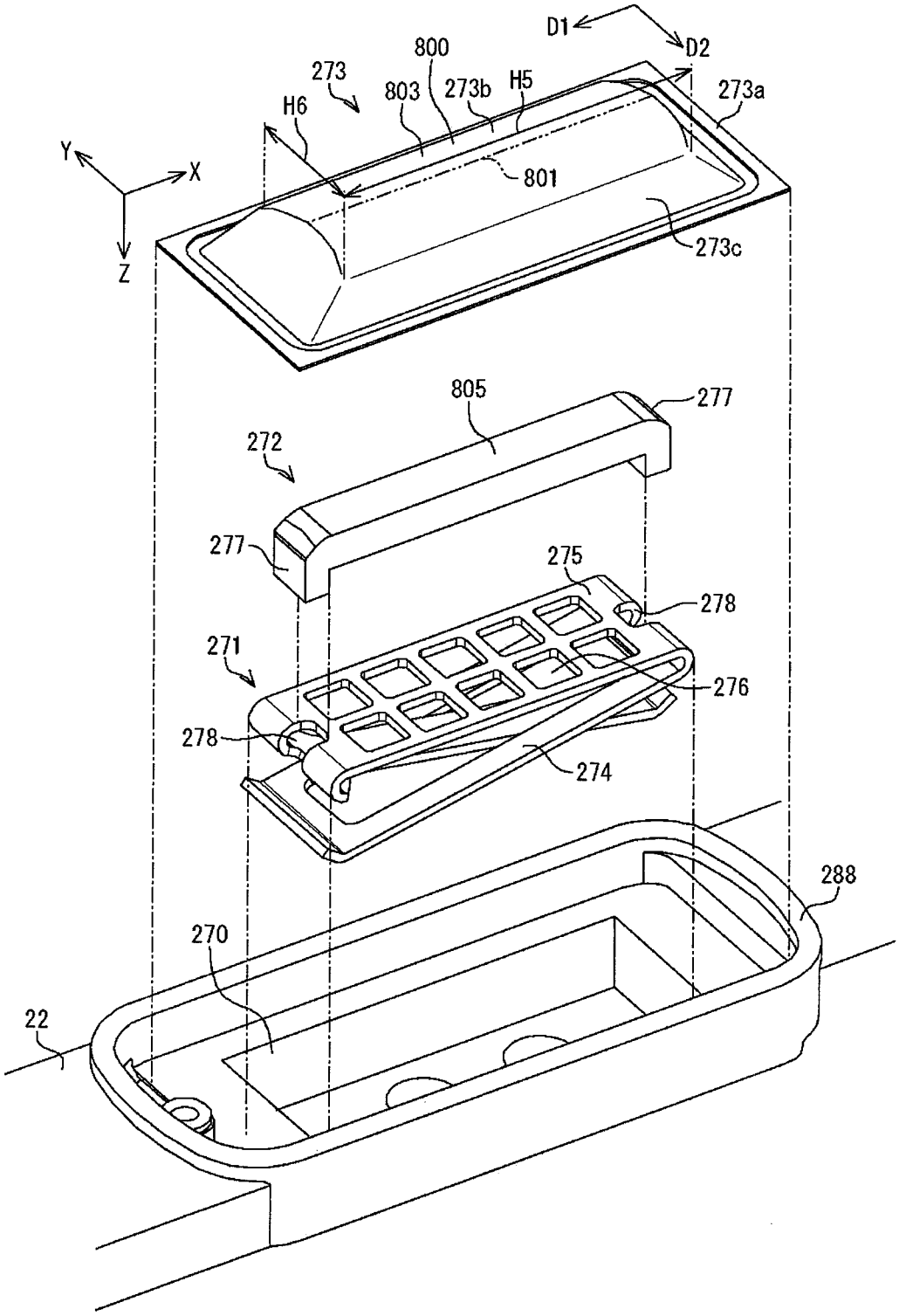
FIG. 28 is an exploded perspective view of the liquid supply portion of working example B4.

With working example B4, as shown in FIG. 28, the convex part 805 is constituted by the foam 272. The foam 272 as the convex part 805 is provided between the flat spring 271 and the container side filter 273. The convex part 805 has a projecting part projecting facing the container side filter 273 side from the flat spring 271, specifically, facing the −Z axis direction. The width in the mounting direction D1 of the convex part 805 is greater than the width in the orthogonal direction D2 of the convex part 805. With working example B4, the convex part 805 extends along the mounting direction D1.

The width in the mounting direction D1 of the convex part 805 is the same as the width H5 of the convex part 800 or is smaller than the width H5 of the convex part 800. Also, the width in the orthogonal direction D2 of the convex part 805 is the same as the width H6 of the convex part 800 or is smaller than the width H6 of the convex part 800. Also, the width in the orthogonal direction D2 of the convex part 805 with working example B4 is smaller than the width in the orthogonal direction D2 of the convex part 805 with working example B2 (FIG. 26). With working example B4, the convex part 805 is constituted by the foam 272, so by adhering the container side filter 273 to the case 22 in a state with the flat spring 271 and the foam 272 housed inside the recess 270, it is possible to constitute the convex part 800 of the container side filter 273.

WORKING EXAMPLE B5

Figure 29:
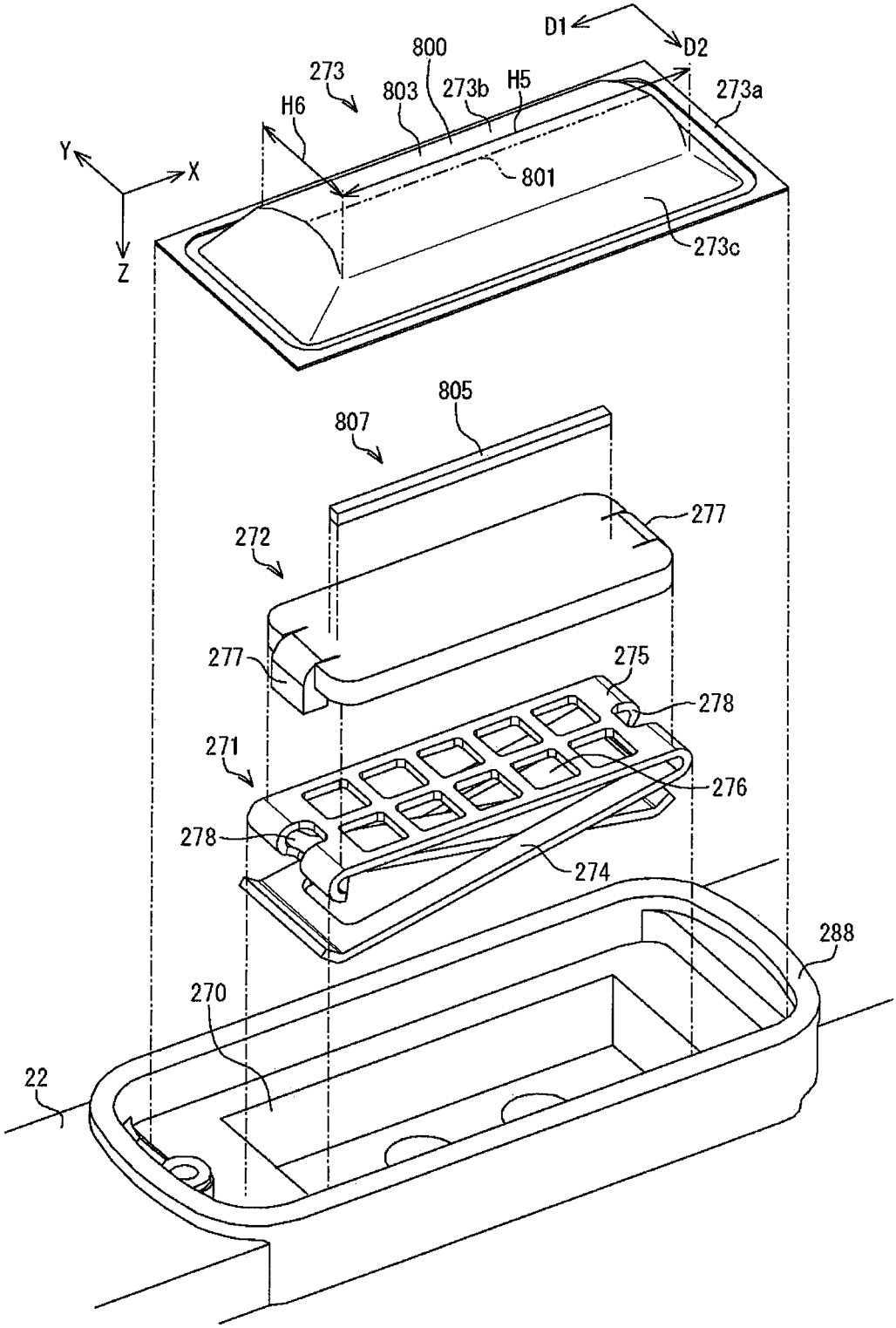
FIG. 29 is an exploded perspective view of the liquid supply portion of working example B5.

With working example B5, as shown in FIG. 29, the convex part 805 is provided between the foam 272 and the container side filter 273. Also, with working example B5, the convex part 805 constitutes the spacer 807. The spacer 807 as the convex part 805 extends in the mounting direction D1. The spacer 807 as the convex part 805 has a projecting part projecting facing the container side filter 273 side from the foam 272 side, specifically, facing the axis direction. The width in the mounting direction D1 of the convex part 805 is greater than the width in the orthogonal direction D2 of the convex part 805. With working example B5, the convex part 805 extends along the mounting direction D1.

The width in the mounting direction D1 of the convex part 805 is the same as the width H5 of the convex part 800 or is smaller than the width H5 of the convex part 800. Also, the width in the orthogonal direction D2 of the convex part 805 is the same as the width H6 of the convex part 800 or is smaller than the width H6 of the convex part 800. Also, the width in the orthogonal direction D2 of the convex part 805 of working example B5 is smaller than the width in the orthogonal direction D2 of the convex part 805 with working example B2 (FIG. 26). As the material of the spacer 807 as the convex part 805, it is possible to use either the same material as the foam 272 or a different material from the material of the foam 272. With working example B5, by adhering the container side filter 273 to the case 22 in a state with the flat spring 271, the foam 272, and the convex part 805 housed inside the recess 270, it is possible to constitute the convex part 805.

WORKING EXAMPLE B6

Figure 30:
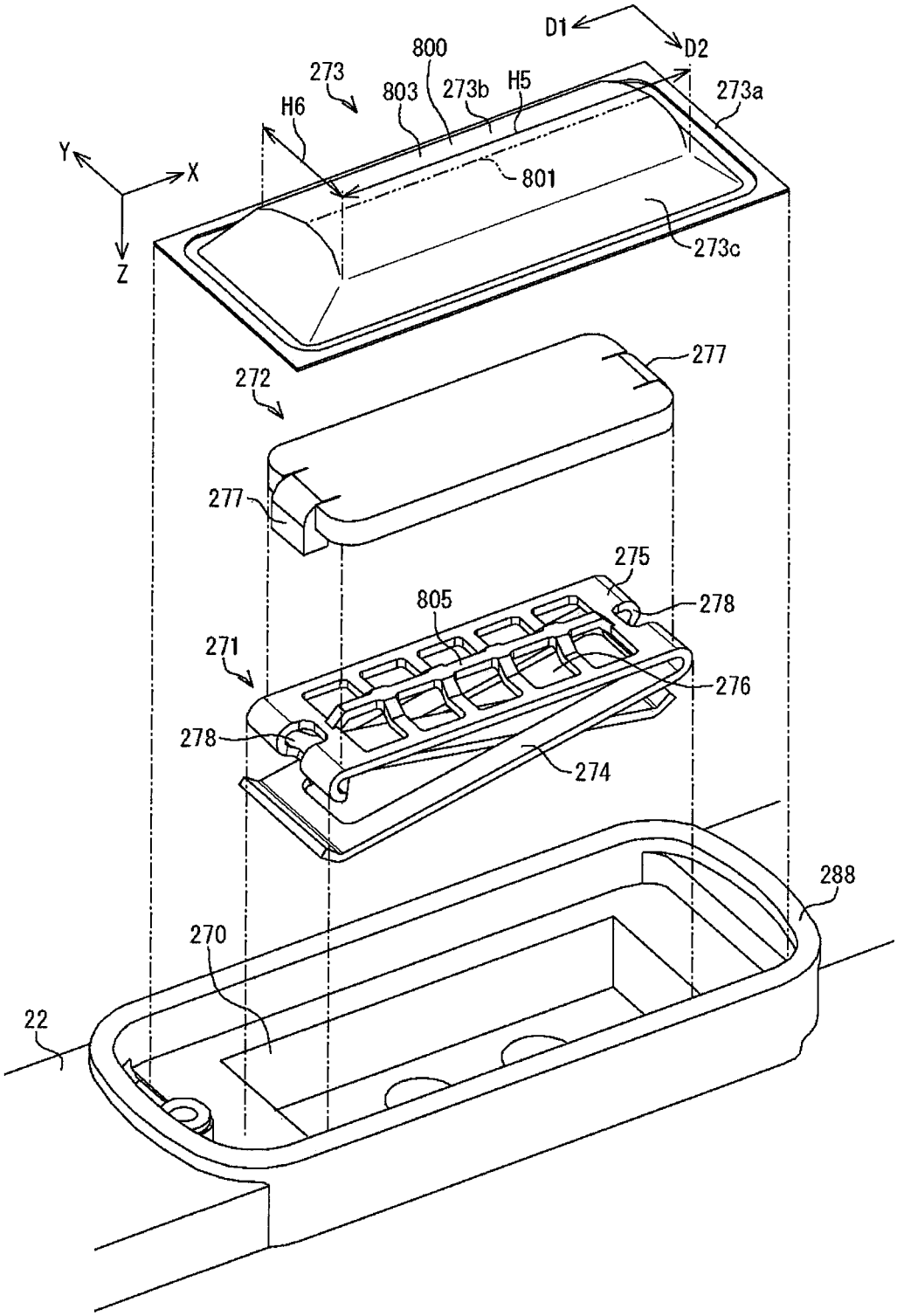
FIG. 30 is an exploded perspective view of the liquid supply portion of working example B6.

With working example B6, as shown in FIG. 30, the convex part 805 is provided on the flat spring 271. The convex part 805 is provided at the container side filter 273 of the flat spring 271. With the flat spring 271, the convex part 805 has a projecting part projecting facing the container side filter 273 side, specifically, facing the −Z axis direction. The width in the mounting direction D1 of the convex part 805 is greater than the width in the orthogonal direction D2 of the convex part 805. With working example B6, the convex part 805 extends along the mounting direction D1.

The width in the mounting direction D1 of the convex part 805 is the same as the width H5 of the convex part 800 or smaller than the width H5 of the convex part 800. Also, the width in the orthogonal direction D2 of the convex part 805 is the same as the width H6 of the convex part 805 or smaller than the width H6 of the convex part 800. With the example shown in FIG. 30, the convex part 805 is formed by implementing bending processing on the support member 275 of the flat spring 271. With working example B6, in a state with the flat spring 271 and the foam 272 housed inside the recess 270, when the container side filter 273 is adhered to the case 22, the foam 272 is boosted in the direction that is convex facing the −Z axis direction using the convex part 805. By doing this, it is possible to constitute the convex part 800 of the container side filter 273.

WORKING EXAMPLE B7

Figure 31:
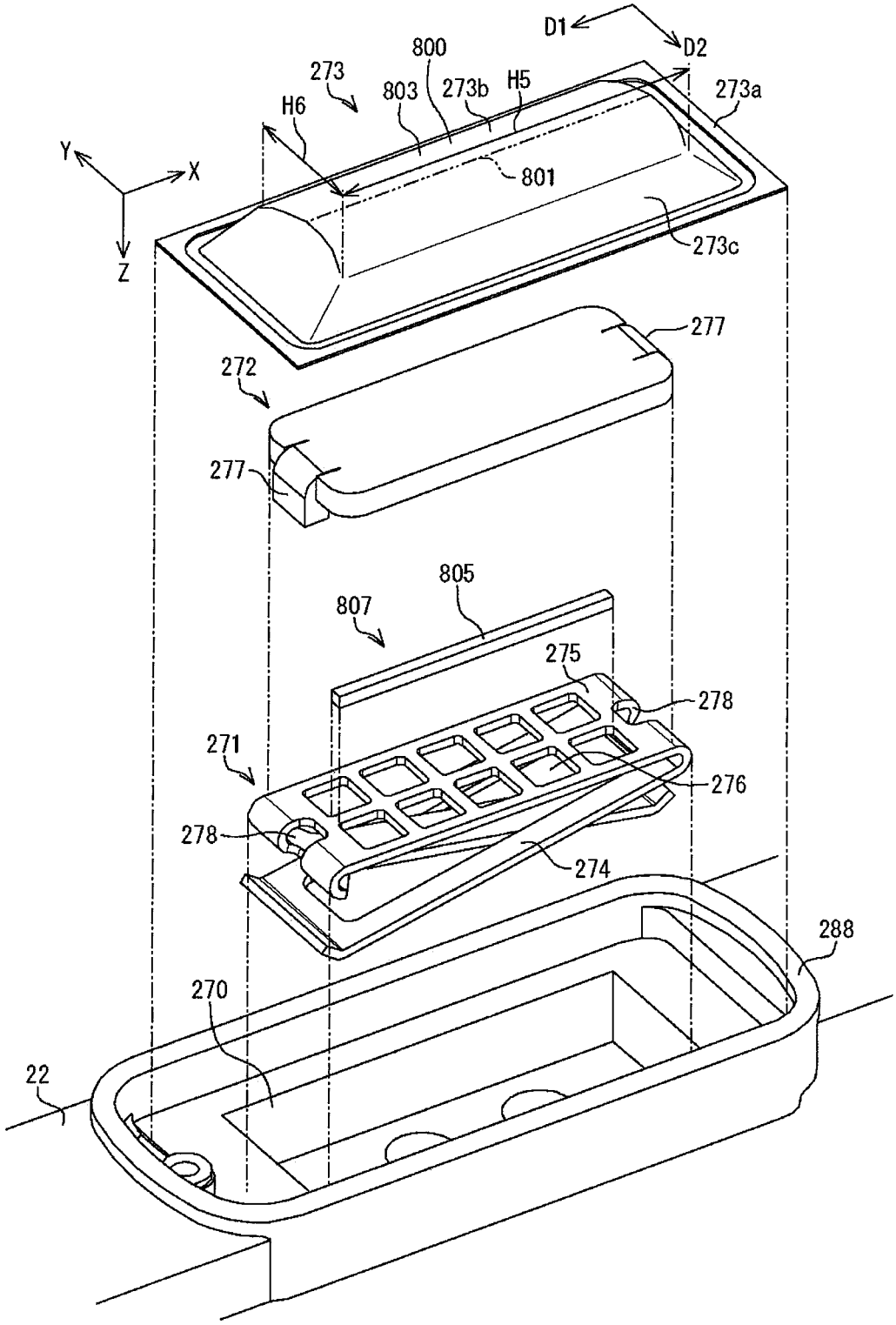
FIG. 31 is an exploded perspective view of the liquid supply portion of working example B7.

With working example B7, as shown in FIG. 31, the convex part 805 is provided between the flat spring 271 and the foam 272. The convex part 805 with working example B7 has the same constitution as the convex part 805 with working example B5 except for the arrangement position being different. Because of this, hereafter, we will omit a detailed description of the convex part 805. With working example B7, when the container side filter 273 is adhered to the case 22 in a state with the flat spring 271, the convex part 805, and the foam 272 housed inside the recess 270, the foam 272 is boosted in the direction that is convex facing the −Z axis direction using the convex part 805. By doing this, it is possible to constitute the convex part 800 of the container side filter 273.

WORKING EXAMPLE B8

Figure 32:
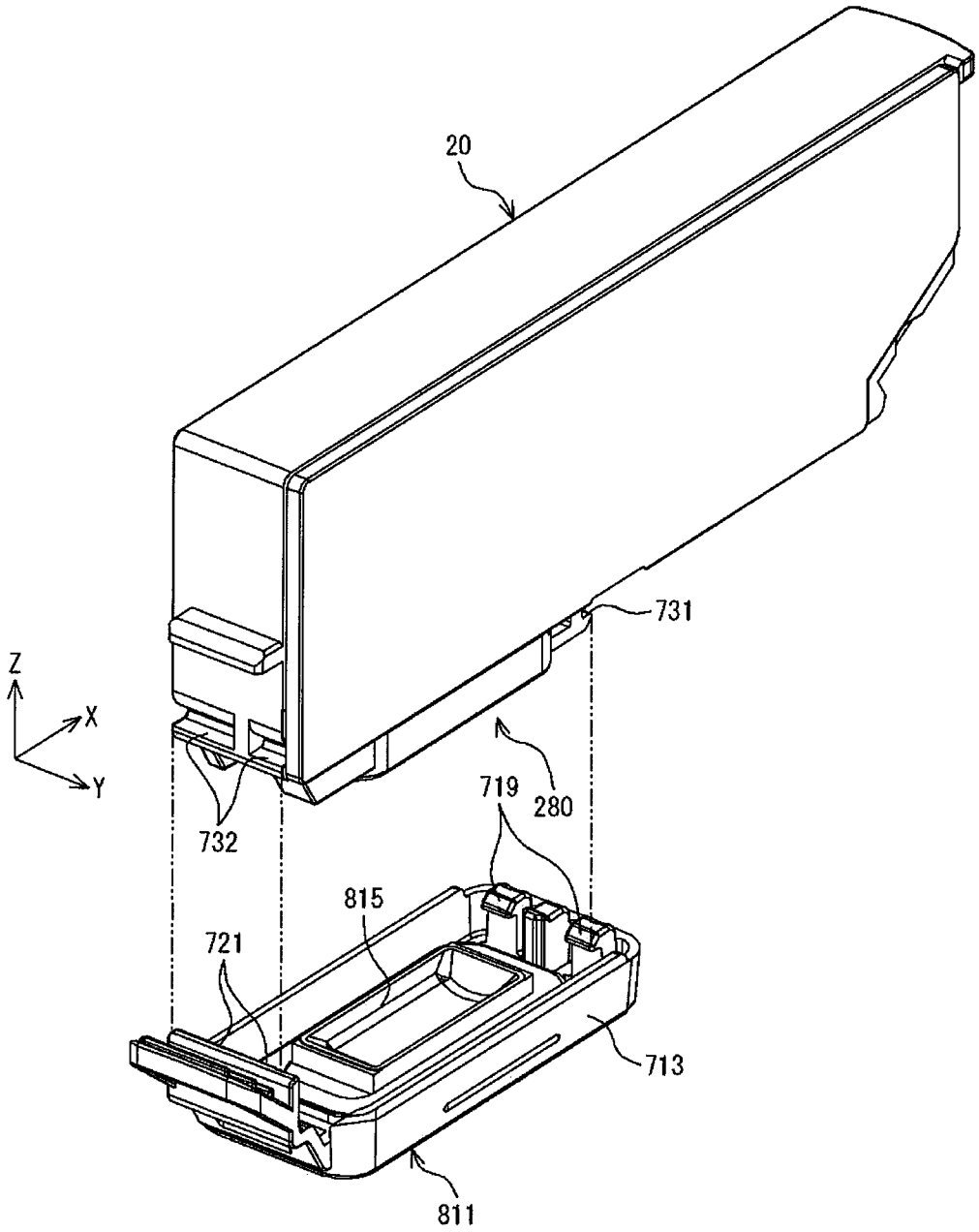
FIG. 32 is a perspective view showing the cartridge and the cap of working example B8.

With working example B8, as shown in FIG. 32, the cap 811 is added to the cartridge 20. In a state with the cartridge 20 unused, the cap 811 is covered on the liquid supply portion 280. It is possible to close the liquid supply portion 280 using the cap 811. By closing the liquid supply portion 280 with the cap 811, it is possible to suppress to a low level leaking of ink from the liquid supply portion 280 and evaporation of the ink liquid element from the liquid supply portion 280. When the operator mounts the cartridge 20 in the printer 50, he removes the cap 811 from the liquid supply portion 280 and mounts the cartridge 20 on the printer 50. In other words, the cartridge 20 is mounted in the printer 50 in a state with the cap 811 removed from the liquid supply portion 280.

Figure 33:
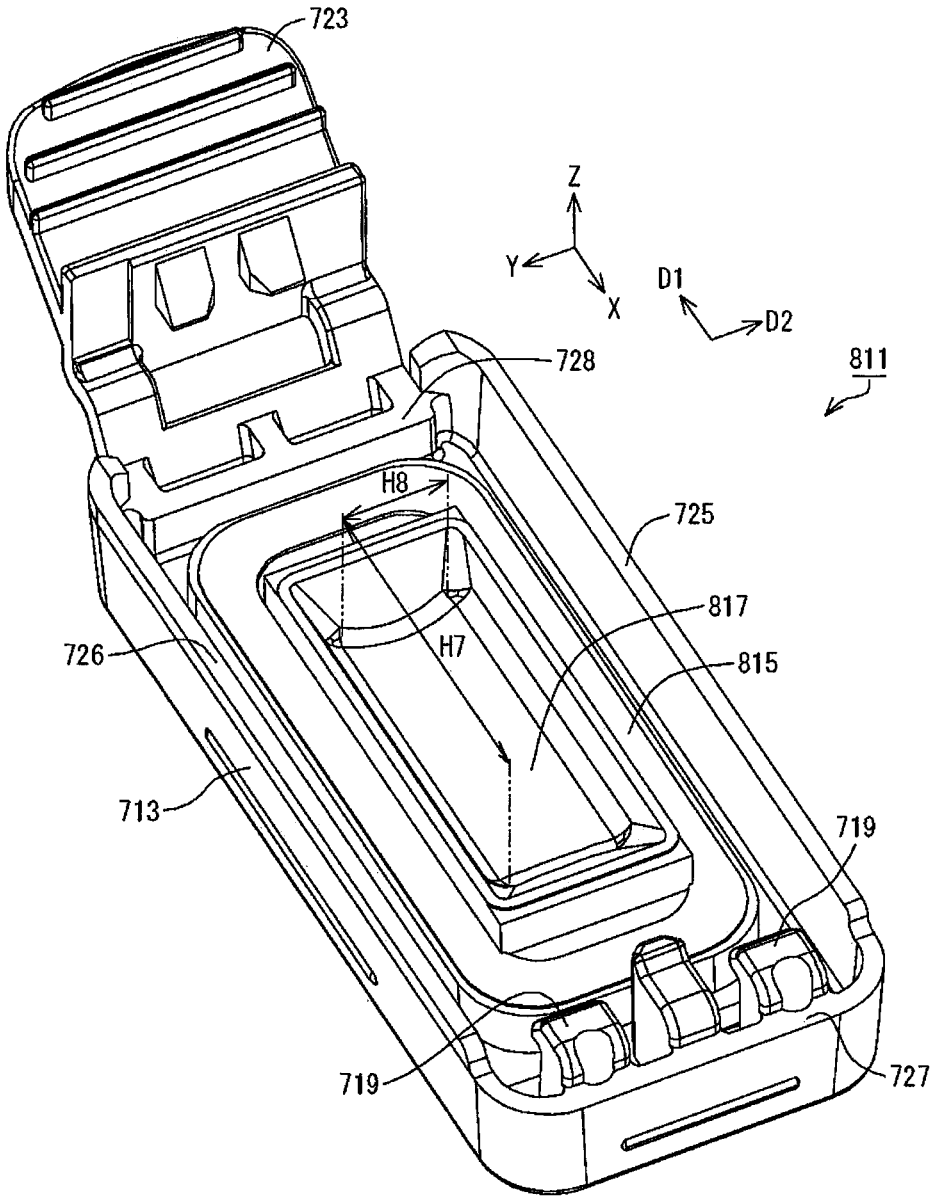
FIG. 33 is a perspective view showing the cap of working example B8.

As shown in FIG. 33, the cap 811 has a seal member 815. A recess 817 is provided on the seal member 815. The cap 811 has the same constitution as the cap 711 with the first embodiment except for the seal member 815. Because of this, hereafter, for the same constitutions as those of the cap 711, the same code numbers as the cap 711 are given, and a detailed description is omitted.

Figure 34:
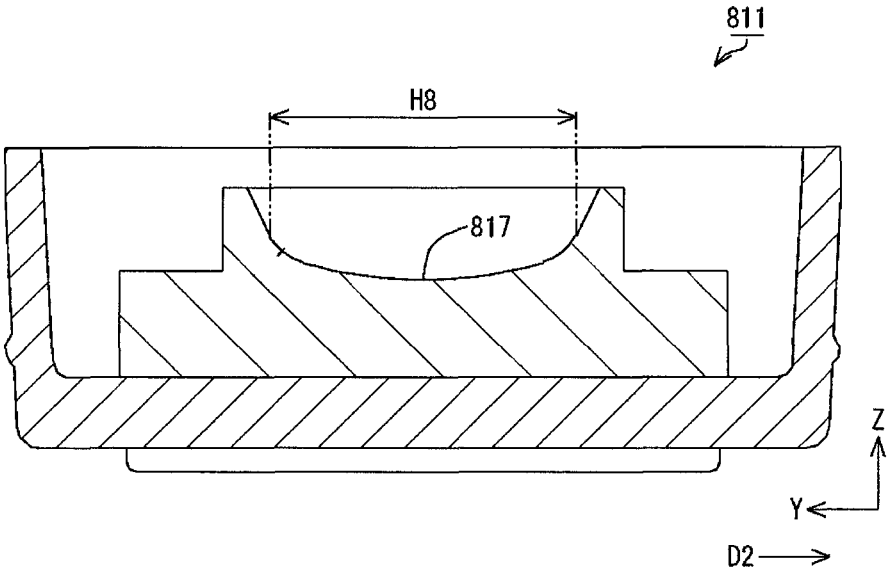
FIG. 34 is a cross section view when the cap is cut on the YZ plane with working example B8.

As shown in FIG. 34, the recess 817 is provided facing being concave facing the −Z axis direction. The width H8 in the orthogonal direction D2 of the recess 817 is the same as the width H6 of the convex part 800 (FIG. 24) or is greater than the width H6 of the convex part 800. Also, as shown in FIG. 33, the width H7 in the mounting direction D1 of the recess 817 is the same as the width H5 of the convex part 800 (FIG. 24) or is greater than the width H5 of the convex part 800.

Figure 35:
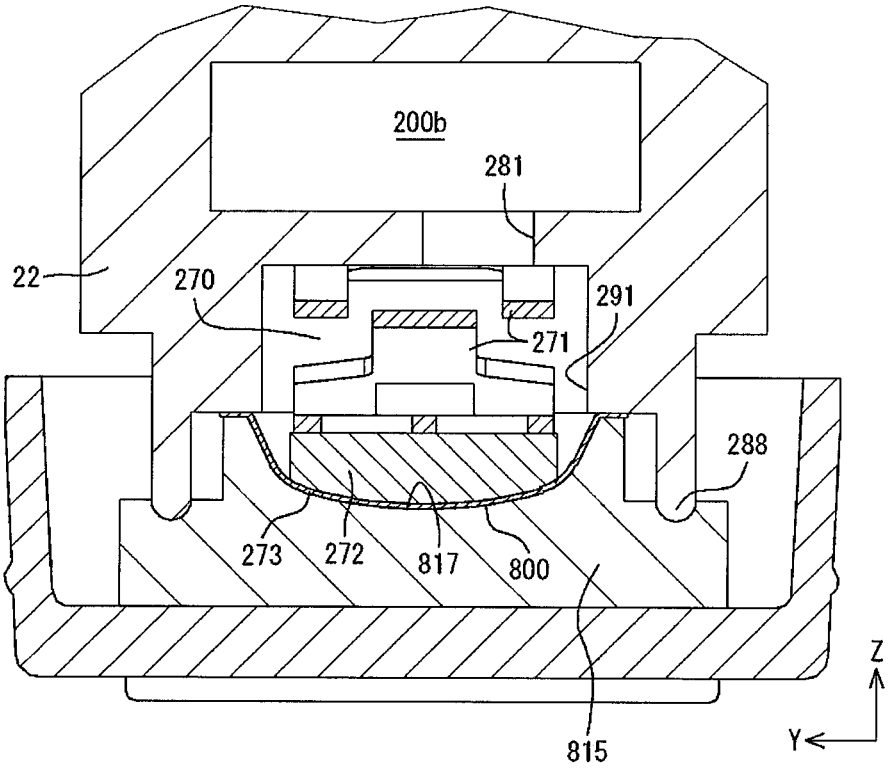
FIG. 35 is a partial cross section diagram when the cap is mounted on the cartridge with working example B8.

In the state with the cap 811 mounted in the cartridge 20, as shown in FIG. 35, the recess 817 faces opposite the foam 272 sandwiching the container side filter 273. Then, the recess 817 is in contact with the container side filter 273. At this time, the foam 272 is pressed facing the +Z axis direction by the recess 817 of the seal member 815 via the container side filter 273. By doing this, it is possible to constitute the convex part 800 on the container side filter 273. In other words, with working example B8, by mounting the cap 811 on the cartridge 20, the convex part 800 of the container side filter 273 is formed.

With working example B8, when the cap 811 is removed from the cartridge 20, as time elapses, the deformation of the foam 272 and the container side filter 273 is reversed. Because of this, when the cap 811 is removed from the cartridge 20, as time elapses, the convex part 800 of the container side filter 273 decreases. However, during the time it takes from removing the cap 811 from the cartridge 20 until mounting of the cartridge 20 on the printer 50, the boosting of the convex part 800 is maintained. Because of that, with working example B8 as well, it is possible to obtain the same effects respectively as from working example B1 through working example B7. In other words, with working example B8 as well, when the cartridge 20 is mounted in the holder 60, it is possible to avoid air becoming trapped between the container side filter 273 and the device side filter 642. Even when the convex part 800 disappears after the cartridge 20 is mounted in the printer 50, there is no loss of the function of the cartridge 20 or the printer 50.

With the second embodiment described above, it is possible to use the respective working example B1 through working example B8 individually. Also, with the second embodiment described above, it is possible to also use a constitution that combines a number of the working example B1 through working example B8. Furthermore, it is possible to also use a constitution that combines all of from working example B1 through working example B8.

THIRD EMBODIMENT

Figure 36:
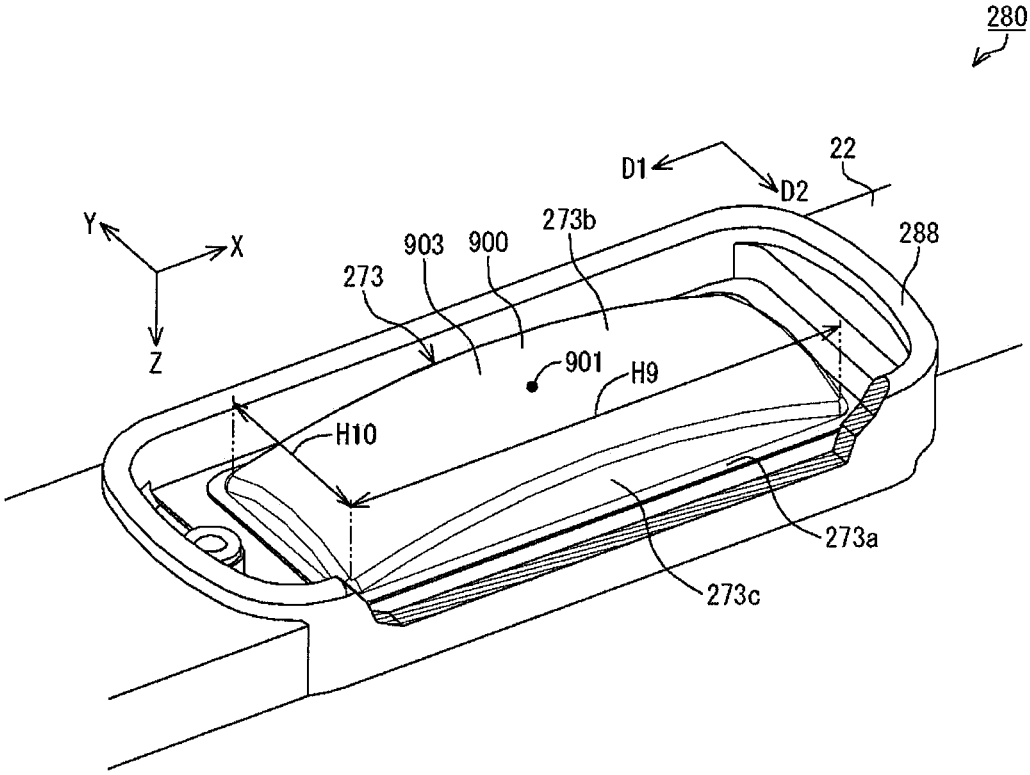
FIG. 36 is a perspective view of the liquid supply portion of the third embodiment.

With the cartridge 20 of the third embodiment, as shown in FIG. 36, the container side filter 273 has a convex part 900. With FIG. 36, to show the constitution in an easy to understand way, a state with a portion of the container side cylindrical body 288 cut away is shown. The cartridge 20 of the third embodiment has the same constitution as the first embodiment except for the container side filter 273 having the convex part 900. Because of his, hereafter, for the same constitutions as those of the first embodiment, the same code numbers will be given as with the first embodiment, and a detailed description will be omitted.

The convex part 900 has a projecting part that is convex in the direction facing the −Z axis direction from the +Z axis direction, specifically, in the direction facing the discharge port 291 side from the liquid holding portion 200 (FIGS. 11A and 11B) side. The width H7 of the convex part 900 in the mounting direction D1 is greater than the width H8 of the convex part 900 in the orthogonal direction D2. With the cartridge 20 of the third embodiment, the top part 901 of the convex part 900 exists as a point (apex). In other words, with the container side filter 273, the top part 901 as the apex projects the furthest in the −Z axis direction. With the third embodiment, the top part 901 is positioned over a spherical surface 903.

The container side filter 273 has a first part including the top part 901 and a second part that does not include the top part 901. The first part projects further in the direction facing the discharge port 291 from the liquid holding portion 200 than the second part. Because of this, with the process of mounting the cartridge 20 in the holder 60, the first part contacts the device side filter 273 ahead of the second part. By doing this, only the first part of the container side filter 273 is in contact with the device side filter 642 during the first period in the mounting process. Then, it is only the second part that newly starts contact in the second period subsequent to the first period.

Here, when the surface area in simultaneous contact of the container side filter 273 and the device side filter 642 is large, the time required to allow the trapped air to escape to the outside from between the container side filter 273 and the device side filter 642 increases, so the possibility of the air being closed in increases. However, if the surface area in simultaneous contact is made smaller, it is possible to reduce the volume of air that fails to escape to the outside of the container side filter 273 during contact. As a result, the air that existed between the container side filter 273 and the device side filter 642 is easily removed from between the container side filter 273 and the device side filter 642.

Furthermore, with the third embodiment, the top part 901 exists as a point (apex), so when the first part is in contact with the device side filter 642, it is possible to have mutual point contact between the container side filter 273 and the device side filter 642. If there is point contact, the surface area in initial contact of the container side filter 273 and the device side filter 642 is extremely small, so the possibility of air becoming trapped is extremely small. Because of that, the effect is greater if the first part is of a shape close to a point having almost no surface area. Also, the effect is greater if the top part 901 is positioned at the center of the width in the mounting direction of the first part.

WORKING EXAMPLE C1

We will describe a working example of the cartridge 20 of the third embodiment. Hereafter, working examples of the third embodiment will be noted as working examples C. Then, hereafter, since there are a plurality of working examples C, the plurality of working examples C will be distinguished from each other by giving each a respective number. As described previously, with the cartridge 20 of the third embodiment, the convex part 900 of the container side filter 273 can be formed by implementing embossing on a filter, for example. An example of forming the convex part 900 of the container side filter 273 by implementing embossing on a filter is used as working example C1. With working example C1, it is possible to constitute the convex part 900 of the container side filter 273.

However, the method of forming the convex part 900 of the container side filter 273 is not limited to working example C1. As the method of forming the convex part 900 of the container side filter 273, for example, it is possible to use a method of providing a projecting structure that is convex facing the outside from the inside of the recess 270, specifically, facing the container side filter 273 side, further to the liquid holding portion 200 side than the container side filter 273. In this case, the container side filter 273 is boosted in a direction that is convex facing the outside from the inside of the liquid holding portion 200 by the projecting structure. Hereafter, we will describe an example of forming the convex part 900 of the container side filter 273 using the projecting structure.

WORKING EXAMPLE C2

Figure 37:
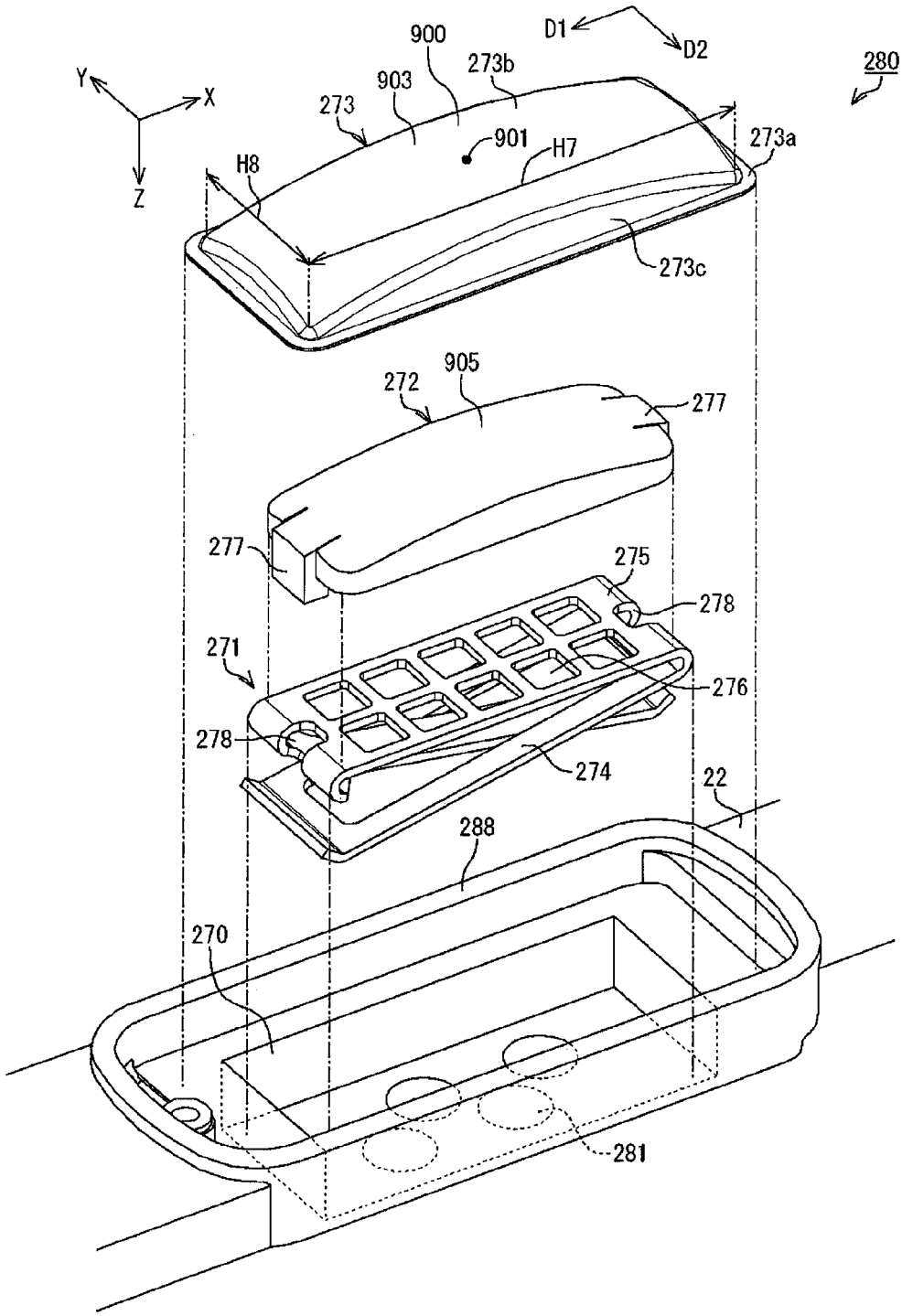
FIG. 37 is an exploded perspective view of the liquid supply portion of working example C2.

With working example C2, a projecting structure for forming the convex part 900 of the container side filter 273 is provided on the foam 272. As shown in FIG. 37, the foam 272 having a projecting structure includes the convex part 905. With working example C2, the convex part 905 constitutes at least a portion of the projecting structure. The convex part 905 is provided on the container side filter 273 side of the foam 272. With the foam 272, the convex part 905 has a projecting part that projects facing the container side filter 273 side, specifically, facing the −Z axis direction. The width in the mounting direction of the convex part 905 is the same as the width H7 of the convex part 900 or is smaller than the width H7 of the convex part 900. Also, the width in the orthogonal direction D2 of the convex part 905 is the same as the width H8 of the convex part 900 or is smaller than the width H8 of the convex part 900.

With working example C2, the convex part 905 is provided on the foam 272, so by adhering the container side filter 273 on the case 22 in a state with the flat spring 271 and the foam 272 housed inside the recess 270, it is possible to constitute the convex part 900 of the container side filter 273. The foam 272 is positioned between the container side filter 273 and the liquid holding portion 200 so as to contact the container side filter 273, and has the convex part 905 on the surface that contacts the container side filter 273. In this way, by forming the foam 272 having the convex part 905 in advance, it is possible to simplify the manufacturing process of incorporating the projecting structure in the cartridge 20.

WORKING EXAMPLE C3

Figure 38:
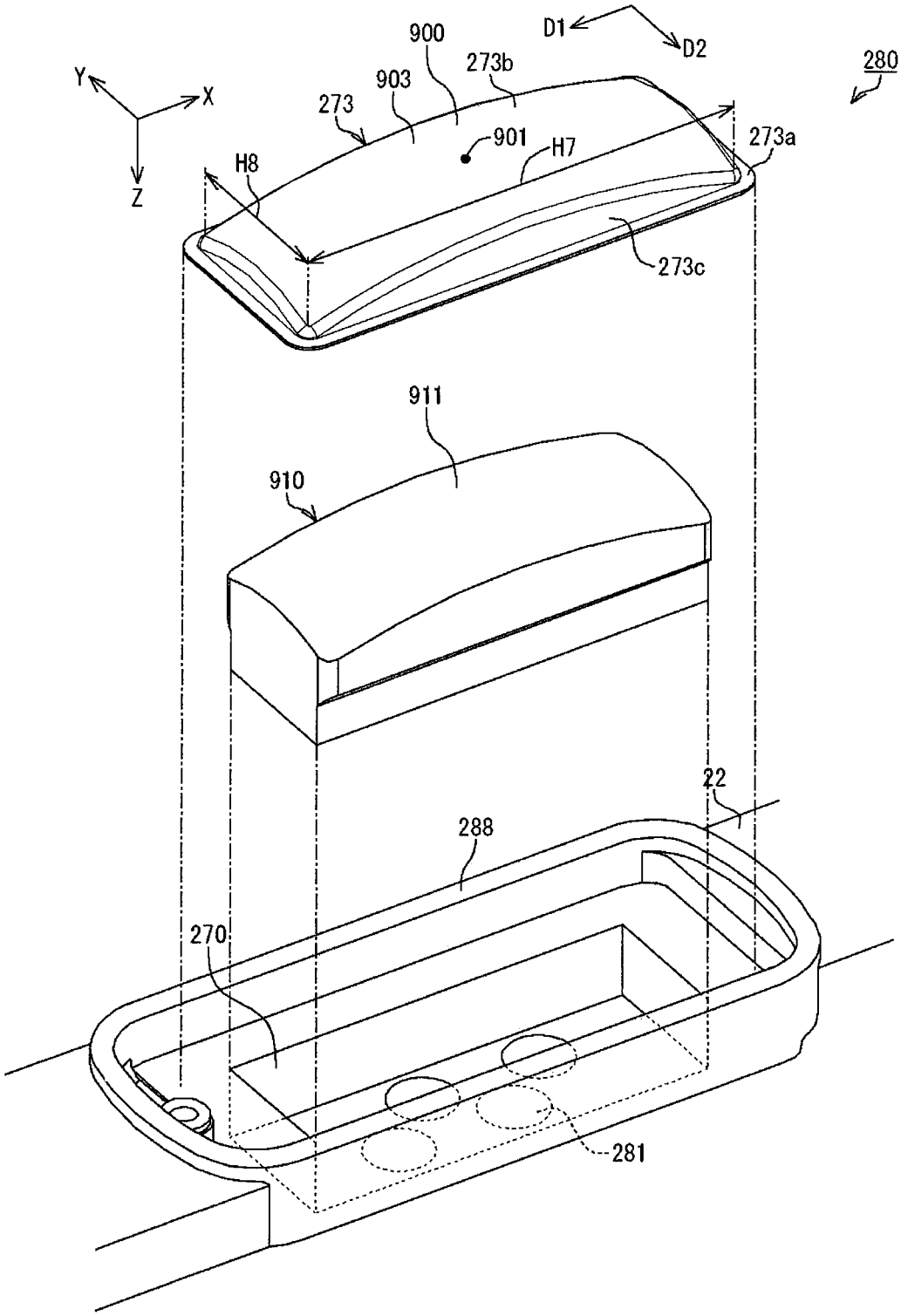
FIG. 38 is an exploded perspective view of the liquid supply portion of working example C3.

With the cartridge 20 of the working example C3, as shown in FIG. 38, the liquid supply portion 280 has the container side filter 273 and the foam 910. The cartridge 20 of working example C3 has the same constitution as the cartridge 20 of working example C2 except for the fact that the flat spring 271 of the carriage 20 of working example C2 is omitted, and the foam 272 is substituted by the foam 910. Because of this, hereafter, for the same constitutions as those of working example C2, the same code numbers as working example C2 are given, and a detailed explanation is omitted.

The foam 910 is inlayed inside the recess 270. Then, the foam 910, in a state inlayed inside the recess 270, projects to the opposite side to the liquid holding portion 200 side further than the recess 270, specifically, further to the −Z axis direction than the recess 270. With working example C3, the projecting structure for forming the convex part 900 of the container side filter 273 is provided on the foam 910. The foam 910 having the projecting structure includes the convex part 911. With working example C3, the convex part 911 constitutes at least a portion of the projecting structure. The convex part 911 has a projecting part that projects facing the container side filter 273 side, specifically, faces the −Z axis direction. The width of the mounting direction D1 of the convex part 911 is the same as the width H7 of the convex part 900 or is smaller than the width H7 of the convex part 900. Also, the width in the orthogonal direction D2 of the convex part 911 is the same as the width H8 of the convex part 900, or is smaller than the width H8 of the convex part 900.

With working example C3, the flat spring 271 is omitted, so compared to working example C2, it is possible to reduce the cost of the cartridge 20, and to simplify the manufacturing process of the cartridge 20. Also, with working example C3, the convex part 911 is provided on the foam 910, so by adhering the container side filter 273 to the case 22 in a state with the foam 910 housed inside the recess 270, it is possible to constitute the convex part 900 of the container side filter 273. The foam 910 is positioned between the container side filter 273 and the liquid holding portion 200 to contact the container side filter 273, and has the convex part 911 on the surface in contact with the container side filter 273. In this way, by forming in advance the foam 272 having the convex part 911, it is possible to simplify the manufacturing process of incorporating the projecting structure in the cartridge 20.

WORKING EXAMPLE C4

Figure 39:
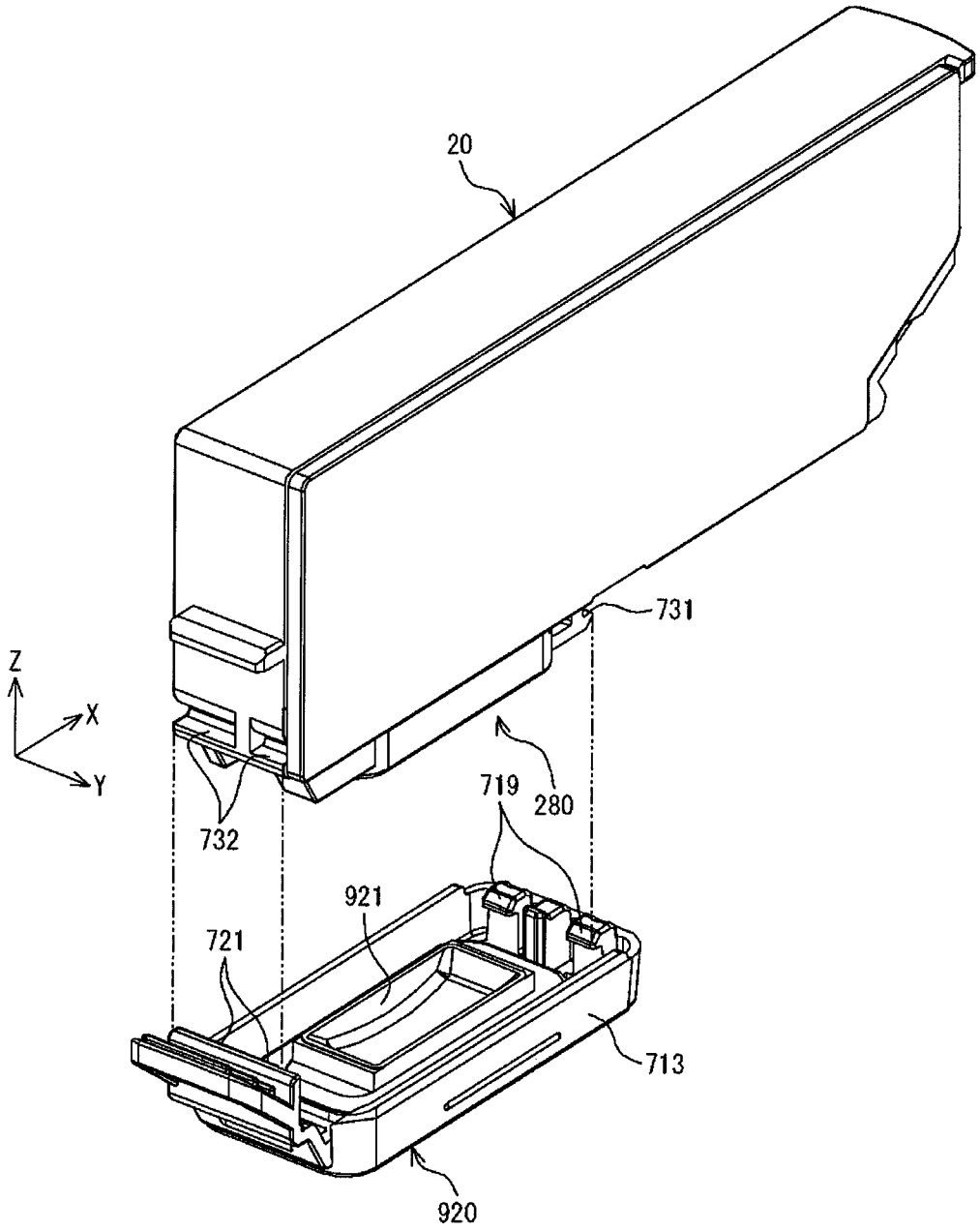
FIG. 39 is a perspective view showing the cartridge and the cap of working example C4.

With working example C4, as shown in FIG. 39, a cap 920 is attached to the cartridge 20. In the unused state of the cartridge 20, the cap 920 covers the liquid supply portion 280. It is possible to close the liquid supply portion 280 using the cap 920. By closing the liquid supply portion 280 with the cap 920, it is possible to suppress to a low level leaking of ink from the liquid supply portion 280 and evaporation of the ink liquid component from the liquid supply portion 280. When the operator mounts the cartridge 20 in the printer 50, he mounts the cartridge 20 in the printer 50 after removing the cap 920 from the liquid supply portion 280. In other words, the cartridge 20 is mounted in the printer 50 in a state with the cap 920 removed from the liquid supply portion 280.

Figure 40:
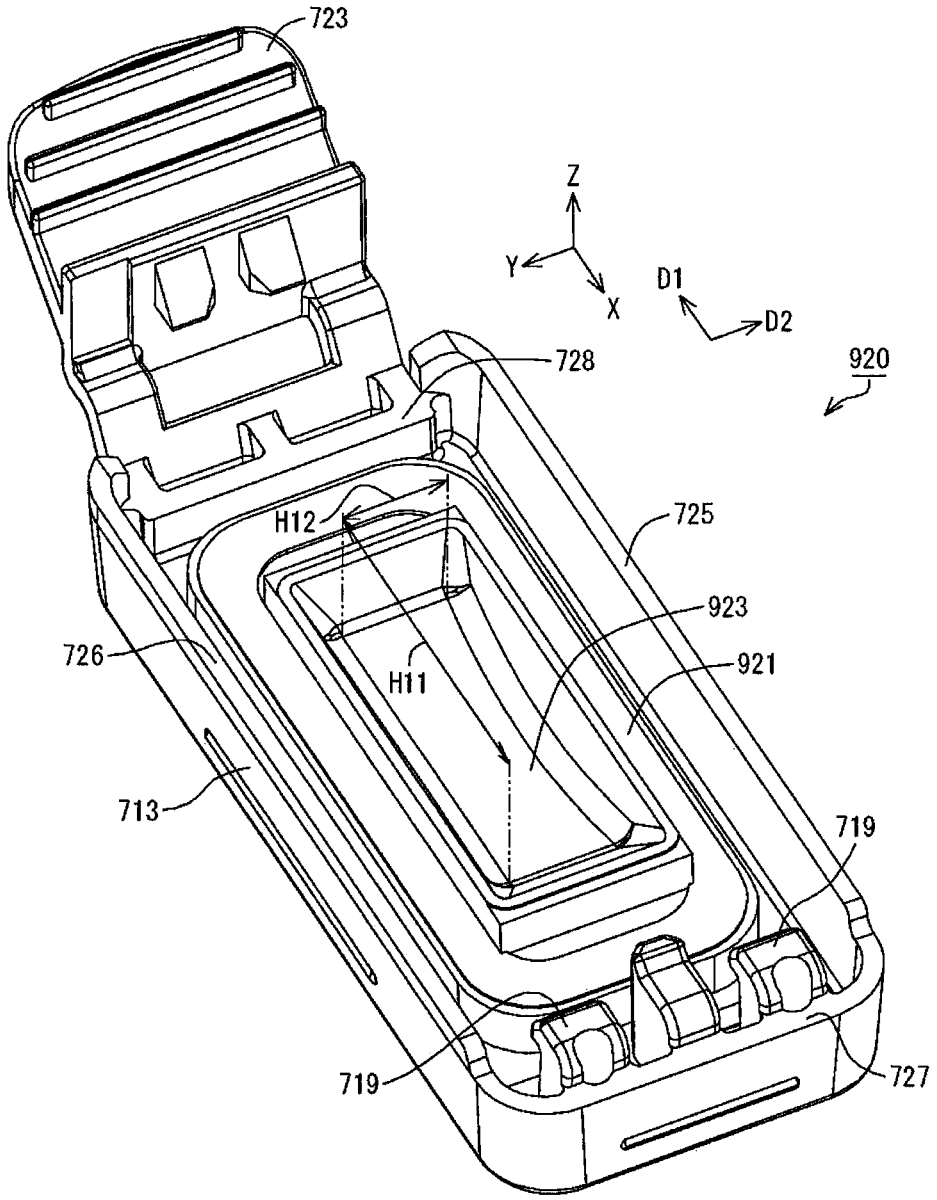
FIG. 40 is a perspective view showing the cap of working example C4.

As shown in FIG. 40, the cap 920 has a seal member 921. A recess 923 is provided in the seal member 921. The cap 920 has the same constitution as the cap 711 of the first embodiment except for the seal member 921. Because of this, hereafter, for the same constitutions as the cap 711, the same code numbers are given, and a detailed description is omitted.

Figure 41:
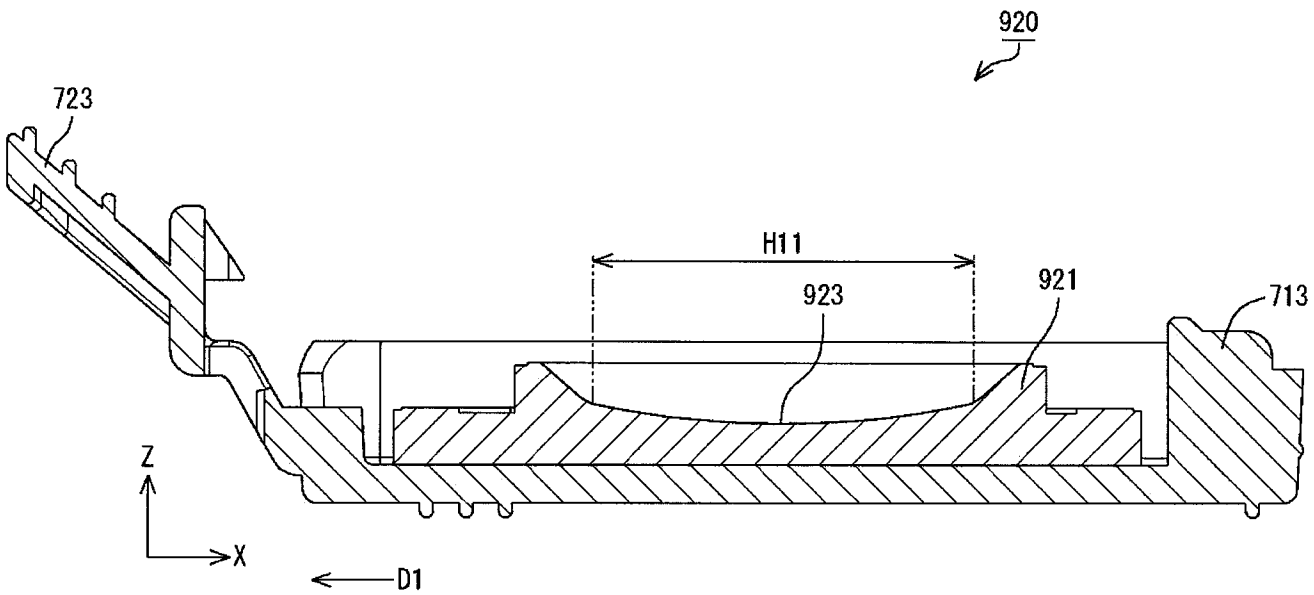
FIG. 41 is a cross section diagram when the cap is cut in the XZ plane with working example C4.

As shown in FIG. 41, the recess 923 is provided in a direction that is concave facing the −Z axis direction. The width H12 in the orthogonal direction D2 of the recess 923 is the same as the width H10 of the convex part 900 (FIG. 36) or is greater than the width H10 of the convex part 900. Also, as shown in FIG. 40, the width H11 in the mounting direction D1 of the recess 923 is the same as the width H9 of the convex part 900 (FIG. 36) or is greater than the width H9 of the convex part 900.

Figure 42:
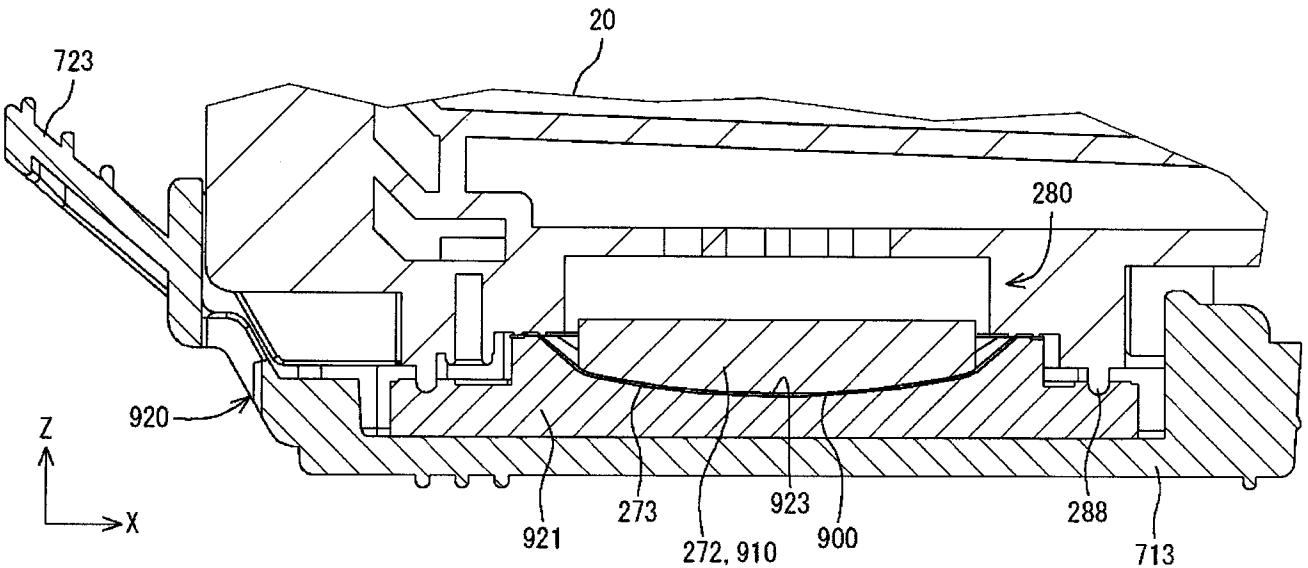
FIG. 42 is a partial cross section diagram when the cap is mounted on the cartridge with working example C4.

In a state with the cap 920 mounted on the cartridge 20, as shown in FIG. 42, the recess 923 faces opposite the foam 272 or the foam 910 sandwiching the container side filter 273. Then, the recess 923 is in contact with the container side filter 273. At this time, the foam 272 or the foam 910 is pressed facing the +Z axis direction by the recess 923 of the seal member 921 via the container side filter 273. By doing this, it is possible to constitute the convex part 900 on the container side filter 273. In other words, with working example C4, the convex part 900 of the container side filter 273 is formed by mounting the cap 920 on the cartridge 20.

With working example C4, when the cap 920 is removed from the cartridge 20, as time elapses, the deformation of the foam 272 or the foam 910 and the container side filter 273 is reversed. Because of this, when the cap 920 is removed from the cartridge 20, as time elapses, the convex part 900 of the container side filter 273 decreases. However, during the time it takes after the cap 920 is removed from the cartridge 20 until the cartridge 20 is mounted in the printer 50, the boosting of the convex part 900 is maintained. Because of this, with working example C4 as well, it is possible to obtain the same effects as with the working example C1 through working example C3 respectively. In other words, with working example C4 as well, when the cartridge 20 is mounted in the holder 60, it is possible to avoid air becoming trapped between the container side filter 273 and the device side filter 642. Even when the convex part 900 disappears after the cartridge 20 is mounted in the printer 50, there is no loss of the functions of the cartridge 20 or the printer 50.

With the third embodiment, it is possible to use working example C1 through working example C4 respectively individually. Also, with the third embodiment, it is possible to use constitutions that combine a number of working example C1 through working example C4. As combinations of the working example C1 through working example C4, for example, it is possible to combine working example C1 and working example C2, to combine working example C1 and working example C3, to combine working example C2 and working example C4, to combine working example C3 and working example C4, to combine working example C1 and working example C2 and working example C4, or to combine working example C1 and working example C3 and working example C4, for example.

FOURTH EMBODIMENT

Figure 43:
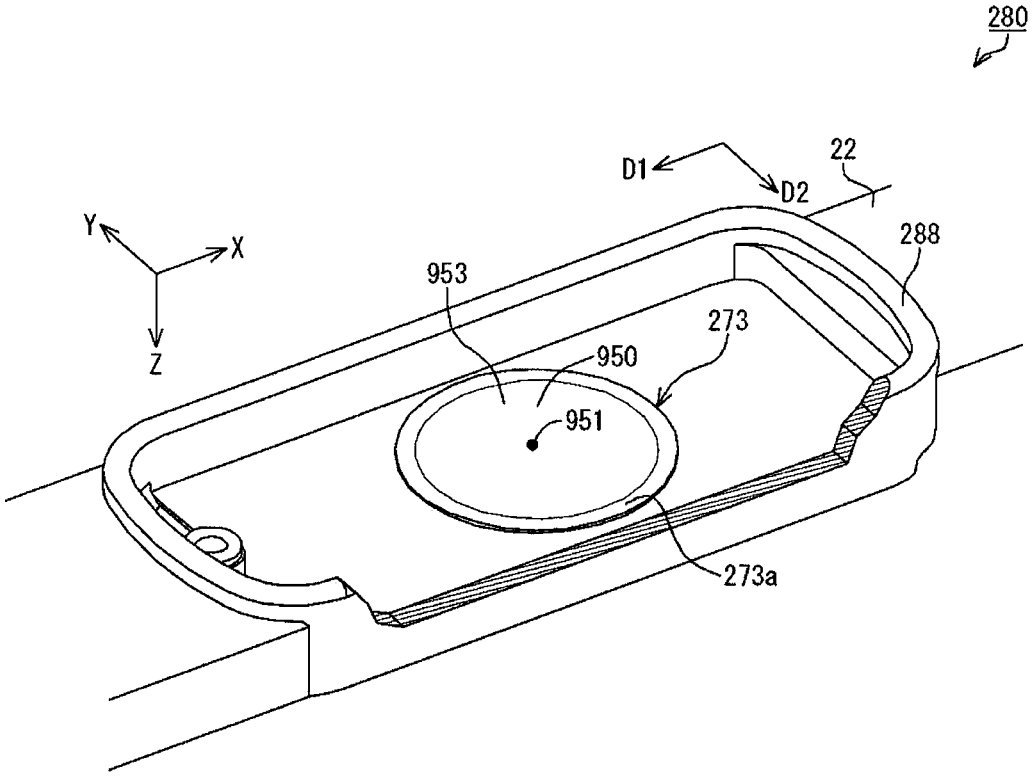
FIG. 43 is a perspective view of the liquid supply portion with the fourth embodiment.

With the cartridge 20 of the fourth embodiment, as shown in FIG. 43, the container side filter 273 has a convex part 950. With FIG. 43, to show the constitution in an easy to understand way, the container side cylindrical body 288 is shown in a state with a portion cut away. The cartridge 20 with the fourth embodiment has the same constitution as that of the first embodiment except that the convex part 950 exhibits a circular shape with the XY plane in planar view. Because of this, hereafter, for the same constitutions as those of the first embodiment, the same code numbers are given as with the first embodiment, and a detailed description will be omitted.

The convex part 950 has a projecting part that is convex facing the −Z axis direction from the +Z axis direction, specifically, in the direction facing the discharge port 291 side from the liquid holding portion 200 (FIGS. 11A and 11B) side. The width of the convex part 950 in the mounting direction D1 and the width of the convex part 950 in the orthogonal direction D2 are equal to each other. With the cartridge 20 of the fourth embodiment, the top part 951 of the convex part 950 exists as a point (apex). In other words, with the container side filter 273, the top part 951 as the apex projects the furthest in the −Z axis direction. With the fourth embodiment, the top part 951 is positioned over the spherical surface 953.

The container side filter 273 has a first part including the top part 951, and a second part that does not include the top part 951. The first part projects in the direction facing the discharge port 291 from the liquid holding portion 200 further than the second part. Because of this, with the process of the cartridge 20 being mounted in the holder 60, the first part contacts the device side filter 642 ahead of the second part. By doing this, only the first part of the container side filter 273 contacts the device side filter 642 in the first period in the mounting process. Also, only the second part starts new contact in the second period subsequent to the first period.

Here, when the surface area in simultaneous contact of the container side filter 273 and the device side filter 642 is large, the time required for the trapped air to escape to outside from between the container side filter 273 and the device side filter 642 increases, so the possibility of air becoming closed in increases. However, if the surface area in contact simultaneously is made smaller, it is possible to reduce the volume of air that fails to escape to outside the container side filter 273 during contact. As a result, the air that existed between the container side filter 273 and the device side filter 642 is easily removed from between the container side filter 273 and the device side filter 642.

Furthermore, with the fourth embodiment, the top part 951 exists as a point (apex), so when the first part is in contact with the device side filter 642, it is possible to have mutual point contact of the container side filter 273 and the device side filter 642. If there is point contact, the surface area in initial contact by the container side filter 273 with the device side filter 642 is extremely small, so the possibility of air becoming trapped is also extremely small. Because of that, the effect is greater if the shape is close to a point for which the first part almost has no surface area. Also, the effect is greater if the top part 951 is positioned at the middle of the width in the mounting direction of the first part.

WORKING EXAMPLE D1

We will describe a working example of the cartridge 20 of the fourth embodiment. Hereafter, the working examples of the fourth embodiment are noted as working examples D. Then, hereafter, since there is a plurality of working examples D, the plurality of working examples D are distinguished from each other by adding numbers to each respectively. As described previously, with the cartridge 20 of the fourth embodiment, the convex part 950 of the container side filter 273 is formed, for example, by implementing embossing on a filter. An example for which the convex part 950 of the container side filter 273 is formed by implementing embossing on a filter is used as working example D1. With working example D1, it is possible to constitute the convex part 950 of the container side filter 273.

Figure 44:
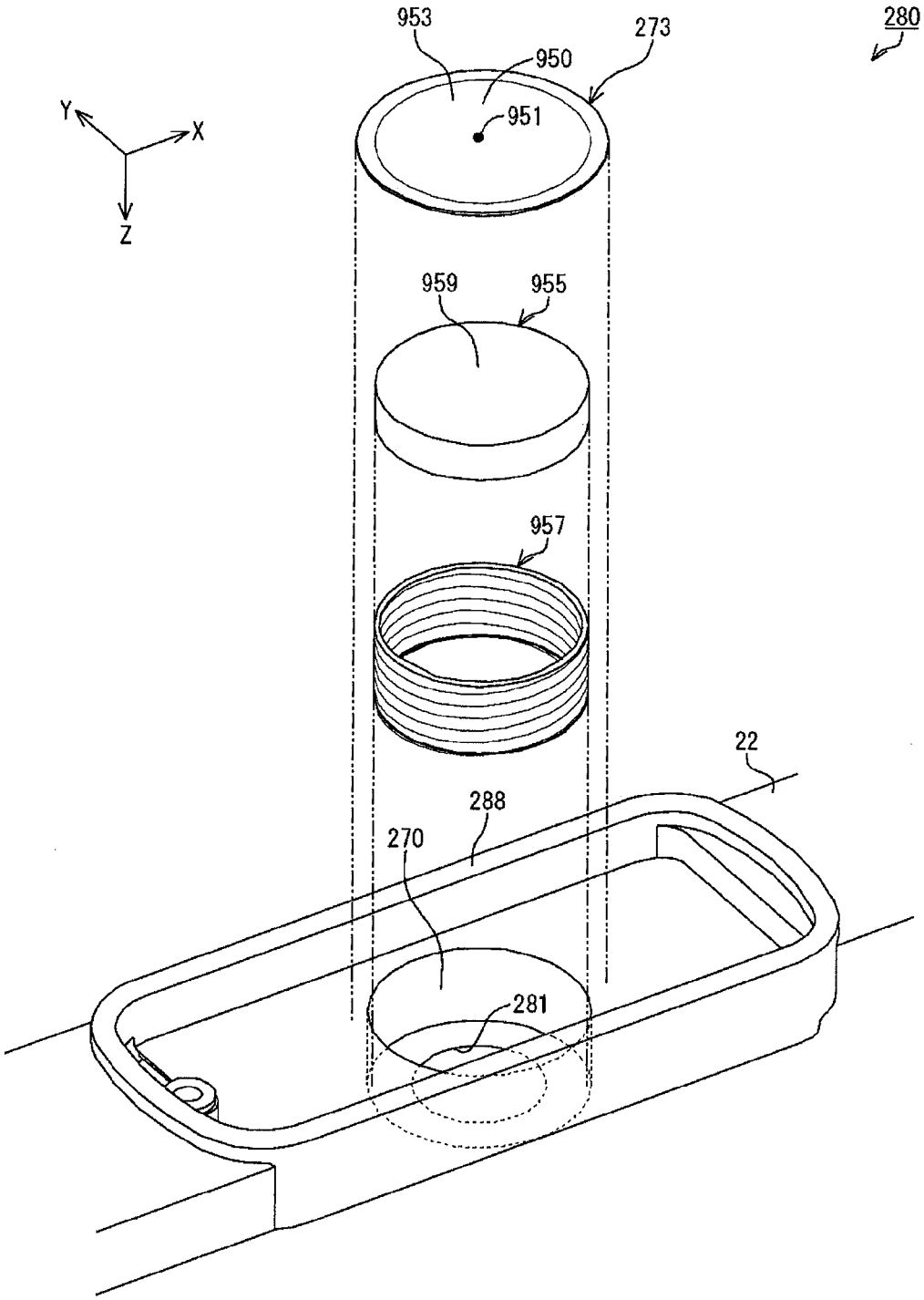
FIG. 44 is an exploded view of the liquid supply portion with working example D2.

Here, with the fourth embodiment, as shown in FIG. 44, the recess 270 of the case 22 exhibits a circular shape with a planar view of the XY plane. Then, the container side filter 273 has a size that covers the recess 270. Then, the container side filter 273 covers the recess 270.

The method of forming the convex part 950 of the container side filter 273 is not limited to that of working example D1. As the method of forming the convex part 950 of the container side filter 273, for example, it is also possible to use a method of providing a projecting structure that is convex facing the outside from the inside of the recess 270, specifically, facing the container side filter 273 side, further to the liquid holding portion 200 side than the container side filter 273. In this case, the container side filter 273 is boosted in a direction that is convex facing the outside from the inside of the liquid holding portion 200 using the projecting structure. Hereafter, we will describe an example of forming the convex part 950 of the container side filter 273 using the projecting structure.

WORKING EXAMPLE D2

With the cartridge 20 of working example D2, as shown in FIG. 44, the liquid supply portion 280 has the container side filter 273, a foam 955, and a coil spring 957. The coil spring 957 and the foam 955 are inserted in this sequence inside the recess 270. Then, the container side filter 273 is adhered to the case 22 further than the foam 955 at the opposite side to the liquid holding portion 200 side, specifically, further than the foam 955 at the −Z axis direction side. The cartridge 20 of the working example D2 has the same constitution as the first embodiment except for the constitution of the liquid supply portion 280 being different from that of the first embodiment. Because of this, hereafter, for the same constitutions as those of the first embodiment, the same code numbers as the first embodiment are given, and a detailed description is omitted.

With working example D2, the projecting structure for forming the convex part 950 of the container side filter is provided on the foam 955. As shown in FIG. 44, the foam 955 having the projecting structure includes a convex part 959. With working example D2, the convex part 959 constitutes at least a portion of the projecting structure. The convex part 959 is provided on the container side filter 273 side of the foam 955. At the foam 955, the convex part 959 has a projecting part that projects facing the container side filter side 273, specifically, facing the −Z axis direction side. The width in the mounting direction D1 of the convex part 959 is the same as the width of the convex part 950, or is smaller than the width of the convex part 950. Also, the width in the orthogonal direction D2 of the convex part 959 is the same as the width of the convex part 950 or is smaller than the width of the convex part 950. Furthermore, the width in the mounting direction D1 of the convex part 959 and the width in the orthogonal direction D2 of the convex part 959 are equal to each other.

With working example D2, the convex part 959 is provided on the foam 955, so by adhering the container side filter 273 on the case 22 in a state with the coil spring 957 and the foam 955 housed inside the recess 270, it is possible to constitute the convex part 950 of the container side filter 273. The foam 955 is positioned between the container side filter 273 and the liquid holding portion 200 so as to contact the container side filter 273, and has a convex part 959 on the surface that contacts the container side filter 273. In this way, by forming the foam 955 having the convex part 959 in advance, it is possible to simplify the manufacturing process of incorporating the projecting structure in the cartridge 20. With working example D2, the member biasing the foam 955 toward the container side filter 273 side is not limited to the coil spring 957. As the member for biasing the foam 955 toward the container side filter 273 side, for example, it is possible to use a flat spring or various types of elastic member such as rubber or the like.

WORKING EXAMPLE D3

Figure 45:
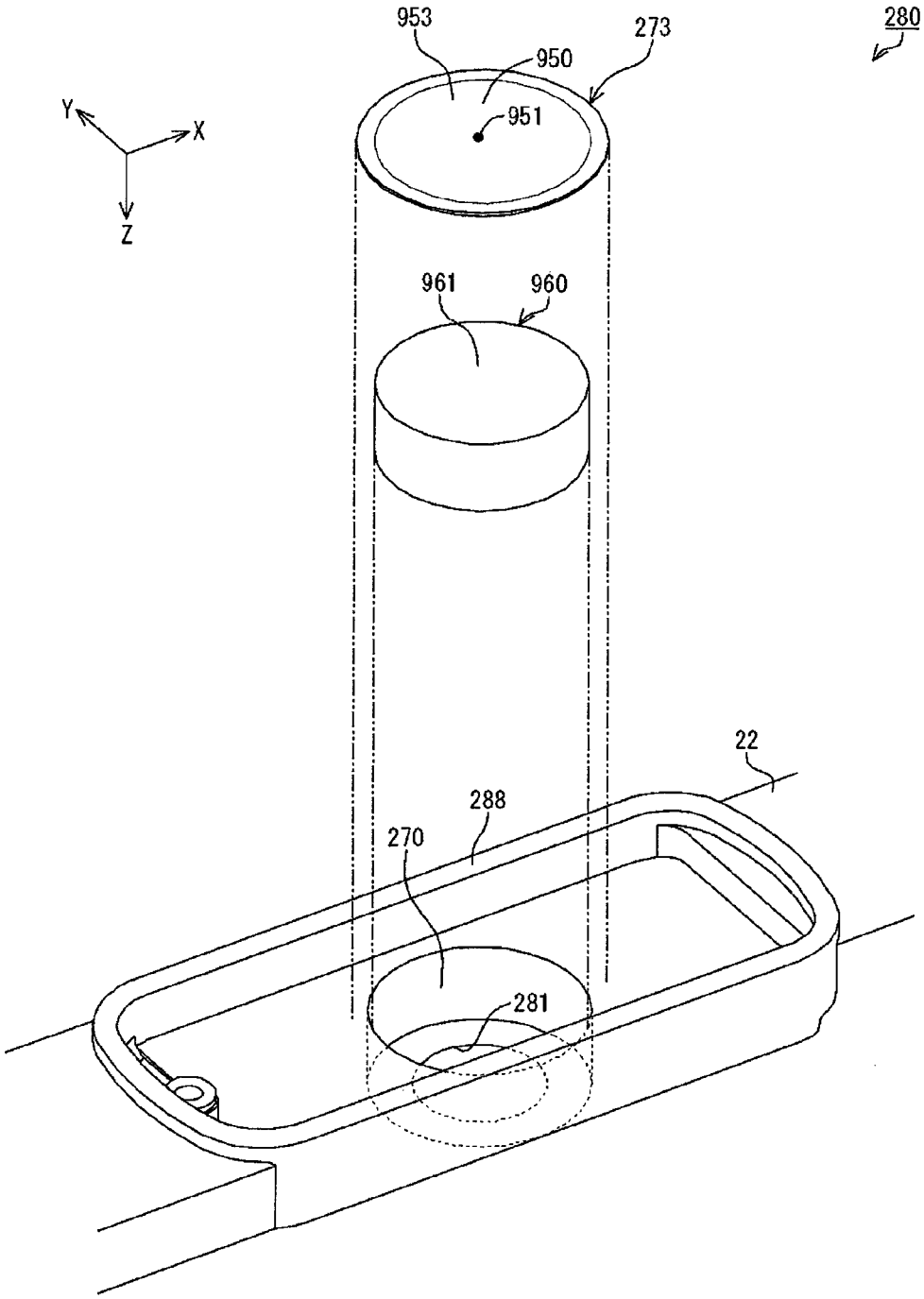
FIG. 45 is an exploded view of the liquid supply portion with working example D3.

With the cartridge 20 of working example D3, as shown in FIG. 45, the liquid supply portion 280 has the container side filter 273 and a foam 960. The cartridge 20 of the working example D3 has the same constitution as the cartridge 20 of working example D2 except for the coil spring 957 of the cartridge 20 being omitted and the foam 955 being replaced by the foam 960. Because of this, hereafter, for constitutions that are the same as those of working example D2, the same code numbers as working example D2 are given, and a detailed description is omitted.

The foam 960 is inlayed inside the recess 270. Then, in a state inlayed inside the recess 270, the foam 960 projects further than the recess 270 to the opposite side to the liquid holding portion 200 side, specifically, further than the recess 270 in the −Z axis direction. With working example D3, a projecting structure for forming the convex part 950 of the container side filter 273 is provided on the foam 960. The foam 960 having the projecting structure includes the convex part 961. With working example D3, the convex part 961 constitutes at least a portion of the projecting structure. The convex part 961 is provided on the container side filter 273 side of the foam 960. With the foam 960, the convex part 961 has a projecting part that projects facing the container side filter 273 side, specifically, facing the −Z axis direction. The width in the mounting direction D1 of the convex part 961 is the same as the width of the convex part 950 or is smaller than the width of the convex part 950. Also, the width in the orthogonal direction D2 of the convex part 961 is the same as the width of the convex part 950 or is smaller than the width of the convex part 950. Furthermore, the width in the mounting direction D1 of the convex part 961 and the width in the orthogonal direction D2 of the convex part 961 are equal to each other.

With working example D3, the coil spring 957 is omitted, so compared to working example D2, it is possible to reduce the cost for the cartridge 20 and to simplify the manufacturing cost of the cartridge 20. Also, with the working example D3, the convex part 961 is provided on the foam 960, so by adhering the container side filter 273 to the case 22 in a state with the foam 960 housed inside the recess 270, it is possible to constitute the convex part 950 of the container side filter 273. The foam 960 is positioned between the container side filter 273 and the liquid holding portion 200 so as to contact the container side filter 273, and has the convex part 961 on the surface in contact with the container side filter 273. In this way, by forming in advance the foam 960 having the convex part 961, it is possible to simplify the manufacturing process of incorporating the projecting structure in the cartridge 20.

WORKING EXAMPLE D4

With the fourth embodiment as well, the same as the respective first embodiment through the third embodiment, using a cap correlating respectively to the cap 711, the cap 811, and the cap 920, it is possible to constitute the convex part 950 on the container side filter 273. With the fourth embodiment, an example of constituting the convex part 950 on the container side filter 273 using a cap attached to the cartridge 20 is used as working example D4. With working example D4 as well, the same effect as with working example C4 can be obtained.

With the fourth embodiment, it is possible to use the respective working example D1 through working example D4 individually. Also, with the fourth embodiment, it is possible to use a constitution that combines a number of working example D1 through working example D4.

As combinations among the working example D1 through working example D4, examples include a combination of working example D1 and working example D2, a combination of working example D1 and working example D3, a combination of working example D2 and working example D4, a combination of working example D3 and working example D4, a combination of working example D1 and working example D2 and working example D4, a combination of working example D1 and working example D3 and working example D4 and the like.

We will describe modification examples respectively for the first embodiment through the fourth embodiment.

MODIFICATION EXAMPLE 1

Figure 46:
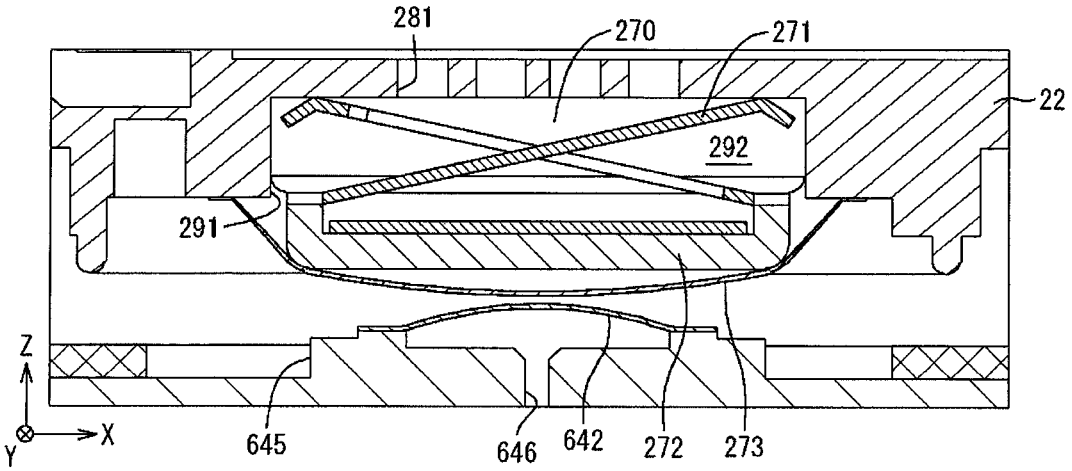
FIG. 46 is an explanatory drawing showing another mode of the device side filter.

For the respective first embodiment through fourth embodiment noted above, as shown in FIG. 46, it is also possible to use a mode by which the device side filter 642 is boosted in a convex form being convex facing the container side filter 273 side (+Z axis direction). With this mode, it is possible to have the container side filter 273 and the device side filter 642 be in contact with each other in convex form, so it is possible to further avoid air becoming trapped between the container side filter 273 and the device side filter 642.

MODIFICATION EXAMPLE 2

For the respective first embodiment through fourth embodiment noted above, as noted in FIG. 47A, it is also possible to use a mode by which the device side filter 642 is depressed in recess form being depressed facing the opposite side to the container side filter 273 side (−Z axis direction). With this mode, for example, when the cartridge 20 is removed from the holder 60 or the like, it is possible to make it easier to receive the ink from the removed cartridge 20 in the recess of the device side filter 642. By doing this, it is possible to make it easier to avoid spattering of ink that dripped from the cartridge 20.

Figure 47A:
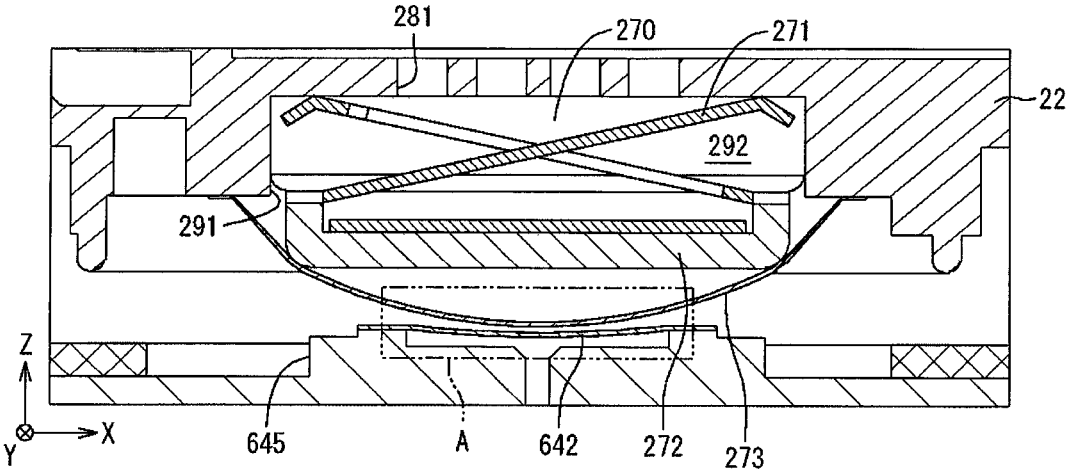
FIGS. 47A and 47B are explanatory drawings showing another mode of the device side filter.
Figure 47B:
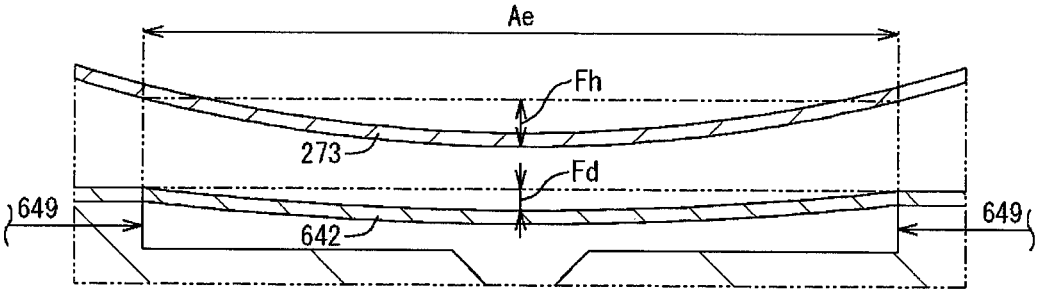

With this mode, as shown in FIG. 47B which is an enlarged view of the A part in FIG. 47A, within the area Ae enclosed by a support part 649 that supports the device side filter 642, a projection volume Fh of the container side filter 273 is greater than a recess volume Fd of the device side filter 642. This requirement is expressed when the curve of the device side filter 642 is greater than the curve of the container side filter 273 in a case when both the boosting of the container side filter 273 and the indentation of the device side filter 642 are spherical surfaces.

Alternatively, this constitution can be said another way as when the container side filter 273 has a convex form that is convex facing the device side filter 642, and the device side filter 642 has a concave form that is concave facing the container side filter 273, the top part of the convex form of the container side filter 273 in the direction facing the device side filter 642 is in a state that can be in contact with a portion of the concave form of the device side filter 642.

By this requirement, together with a drop in the −Z axis direction of the liquid supply portion 280, with the contact start part of the container side filter 273 and the device side filter 642 as the base point, the mutual contact area broadens in the direction moving away in the X axis direction. By doing this, it is possible to obtain the same effects as the embodiments noted above. The indentation of the device side filter 642 can be formed, for example, by adhering the device side filter 642 to the support part 649 in a state with the device side filter 642 pressed in the −Z axis direction.

MODIFICATION EXAMPLE 3

The support member 275 and the foam 272 with the respective first embodiment through fourth embodiment noted above can also be formed as an integrated unit using a hard, porous member, for example. Also, the biasing member 274, the support member 275, and the foam 272 can also be formed as an integrated unit. For example, by forming the foam 272 to be thick, it is possible to have the foam 272 function as the biasing member. Then, using the biasing force of the foam 272, it is possible to bias the container side filter 273 in the direction facing the discharge port 291 from the liquid holding portion 200. It is also possible to form the container side filter 273 and the foam 272 as an integrated unit.

MODIFICATION EXAMPLE 4

It is also possible to not provide holes for the inclined part 273*c* of the container side filter 273 for the respective first embodiment through fourth embodiment noted above. Specifically, the container side filter 273 can also be constituted without providing holes for the other parts as long as only the part in contact with the device side 642 is porous.

MODIFICATION EXAMPLE 5

With the respective first embodiment through fourth embodiment noted above, the container side filter 273 had a form which projected facing the device side filter 642. The container side filter 273 can also have a form that is hollow on the inside, for example. In other words, the container side filter 273 can also project facing the side opposite the device side filter 642. However, in this case, to suppress the occurrence of air bubbles when mounting the cartridge 20, it is preferable to have the device side filter 642 project facing the container side filter 273. Also, in a form for which the container side filter 273 projects facing the device side filter 642, the device side filter 642 can project facing the container side filter 273 or can project facing the side opposite the container side filter 273.

MODIFICATION EXAMPLE 6

Figure 48:
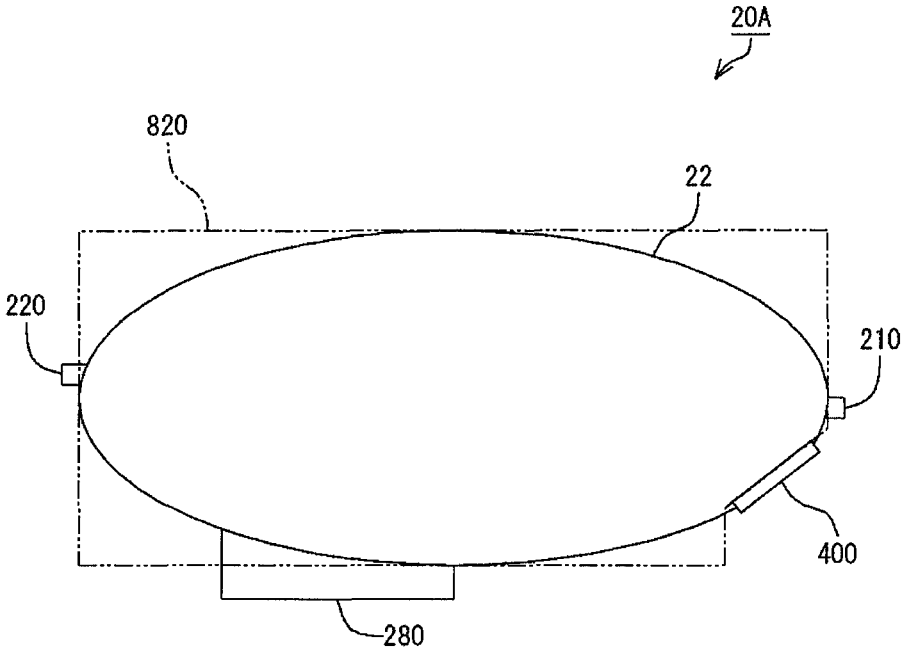
FIG. 48 is a perspective view showing the cartridge of modification example 6.

As shown in FIG. 48, with the cartridge 20A of modification example 6, the case 22 constituting the outer shell is constituted by a surface including a curved surface. With the cartridge 20A as well, it is possible to obtain the same effect as with the cartridge 20. In FIG. 48, the contour area 820 which is the area outlining the cartridge 20 is shown by a double dot dash line. In this way, as long as the outline of the case 22 is within the scope of the contour area 820, it is possible to use various outline forms including a curved surface or flat surface.

MODIFICATION EXAMPLE 7

Figure 49:
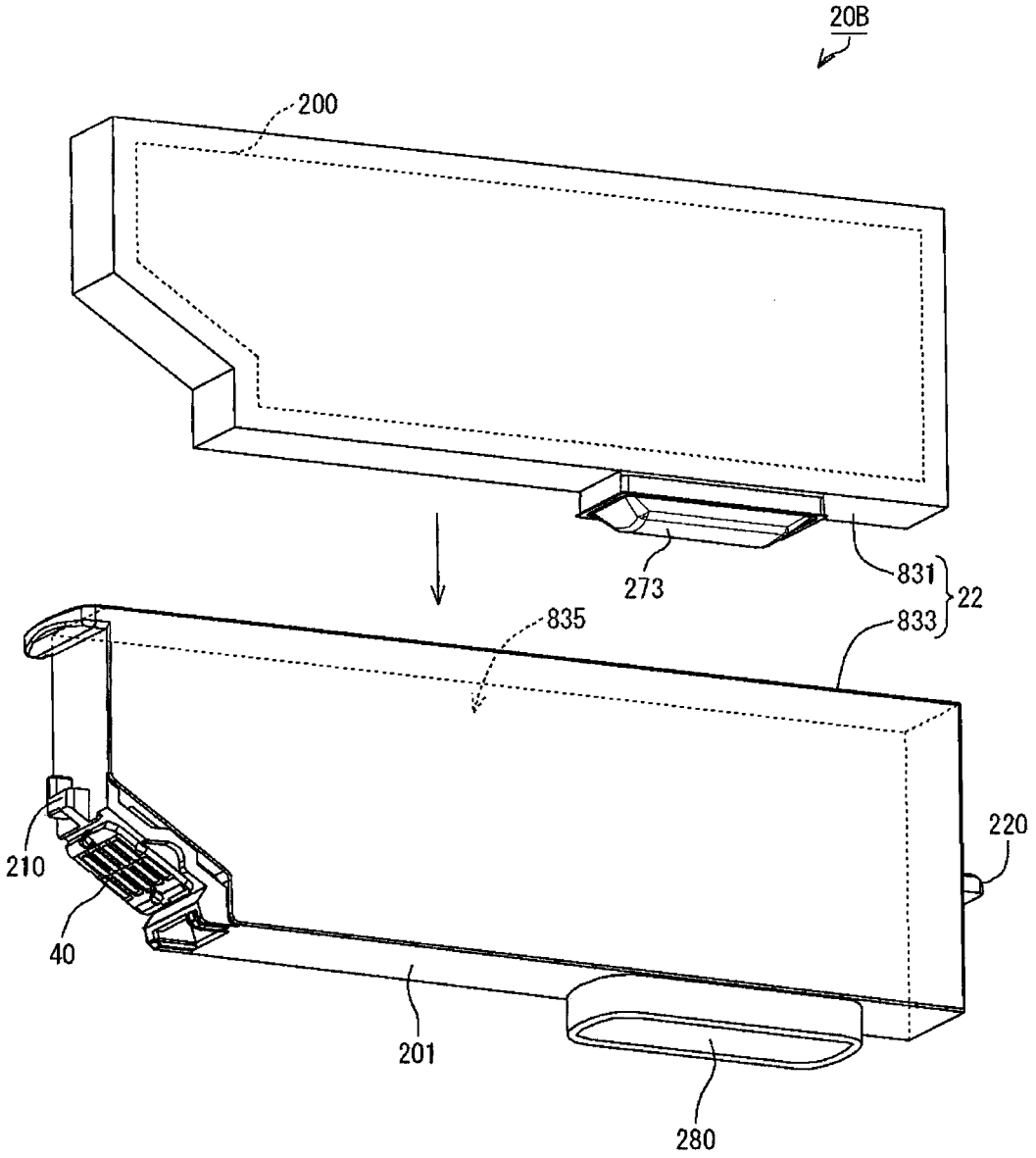
FIG. 49 is a perspective view showing the cartridge of modification example 7.

As shown in FIG. 49, with the cartridge 20B of modification example 7, the case 22 has a first member 831 and a second member 833. The first member 831 and the second member 833 are constituted as mutually separate bodies. The liquid holding portion 200 in which the ink is held is provided on the first member 831. Furthermore, the recess 270 and the discharge port 291 (not illustrated) are provided on the first member 831. The flat spring 271 and the foam 272 (not illustrated) are housed inside the recess 270 of the first member 831. Then, the container side filter 272 that covers the recess 270 from the outside is provided on the first member 831. Ink is held inside the liquid holding portion 200 of the first member 831.

The circuit substrate 40, the liquid supply portion 280, the first projecting part 210, and the second projecting part 220 are provided on the second member 833. A recess 835 is provided on the second member 833. The first member 831 is constituted to be able to be housed inside the recess 835. The liquid supply portion 280 is provided in an area overlapping the container side filter 273 of the first member 831. An opening part (not illustrated) that pierces through the bottom surface 201 is provided on the liquid supply portion 280. The interior and exterior of the recess 835 are passed through via this opening part. Because of this, in a state with the first member 831 housed inside the recess 835 of the second member 833, the container side filter 273 of the first member 831 is exposed via the opening part of the liquid supply portion 280.

With the constitution noted above, it is possible to mount the second member 833 in the holder 60. Then, in a state with the second member 833 mounted in the holder 60, it is possible to connect the device side filter 642 (FIG. 2) to the container side filter 273 of the first member 831. With cartridge 20B as well, it is possible to obtain the same effects as with the cartridge 20. Furthermore, with the cartridge 20B, if the ink inside the cartridge 20B runs out, the operator can exchange the first member 831 with a new first member 831. By doing this, it is possible to use the ink held in the new first member 831. Also, if the ink inside the cartridge 20B runs out, the operator can refill the first member 831 with new ink. By doing this, it is possible to use the new ink refilled in the first member 831. In this way, with the cartridge 20B, it is possible to repeatedly use the second member 833.

MODIFICATION EXAMPLE 8

Figure 50:
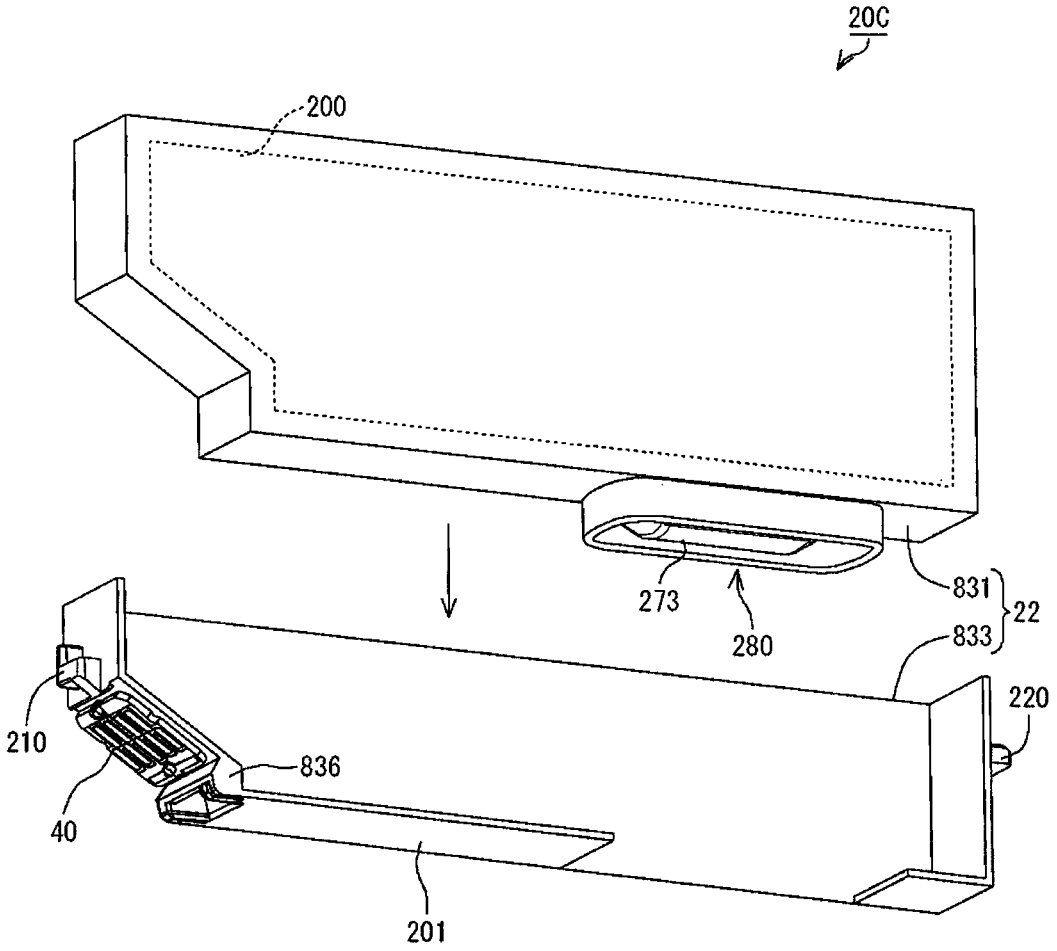
FIG. 50 is a perspective view showing the cartridge of modification example 8.

As shown in FIG. 50, the cartridge 20C of modification example 8 has a portion of a side surface 836 of the second member 833 removed. Then, the first member 831 reaches the area for which the side surface 836 is removed. Except for these points, the cartridge 20C has the same constitution as the cartridge 20B. Because of this, hereafter, for constitutions that are the same as those of the cartridge 20B, the same code numbers as cartridge 20B are used, and a detailed description is omitted. For the cartridge 20C as well, it is possible to obtain the same effects as the cartridge 20B. Furthermore, compared to the cartridge 20B, it is possible to expand the first member 831 by the amount for which the side surface 836 was removed. As a result, with the cartridge 20C, compared to the cartridge 20B, it is possible to increase the volume of ink held in the liquid holding portion 200.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid holding container adapted to supply liquid to a liquid introduction portion of a liquid consuming device, the liquid holding container comprising:

a container including a liquid holding portion for holding the liquid, and a discharge port in communication with the liquid holding portion for discharging the liquid to the liquid introduction portion;

a first porous member provided on the discharge port for contacting the liquid introduction portion, the first porous member having a projecting part projecting in a direction from the liquid holding portion toward the discharge port; and a biasing member provided on a side of the liquid holding portion of the first porous member to bias the first porous member in the direction from the liquid holding portion toward the discharge port.

2. A liquid supply system comprising:

the liquid holding container according to claim 1, and the liquid consuming device for introducing the liquid from the liquid holding container, wherein the liquid consuming device has the liquid introduction portion for introducing the liquid from the liquid discharge port, the liquid introduction portion has a cylindrical body and a second porous member provided on the cylindrical body, the first porous member has a convex form which is convex facing the second porous member, the second porous member has a concave form which is concave facing the first porous member, and a top part of the convex form of the first porous member in a direction facing the second porous member contacts a portion of the concave form of the second porous member.

3. A liquid supply system comprising:

the liquid holding container according to claim 1, and the liquid consuming device for introducing the liquid from the liquid holding container, wherein the liquid consuming device has the liquid introduction portion for introducing the liquid from the liquid discharge port, the liquid introduction portion has a cylindrical body and a second porous member provided on the cylindrical body, the first porous member has a convex form which is convex facing the second porous member, the second porous member has a convex form which is convex facing the first porous member, and a top part of the convex form of the first porous member in a direction facing the second porous member contacts a portion of the convex form of the second porous member.

4. A liquid holding container adapted to supply liquid to a liquid introduction portion of a liquid consuming device, the liquid holding container comprising:

a container including a liquid holding portion for holding the liquid, and a discharge port in communication with the liquid holding portion for discharging the liquid to the liquid introduction portion; and a porous member provided on the discharge port for contacting the liquid introduction portion, the porous member having a projecting part projecting in a direction from the liquid holding portion toward the discharge port, and the projecting part having a top part for contacting the liquid introduction portion, wherein the top part extends in a straight line, and the top part has a ridge that extends through a center of the porous member along a first direction or a second direction, and the first direction and the second direction are orthogonal to a direction in which the liquid is discharged from the discharge port to the liquid introduction portion.

5. The liquid holding container according to claim 4, wherein a shape of a cross section, cutting the projecting part at a surface passing through the top part, has a curved line that does not include an inflection point, and the top part is always positioned over the curved line part.

6. The liquid holding container according to claim 4, wherein a portion of the projecting part to be in contact with the liquid introduction portion is a circular shape for which a shape of a cross section cutting in the direction from the liquid holding portion toward the discharge port includes an oval or a perfect circle.

7. The liquid holding container according to claim 4, wherein when two directions orthogonal to a direction in which the liquid is discharged from the discharge port to the liquid introduction portion are called a first direction and a second direction, and when the first direction and the second direction are orthogonal to each other, the porous member has a first width in the first direction and a second width in the second direction, the first width is greater than the second width, and the top part extends in the straight line along the first direction.

8. The liquid holding container according to claim 4, wherein the porous member has a first part containing the top part and a second part that does not contain the top part, and in a process of mounting the liquid holding container in the liquid consuming device, the first part projects further than the second part in the direction from the liquid holding portion toward the discharge port so that the first part is in contact with the liquid introduction portion ahead of the second part.

9. The liquid holding container according to claim 4, wherein a cross section of the porous member when the porous member is cut at a surface parallel to a direction in which the liquid is discharged from the discharge port to the liquid introduction portion has a curved line, and the top part is positioned over the curved line.

10. The liquid holding container according to claim 4, wherein a projecting structure is equipped between the porous member and the liquid holding portion, and in a state before the liquid holding container is mounted in the liquid consuming device, the top part of the porous member is formed by the projecting structure.

11. The liquid holding container according to claim 10, wherein the projecting structure contains a flow path forming member, and the flow path forming member is positioned between the porous member and the liquid holding portion so as to contact the porous member, and has a convex part on a surface in contact with the porous member.

12. The liquid holding container according to claim 10, wherein the projecting structure contains a flow path forming member and a convex member, the flow path forming member is positioned between the porous member and the liquid holding portion so as to contact the porous member, and the convex member is positioned between the porous member and the flow path forming member so as to contact the porous member.

13. A liquid holding container adapted to supply liquid to a liquid introduction portion of a liquid consuming device, the liquid holding container comprising:

a container including a liquid holding portion for holding the liquid, and a discharge port in communication with the liquid holding portion for discharging the liquid to the liquid introduction portion; and a porous member provided on the discharge port for contacting the liquid introduction portion. the porous member having a projecting part projecting in a direction from the liquid holding portion toward the discharge port, the Projecting part having a top part for contacting the liquid introduction portion, wherein a projecting structure is equipped between the porous member and the liquid holding portion and in a state before the liquid holding container is mounted in the liquid consuming device, the top part of the porous member is formed by the projecting structure, the projecting structure contains a flow path forming member and a biasing member, the flow path forming member is positioned between the porous member and the liquid holding portion so as to be in contact with the porous member, and the biasing member is positioned between the flow path forming member and the liquid holding portion so as to be in contact with the flow path forming member, and has a convex part on a surface in contact with the flow path forming member.

14. A liquid holding container adapted to supply liquid to a liquid introduction portion of a liquid consuming device, the liquid holding container comprising:

a container including a liquid holding portion for holding the liquid, and a discharge port in communication with the liquid holding Portion for discharging the liquid to the liquid introduction portion; and a porous member provided on the discharge port for contacting the liquid introduction portion, the porous member having a projecting part projecting in a direction from the liquid holding portion toward the discharge port, the projecting part having a top part for contacting the liquid introduction portion, wherein a projecting structure is equipped between the porous member and the liquid holding portion, and in a state before the liquid holding container is mounted in the liquid consuming device, the top part of the porous member is formed by the projecting structure, the projecting structure contains a flow path forming member, a biasing member, and a convex member, the flow path forming member is positioned between the porous member and the liquid holding portion so as to be in contact with the porous member, and the convex member is positioned between the flow path forming member and the biasing member so as to be in contact with the flow path forming member.

* * * * *